US010663912B2

(12) United States Patent
Ao et al.

(10) Patent No.: US 10,663,912 B2
(45) Date of Patent: May 26, 2020

(54) MOVING APPARATUS HAVING EXPOSURE DEVICE

(71) Applicant: FUJI XEROX CO., LTD., Tokyo (JP)

(72) Inventors: Satoshi Ao, Kanagawa (JP); Hiroyuki Kono, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/052,175

(22) Filed: Aug. 1, 2018

(65) Prior Publication Data

US 2019/0278215 A1 Sep. 12, 2019

(30) Foreign Application Priority Data

Mar. 8, 2018 (JP) ..... 2018-042319
Mar. 8, 2018 (JP) ..... 2018-142320

(51) Int. Cl.
*G03G 21/00* (2006.01)
*G03G 15/04* (2006.01)
*G03G 21/16* (2006.01)

(52) U.S. Cl.
CPC ..... *G03G 21/1666* (2013.01); *G03G 21/1633* (2013.01); *G03G 21/1647* (2013.01); *G03G 2221/1636* (2013.01)

(58) Field of Classification Search
CPC ..... G03G 21/1647; G03G 21/1666; G03G 21/1633; G03G 2221/1636; G03G 2221/169
USPC ..... 399/118
See application file for complete search history.

(56) References Cited

U.S. PATENT DOCUMENTS 9,069,325 B2 * 6/2015 Kitamura ..... G03G 21/1633
2009/0180798 A1 7/2009 Itabashi
2009/0190953 A1 7/2009 Okabe
2013/0259516 A1 * 10/2013 Ikeda ..... G03G 15/22 399/110
2013/0308983 A1 11/2013 Takano
2016/0018779 A1 * 1/2016 Takano ..... G03G 21/1633 347/118
2017/0277115 A1 * 9/2017 Yamamura ..... G03G 21/1623
2018/0095405 A1 * 4/2018 Iwai ..... G03G 15/04054
2018/0321636 A1 * 11/2018 Chueh ..... G03G 21/1619

FOREIGN PATENT DOCUMENTS

JP 2009-134004 A 6/2009
JP 5029388 B2 9/2012
JP 2016128844 A * 7/2016
JP 2016206333 A * 12/2016
JP 6128414 B2 5/2017

* cited by examiner

*Primary Examiner* — Robert B Beatty
(74) *Attorney, Agent, or Firm* — Sughrue Mion, PLLC

(57) ABSTRACT

A moving apparatus includes: an exposure unit that forms a latent image by exposure; a support unit that supports the exposure unit so that the exposure unit is displaceable, a guide groove guiding a movement of the support unit to move the exposure unit between an exposure position and a retracted position; a first link unit that includes a first shaft portion, and a second shaft portion that swings about the first shaft portion to transmit force used to move the exposure unit; a second link unit that connects the support unit and the second shaft portion of the first link unit; and a coupling shaft that connects the support unit and the second link unit and is guided by the guide groove.

8 Claims, 33 Drawing Sheets

MOVING APPARATUS HAVING EXPOSURE DEVICE

CROSS-REFERENCE TO RELATED APPLICATIONS

This application is based on and claims priority under 35 USC 119 from Japanese Patent Application No. 2018-042319 filed Mar. 8, 2018 and Japanese Patent Application No. 2018-042320 filed Mar. 8, 2018.

BACKGROUND

(i) Technical Field

The present invention relates to a moving apparatus, an image forming apparatus, and a link operating apparatus.

(ii) Related Art

As a technology in the related art that moves an exposure unit, which forms a latent image through exposure, between an exposure position and a retracted position using a link mechanism, technologies disclosed in Japanese Patent No. 6128414 and Japanese Patent No. 5029388 are known, for example.

Japanese Patent No. 6128414 discloses a retracting mechanism that moves a latent image forming unit, which forms a latent image on a surface of a latent image carrier, between a latent image forming position at which the latent image is formed on the surface of the latent image carrier and a retracted position which is spaced apart from the latent image carrier. The retracting mechanism includes a rotating member which is rotatably supported on a main body of an image forming apparatus and rotates to move the latent image forming unit between the latent image forming position and the retracted position, and a biasing unit which biases the rotating member. The retracting mechanism further includes a regulating unit which is configured to switch a direction from a prevention direction in which biasing force of the biasing unit prevents a rotation of the rotating member to a direction opposite to the prevention direction while the latent image forming unit is moved from the retracted position to the latent image forming position by rotating the rotating member, so as to regulate the rotation of the rotating member, which is caused by the biasing force of the biasing unit, when the latent image forming unit is at the latent image forming position.

Japanese Patent No. 6128414 discloses that the retracting mechanism includes a first link member as the rotating member rotatably supported on the main body of the apparatus, a second link member as a holding member holding an exposure device as the latent image forming unit and rotatably supported on the main body of the apparatus, and a coupling mechanism as the coupling unit which couples the first link member and the second link member.

Japanese Patent No. 6128414 discloses that the retracting mechanism is provided with an operating member having a hook portion which hooks a hooked portion (boss portion) of the rotating member (first link member) to an opening/closing cover, which opens/closes an opening in the main body of the apparatus, at the time of opening/closing the cover, to rotate the rotating member, and the hook portion of the operating member and (the hooked portion of) the rotating member are not in contact with each other when the opening/closing cover is in a closed state.

Japanese Patent No. 5029388 described below discloses an image forming apparatus that has plural process cartridges which have photoconductors, a support member which detachably supports the plural process cartridges and is configured to be able to be drawn from a main body of the apparatus, and plural exposure members which are movable between an exposure position adjacent to the photoconductors and a retracted position spaced apart from the photoconductors and have plural light emitting parts arranged to expose the photoconductors.

Japanese Patent No. 5029388 discloses that in the image forming apparatus, the support member has a pair of side plates which face each other in a main direction in which light emitting parts are arranged, each of the pair of side plates has a guide groove formed to guide the exposure member that moves between the exposure position and the retracted position, the guide groove has a positioning portion which positions the exposure member in a sub-direction perpendicular to the main direction and the exposure direction, and the exposure member is mounted on the support member by an arm member which supports the exposure member so that the exposure member is rotatable between the exposure position and the retracted position.

Japanese Patent No. 5029388 also discloses a configuration having a first biasing unit which biases the exposure member toward the photoconductor, or a second biasing unit which biases the exposure member toward the retracted position when the support member is drawn from the main body of the apparatus.

SUMMARY

An aspect of non-limiting embodiments of the present disclosure relates to a moving apparatus which may smoothly move an exposure unit even in a case in which a path of a guide groove, which is used to move the exposure unit between an exposure position and a retracted position, is different from a trajectory along which a shaft portion in a first link unit, which swings to transmit force used to move the exposure unit, swings, and an image forming apparatus using the moving apparatus.

Another aspect of non-limiting embodiments of the present disclosure a link operating apparatus such that when a part of a moving unit rotatably supported is brought into contact with a part of a moving contact unit to rotate the rotating unit, the link operating apparatus may increase an amount by which a link unit, which is connected to a part of a rotating unit and displaced in accordance with the rotation of the rotating unit, is moved in a direction away from the rotating unit, and an image forming apparatus using the link operating apparatus.

Aspects of certain non-limiting embodiments of the present disclosure overcome the above disadvantages and other disadvantages not described above. However, aspects of the non-limiting embodiments are not required to overcome the disadvantages described above, and aspects of the non-limiting embodiments of the present disclosure may not overcome any of the problems described above.

According to an aspect of the present disclosure, there is provided a moving apparatus includes: an exposure unit that forms a latent image by exposure; a support unit that supports the exposure unit so that the exposure unit is displaceable, a guide groove guiding a movement of the support unit to move the exposure unit between an exposure position and a retracted position; a first link unit that includes a first shaft portion, and a second shaft portion that swings about the first shaft portion to transmit force used to move the exposure unit; a second link unit that connects the support unit and the second shaft portion of the first link unit; and a coupling shaft that connects the support unit and the second link unit and is guided by the guide groove.

BRIEF DESCRIPTION OF THE DRAWINGS

Exemplary embodiment(s) of the present invention will be described in detail based on the following figures, wherein:

FIGS. 22A to 22C illustrate a side coupling portion of the casing, in which FIG. 22A is a perspective view of the side coupling portion, FIG. 22B is a schematic side view of the side coupling portion, and FIG. 22C is another schematic side view of the side coupling portion;

and

Figure 33A:
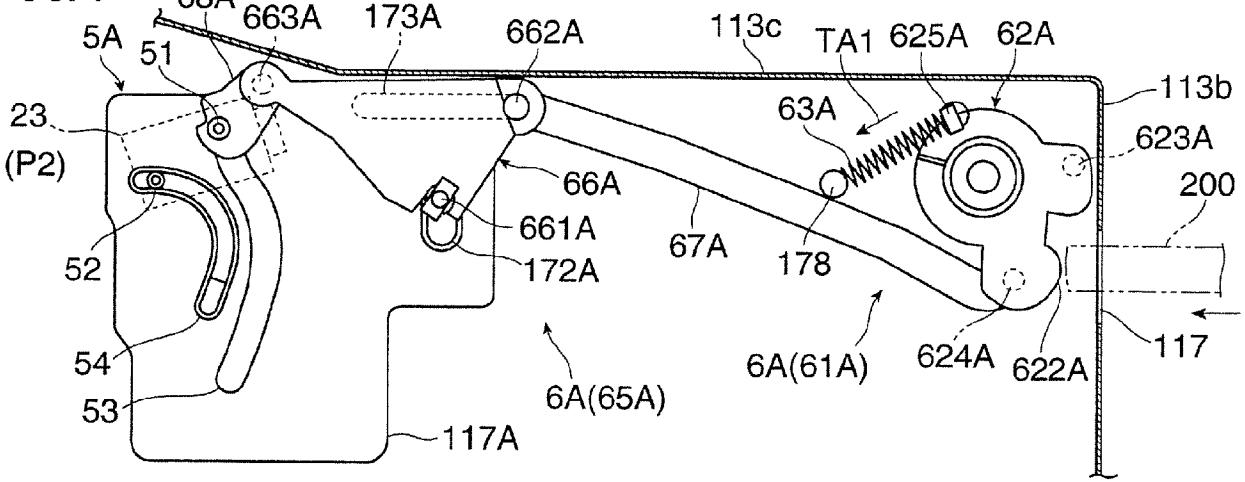
Figure 33B:
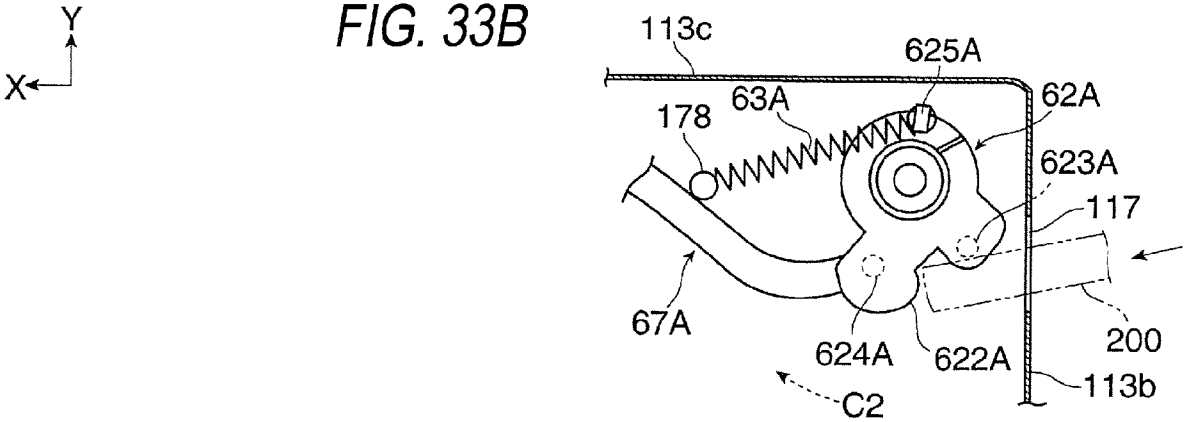

FIGS. 33A and 33B are schematic views for explaining a function of preventing an incorrect operation of the link operating apparatus.

DETAILED DESCRIPTION

Hereinafter, exemplary embodiments of the present invention will be described with reference to the drawings.

First Exemplary Embodiment

Figure 1:
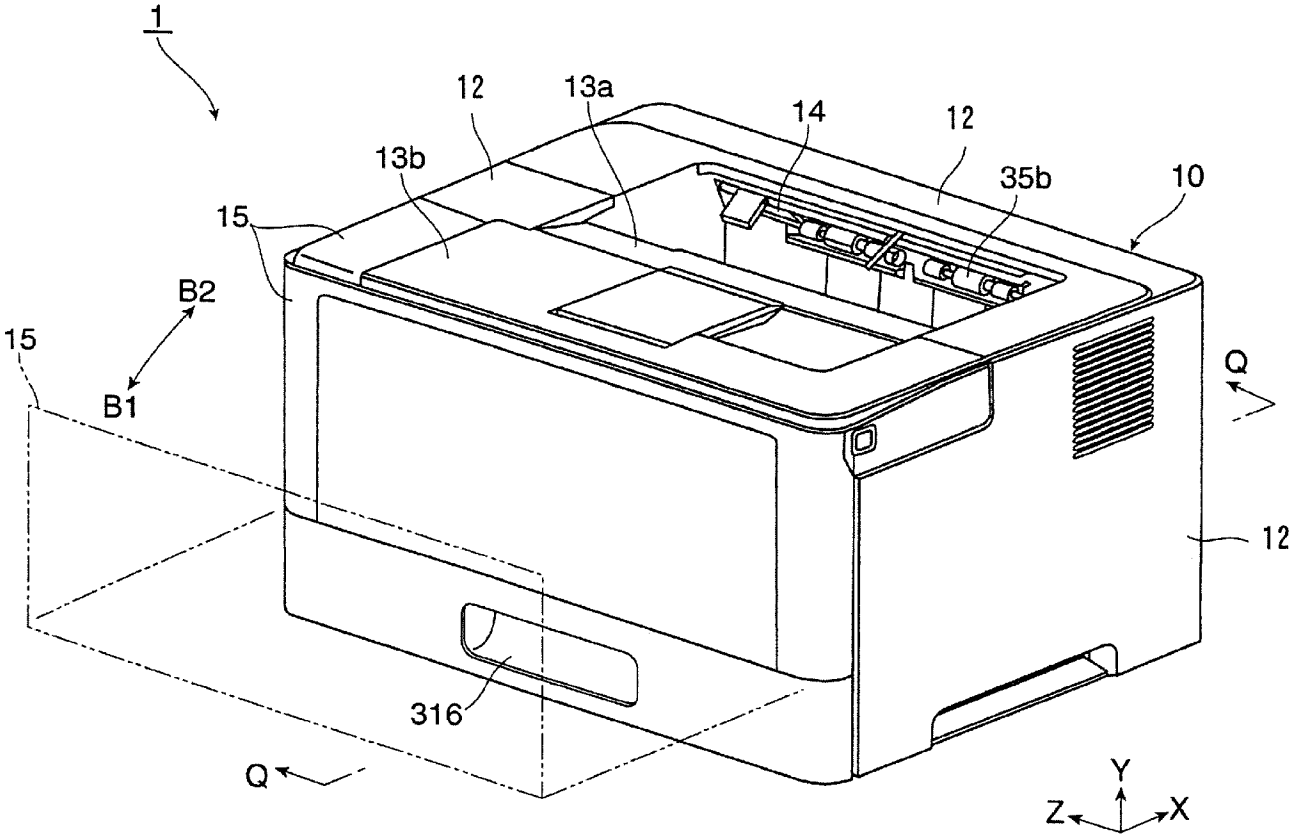
FIG. 1 is a schematic perspective view illustrating an external appearance of an image forming apparatus according to a first exemplary embodiment.
Figure 2:
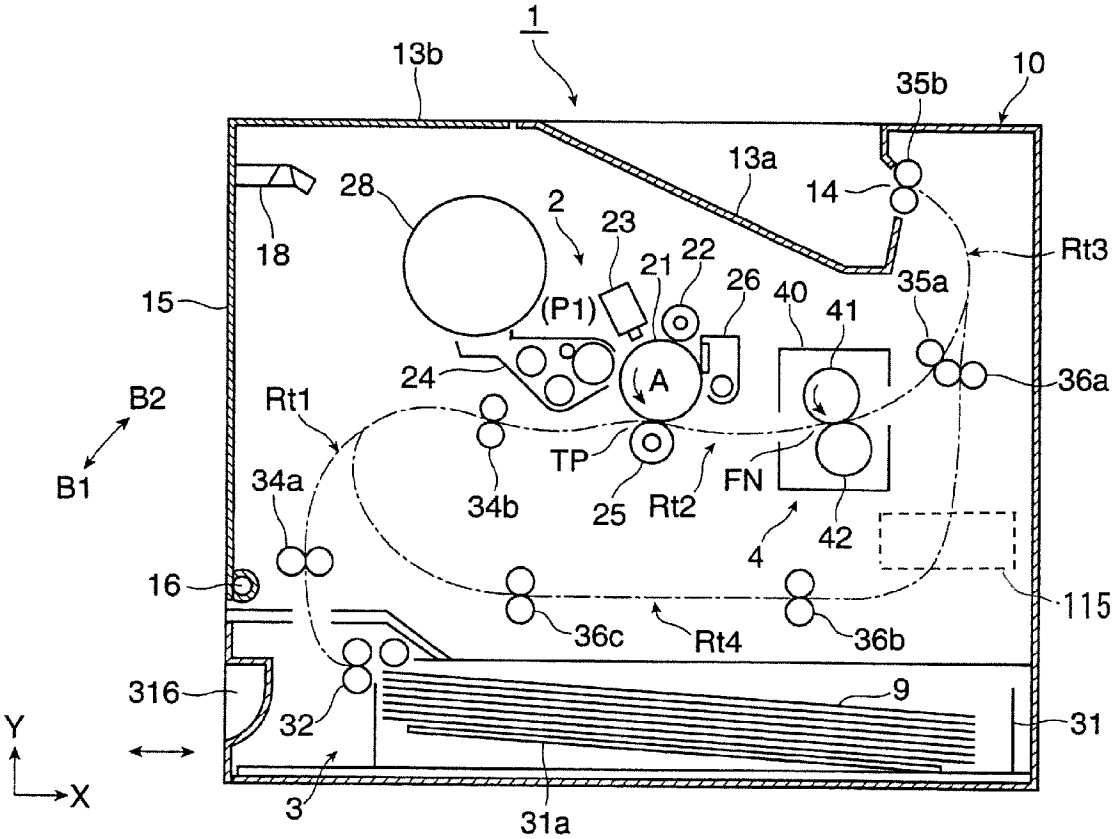
FIG. 2 is a schematic view illustrating a main configuration when viewing a cross section of the image forming apparatus taken along line Q-Q in FIG. 1.
Figure 3:
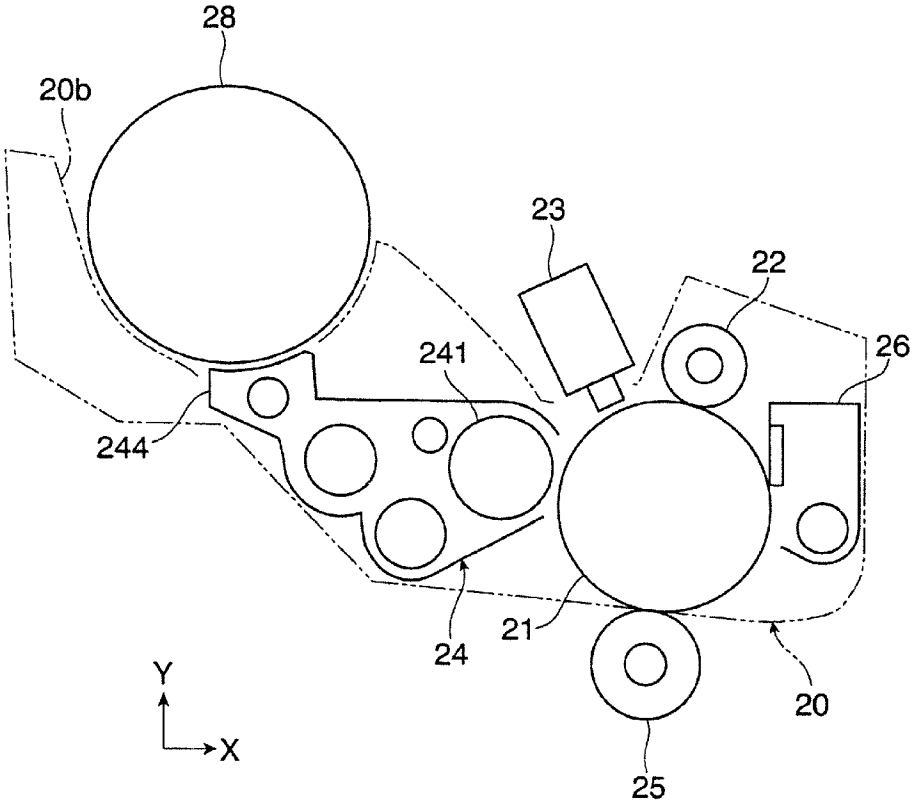
FIG. 3 is a schematic view illustrating an image forming device of the image forming apparatus in FIG. 1.
Figure 4:
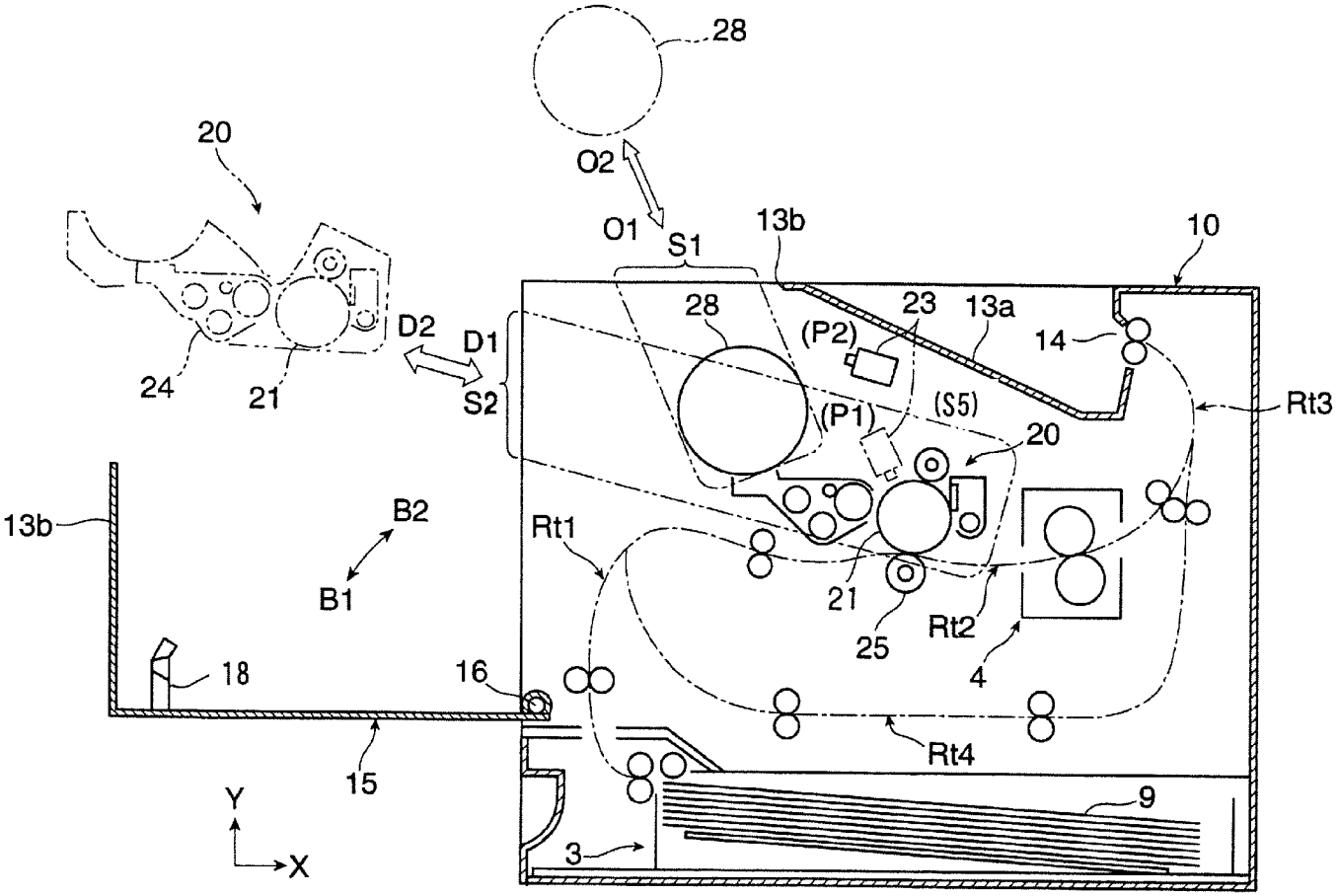
FIG. 4 is a schematic view illustrating a detachable structure part of the image forming apparatus in FIG. 2.

FIGS. 1 to 4 illustrate a first exemplary embodiment of the present invention. FIG. 1 illustrates a schematic view of an external appearance of an image forming apparatus 1 according to the first exemplary embodiment, FIG. 2 illustrates a schematic view of a main configuration of the image forming apparatus 1, FIG. 3 illustrates a schematic view of an image forming device and the like in the image forming apparatus 1, and FIG. 4 illustrates a schematic view of a detachable structure part in the image forming apparatus 1.

<Entire Configuration of Image Forming Apparatus>

The image forming apparatus 1 is configured as a printer which is an example of the image forming apparatus, and forms an image configured with a developer (toner) on a recording sheet 9, which an example of a material to be recorded, based on information about an image which includes letters, photographs, figures, and the like and which are input from the outside.

As illustrated in FIG. 2, the image forming apparatus 1 has, in a casing 10 which is an apparatus main body, an image forming device 2 which forms a toner image formed by toner as a developer by an image forming method such as an electrophotographic process and transfers the toner image to the recording sheet 9, a sheet feeding device 3 which accommodates the necessary recording sheets 9 and supplies the recording sheet 9 to a transfer position of the image forming device 2, and a fixing device 4 which fixes the toner image transferred to the recording sheet 9.

Figure 5:
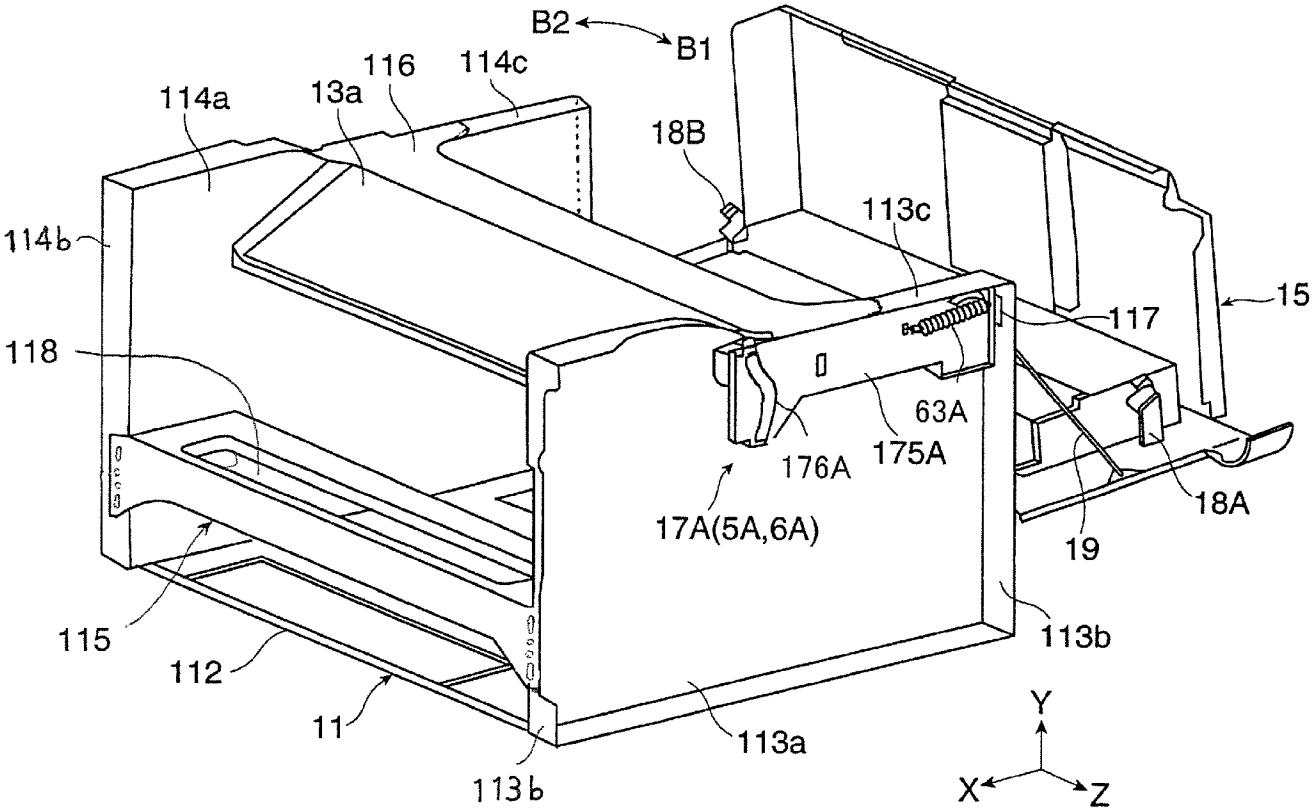
FIG. 5 is a schematic perspective view illustrating a state in which a casing and an opening/closing cover of the image forming apparatus in FIG. 1 are opened.

As illustrated in FIGS. 1 and 5, the casing 10 includes various types of members such as a structure member 11 and an exterior member 12. In addition, a discharging-accommodating unit 13 is provided at an upper side of the casing 10, and the discharging-accommodating unit 13 accommodates the recording sheet 9 which is discharged in a state in which an image is formed on the recording sheet 9. The discharging-accommodating unit 13 is configured as an accommodation surface having an inclined surface portion 13*a* which is provided below an exit port 14 provided in the casing 10, and a horizontal surface portion 13*b* which extends from an upper end of the inclined surface portion 13*a*, and the discharging-accommodating unit 13 is configured to accommodate the recording sheets 9 which are discharged from the exit port 14 and stacked on one another.

As illustrated in FIGS. 2 and 3, the image forming device 2 has a charging device 22, an exposure device 23, a developing device 24, a transfer device 25, a cleaning device 26, and the like which are disposed in this order at a circumference of a photoconductive drum 21 that rotates in a direction indicated by the arrow A.

Among the devices, the charging device 22 is a device which adopts a contact charging method that charges a circumferential surface (an outer circumferential surface portion which is an image forming region) of the photoconductive drum 21 with necessary polarity and electric potential. The exposure device 23 is a device which forms an electrostatic latent image on the circumferential surface of the photoconductive drum 21 by emitting light corresponding to image information (signal) input to the image forming apparatus 1 through various methods after charging the circumferential surface of the photoconductive drum 21. The developing device 24 is a device which forms the toner image by developing the electrostatic latent image on the photoconductive drum 21 by supplying the toner, as the developer, from a developing roller 241. The developer is replenished to the developing device 24 through a replenishing unit 244 from a developer accommodating container 28 that accommodates a developer (mainly, toner) for replenishment. The transfer device 25 is a device which adopts a contact transfer method that transfers the toner image on the photoconductive drum 21 to the recording sheet 9 in an electrostatic manner. The cleaning device 26 is a device which cleans the circumferential surface of the photoconductive drum 21 by removing an unnecessary object such as the toner that remains attached to the circumferential surface of the photoconductive drum 21.

As illustrated in FIG. 3, the image forming device 2 has a structure in which the photoconductive drum 21, the charging device 22, the developing device 24, and the cleaning device 26, which are parts of the image forming device 2, are integrated, and this structure is configured as a detachable unit 20 (a part surrounded by the alternate-long-and-two-short-dashes line) which is detachably mounted on the casing 10 as described below. In addition, the developer accommodating container 28 is also configured as a detachable component detachably mounted on the casing 10 as described below. Further, as illustrated in FIG. 3, a mounting portion 20*b* for mounting the developer accommodating container 28 is provided at a part of a support frame of the detachable unit 20. The mounting portion 20*b* has an approximately semicylindrical and concave shape.

The sheet feeding device 3 is disposed at a position spaced downward apart from the image forming device 2 in a direction of gravity. The sheet feeding device 3 includes a sheet accommodating body 31 which accommodates the plural recording sheets 9, which have sizes and types required to be used to form an image, in a state in which the plural recording sheets 9 are stacked on a loading plate 31*a*, and a delivery device 32 which delivers the recording sheets 9 accommodated in the sheet accommodating body 31, one by one.

The sheet accommodating body 31 is mounted to be able to be drawn from the casing 10, and plural sheet accommodating bodies 31 are equipped in accordance with a usage mode thereof. For example, the sheet accommodating body 31 is operated by a user, for example, holding a concave handle 316 provided on an exterior member of the sheet accommodating body 31 and drawing the sheet accommodating body 31. For example, a recording medium such as plain paper, coated paper, thick paper, or the like, which is cut to a predetermined size, is used as the recording sheet 9.

The fixing device 4 is disposed at a position spaced apart from the image forming device 2 in an approximately horizontal direction (a direction approximately parallel to a coordinate axis X). The fixing device 4 includes a heat rotating body 41 and a pressure rotating body 42 which are in contact with each other and rotated, and provided in the casing 40 having an introducing port and the exit port.

As illustrated in FIG. 2, the heat rotating body 41 is a heat fixing member which rotates in a direction indicated by the arrow, and is configured in the form of a roller, a belt, or the like and heated by a non-illustrated heating unit such that a circumferential surface thereof is maintained at a necessary temperature. The pressure rotating body 42 is a pressure fixing member which is configured in the form of a roller, a belt, or the like and driven to be rotated in a state in which the pressure rotating body 42 is in contact with the heat rotating body 41 with necessary pressure approximately in an axial direction of the heat rotating body 41. In addition, in the fixing device 4, a portion where the heat rotating body 41 and the pressure rotating body 42 are in contact with each other is configured as a fixing processing portion FN that performs necessary fixing processing (heating and pressing) by allowing the recording sheet 9, to which a unfixed toner image is transferred, to pass.

The image forming apparatus 1 has main sheet transport paths for the recording sheet 9 in the casing 10 as indicated by an alternate-long-and-short-dashes line Rt in FIG. 2.

As the main sheet transport paths, there are a supply transport path Rt1 which is provided between the delivery device 32 of the sheet feeding device 3 and a transfer position TP (a position of the photoconductive drum 21 which faces the transfer device 25) of the image forming device 2, a relay transport path Rt2 which is provided between the transfer position TP of the image forming device 2 and the fixing processing portion FN of the fixing device 4, a discharge transport path Rt3 which is provided between the fixing processing portion FN of the fixing device 4 and the exit port 14 of the casing 10, and a double-sided printing transport path Rt4 which is provided between a terminal end (branch portion) of the discharge transport path Rt3 and an intermediate portion (merging portion) of the supply transport path Rt1.

Among the transport paths, the supply transport path Rt1 is formed by using plural transport roller pairs 34*a* and 34*b*, non-illustrated plural transport guide members, or the like. The transport roller pair 34*b* is configured as a pair of so-called registration rollers which starts rotating at a transfer timing to send the recording sheet 9 to the transfer position TP of the image forming device 2.

The discharge transport path Rt3 is formed as a path having an entirely and curvedly raised shape by using plural transport roller pairs 35*a* and 35*b* or non-illustrated plural transport guide members. The transport roller pair 35*b* is configured as a pair of discharge rollers which is provided in front of the exit port 14 and sends the recording sheet 9 to the discharging-accommodating unit 13 after fixing the toner image.

The double-sided printing transport path Rt4 includes the pair of discharge rollers 35*b* which is rotatable forward and reverse and constitutes the terminal end of the discharge transport path Rt3, plural transport roller pairs 36*a*, 36*b*, and 36*c*, a non-illustrated course switching member which switches a course destination of the recording sheet 9, and non-illustrated plural transport guide members. The transport roller pair 36*a* shares a driving roller with the transport roller pair 35*a* in the discharge transport path Rt3.

<Image Forming Operation Performed by Image Forming Apparatus>

An image is formed by the image forming apparatus 1, as described below. Here, a basic image forming operation when forming an image on a single surface of the recording sheet 9 will be described as an example.

For example, in the image forming apparatus 1, when a non-illustrated controller receives a command (signal) for initiating the image forming operation from an information terminal or the like connected to various communication units, the image forming device 2 initiates an image forming operation of forming the toner image.

First, in the image forming device 2, the photoconductive drum 21 starts rotating, the charging device 22 charges the circumferential surface of the photoconductive drum 21 with predetermined polarity and electric potential (in this example, negative polarity), and then the exposure device 23 performs the exposure on the charged circumferential surface of the photoconductive drum 21 based on image information, such that an electrostatic latent image is formed in a necessary pattern. Thereafter, the developing device 24 supplies the electrostatic latent image formed on the circumferential surface of the photoconductive drum 21 with toner, which is a developer charged with necessary polarity (in this example, negative polarity), from the developing roller 241 to perform the developing process, such that the electrostatic latent image is developed as a toner image. Therefore, the toner image is formed on the photoconductive drum 21.

Subsequently, in the image forming device 2, the photoconductive drum 21, which is rotating, transports the toner image to the transfer position TP facing the transfer device 25. Meanwhile, the sheet feeding device 3 sends the recording sheet 9 to the supply transport path Rt1 at the transfer timing so that the recording sheet 9 is supplied to the transfer position TP of the image forming device 2. Further, the transfer device 25 forms a transfer electric field at the transfer position TP of the image forming device 2, thereby transferring the toner image on the photoconductive drum 21 to the single surface of the recording sheet 9 in an electrostatic manner. In addition, in the image forming device 2, the cleaning device 26 continuously cleans the circumferential surface of the photoconductive drum 21 at timings including a timing after the transfer process.

Subsequently, the recording sheet 9, to which the toner image is transferred, is sent to the relay transport path Rt2 and transported to the fixing device 4 by receiving transport force in a state in which the recording sheet 9 is interposed between the photoconductive drum 21 and the transfer device 25 which are rotating. In the fixing device 4, the recording sheet 9 is introduced to and passes through the fixing processing portion FN between the heat rotating body 41 and the pressure rotating body 42 which are rotating. The toner, as the toner image, formed on the single surface of the recording sheet 9 is heated and melted under pressure when the recording sheet 9 passes through the fixing processing portion FN, such that the toner is fixed on the recording sheet 9.

Finally, the recording sheet 9, on which the fixing process is finished, is sent and transported to the discharge transport path Rt3 from the fixing processing portion FN of the fixing device 4 and then discharged from the exit port 14 of the casing 10 by the pair of discharge rollers 35*b*, such that the recording sheet 9 is finally accommodated in the discharging-accommodating unit 13.

As described above, a monochrome image configured with monochrome toner is formed on the single surface of one recording sheet 9, and the operation of forming an image on the single surface of the recording sheet 9 is finished. In a case in which a command for performing the image forming operation on the plural recording sheets is made, the series of operations are repeatedly performed in accordance with the number of recording sheets.

An operation of forming images on both surfaces, front and rear surfaces of the recording sheet 9 is performed as the operation of forming an image on the single surface of the recording sheet 9 is similarly performed and then the recording sheet 9, on which the toner image transferred to the single surface (a first surface: the front surface) is fixed completely, is sent to the double-sided printing transport path Rt4.

In this case, the recording sheet 9, on which the toner image is completely fixed on the single surface, is stopped in a state in which the recording sheet 9 is temporarily discharged from the exit port 14 in a state in which a front portion of the recording sheet 9, when the recording sheet 9 is transported, is interposed between the pair of discharge rollers 35*b*, and then a displacement operation for switching the course by the course switching member and reverse rotations of the pair of discharge rollers 35*b* are performed, that is, a so-called switch-back type transport operation is performed, such that the recording sheet 9 is sent from a rear end, when the recording sheet 9 is transported, to the double-sided printing transport path Rt4.

Subsequently, the recording sheet 9 sent to the double-sided printing transport path Rt4 is transported via the double-sided printing transport path Rt4 and then transported to be merged into a front position of the transport roller pair 34*b* in the supply transport path Rt1. Therefore, the recording sheet 9 is sent to the supply transport path Rt1 in a state in which the front and rear surfaces of the recording sheet 9 are reversed.

Finally, similar to the operation of forming an image on the single surface, the recording sheet 9 sent back to the supply transport path Rt1 is sent to the transfer position TP of the image forming device 2 at the transfer timing, such that a toner image is transferred to the other surface (a second surface: the rear surface) of the recording sheet 9, and then the recording sheet 9 is transported to the fixing device 4 such that the toner image is fixed thereon. Finally, similar to the case, the recording sheet 9, which has the front and rear surfaces on which the images are formed, is discharged and accommodated in the discharging-accommodating unit 13.

Accordingly, monochrome images configured with monochrome toner are formed on the front and rear surfaces of one recording sheet 9, and the operation of forming images on both surfaces of the recording sheet 9 is finished.

<Configuration of Detachable Structure Part>

As illustrated in FIG. 4, in the image forming apparatus 1, the detachable unit 20 and the developer accommodating container 28, which constitute parts of the image forming device 2, are structured to be detachable from the casing 10.

As illustrated in FIGS. 4 and 5, all of the operations (work) of detaching the detachable unit 20 and the developer accommodating container 28 are performed in a state in which an opening/closing cover 15 provided at a part of the casing 10 is opened.

As illustrated in FIGS. 1 and 4, the opening/closing cover 15 is opened/closed by swinging the opening/closing cover 15 in the directions indicated by the arrows B1 and B2 about a fulcrum shaft 16 provided on one side surface portion (e.g., front operating surface) of the casing 10. When the opening/closing cover 15 is opened by swinging the opening/closing cover 15 in the direction indicated by the arrow B1, a part of one side surface portion of the casing 10 and a part of an upper surface portion of the casing 10 (a portion where the horizontal surface portion 13*b* of the discharging-accommodating unit 13 is present) may be exposed to the outside (FIGS. 4 and 5).

As illustrated in FIG. 4, in the casing 10 of the image forming apparatus 1, there are provided a first detachment passage space 51 which is a passageway through which the developer accommodating container 28 passes when detaching the developer accommodating container 28, and a second detachment passage space S2 which is a passageway through which the detachable unit 20 passes when detaching the detachable unit 20.

The first detachment passage space 51 is configured as a space that obliquely extends toward a part of the upper surface portion of the casing 10 from the mounting portion 20*b* for mounting the developer accommodating container 28. Therefore, the developer accommodating container 28 is mounted and removed by being moved in oblique directions indicated by arrows O1 and O2 that approximately extend along a longitudinal direction of the first detachment passage space 51.

The second detachment passage space S2 is configured as a space that obliquely extends toward a part of one side surface portion of the casing 10 from the mounting portion of the detachable unit 20. Therefore, the detachable unit 20 is mounted and removed by being moved in oblique directions indicated by arrows D1 and D2 that approximately extend along a longitudinal direction of the second detachment passage space S2.

The first detachment passage space S1 and the second detachment passage space S2 have a relationship such that a lower portion of the first detachment passage space S1 penetrates to and overlap a part of the second detachment passage space S2. The reason is that the mounting portion 20*b* for mounting the developer accommodating container 28 is provided at a part of the detachable unit 20 as described above.

Here, in the image forming apparatus 1, the operation of detaching the developer accommodating container 28 may be performed independently without difficulty by using the first detachment passage space S1 when detaching the developer accommodating container 28.

Meanwhile, when detaching the detachable unit 20, the operation of detaching the detachable unit 20 by using the second detachment passage space S2 needs to be performed after the developer accommodating container 28 is removed.

The reason is that when performing the operation of detaching the detachable unit 20 in a state in which the developer accommodating container 28 is mounted, a part of the developer accommodating container 28 protrudes from the second detachment passage space S2 and comes into contact with peripheral components around the second detachment passage space S2, such that the part of the developer accommodating container 28 hinders the detachable unit 20 when the detachable unit 20 passes through the interior of the second detachment passage space S2.

In the image forming apparatus 1, the exposure device 23, which does not constitute the detachable unit 20, is present at a position at which the movement of the detachable unit 20 in the second detachment passage space S2 is hindered (a position of the exposure device indicated by the alternate-long-and-two-short-dashes line in FIG. 4) when performing the operation of detaching the detachable unit 20.

Therefore, the image forming apparatus 1 is configured such that the exposure device 23 is moved, by movement mechanisms 5 as described below, from an exposure position P1 when the electrostatic latent image is formed (a position of the exposure device 23 indicated by the solid line in FIG. 2 or the alternate-long-and-two-short-dashes line in FIG. 4) to a retracted position P2 at which the exposure device 23 is retracted so as not to hinder the movement of the detachable unit 20 (a position of the exposure device 23 indicated by the solid line in FIG. 4) when performing the operation of detaching the detachable unit 20.

<Configuration of Movement Mechanism>

As illustrated in FIG. 4, the movement mechanisms 5 for moving the exposure device 23 are mechanisms that move the exposure device 23 between the exposure position P1, as a first position, and the retracted position P2, as a second position, at which the exposure device 23 is stopped in a posture different from a posture of the exposure device 23 stopped at the first position.

Figure 6:
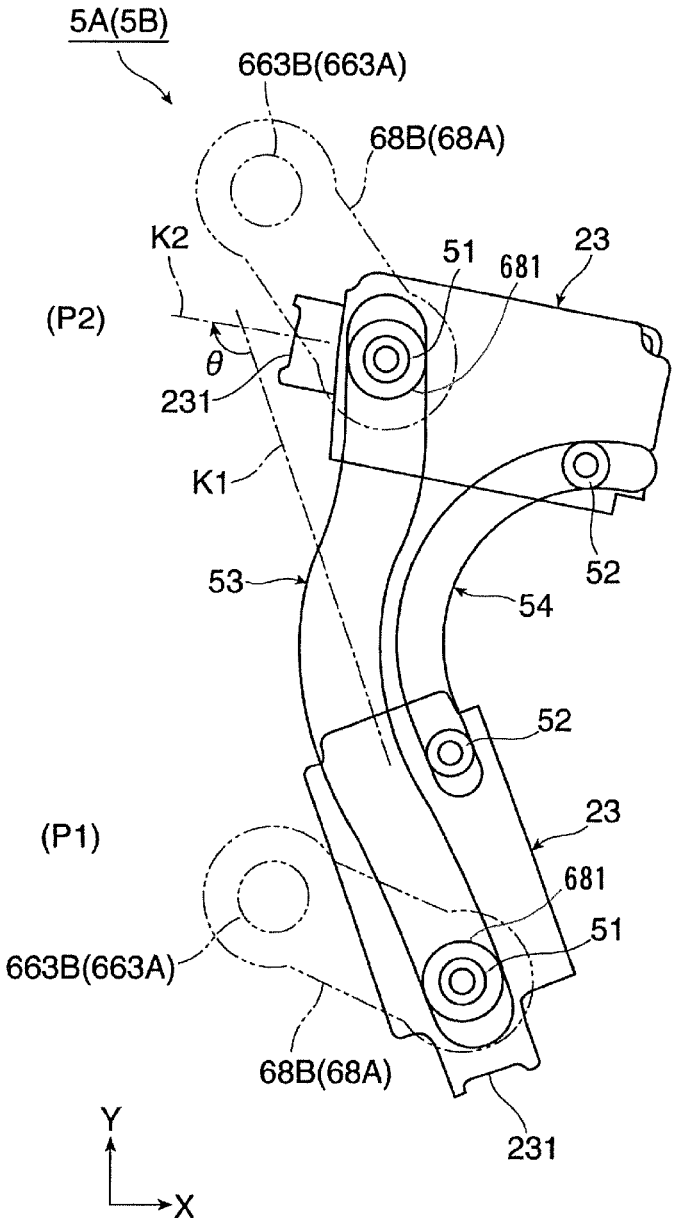
FIG. 6 is a schematic view illustrating the configurations of a movement mechanism and a state in which the configurations are moved to respective positions.

As illustrated in FIG. 6, each of the movement mechanisms 5 at least has a first projection 51 and a second projection 52 which are provided at different positions of the exposure device 23, a first guide groove 53 which guides the first projection 51 between the exposure position P1, which is the first position, and the retracted position P2 which is the second position, and a second guide groove 54 which guides the second projection 52 between the exposure position P1, which is the first position, and the retracted position P2 which is the second position.

The movement mechanisms 5 include two left and right movement mechanisms 5A and 5B (specifically, a left movement mechanism 5A and a right movement mechanism 5B) which are disposed at two separate positions that face both ends of the exposure device 23 in the longitudinal direction, respectively.

The movement mechanisms 5 (5A and 5B) are configured to move the exposure device 23 between the exposure position P1 and the retracted position P2 in cooperation with the operation of opening/closing the opening/closing cover 15.

To realize the cooperative function, the image forming apparatus 1 adopts link mechanisms 6 to be described below as a unit that converts the swing operation of the opening/closing cover 15 at the time of the opening/closing operation into power for the movement operations of the movement mechanisms 5A and 5B and transmitting the power to the movement mechanisms 5A and 5B.

In the movement mechanisms 5A and 5B, both of the first guide groove 53 and the second guide groove 54 are curved guide grooves having necessary lengths, but have different overall shapes.

As illustrated in FIG. 4, the retracted position P2, which is the second position, is set to a position which is a part of a narrow space S5 which is interposed obliquely between the second detachment passage space S2 and the inclined surface portion 13*a* of the discharging-accommodating unit 13.

The movement mechanisms 5A and 5B operate in cooperation with the operation of opening/closing the opening/closing cover 15, as schematically described below.

Figures 13A, 13B:
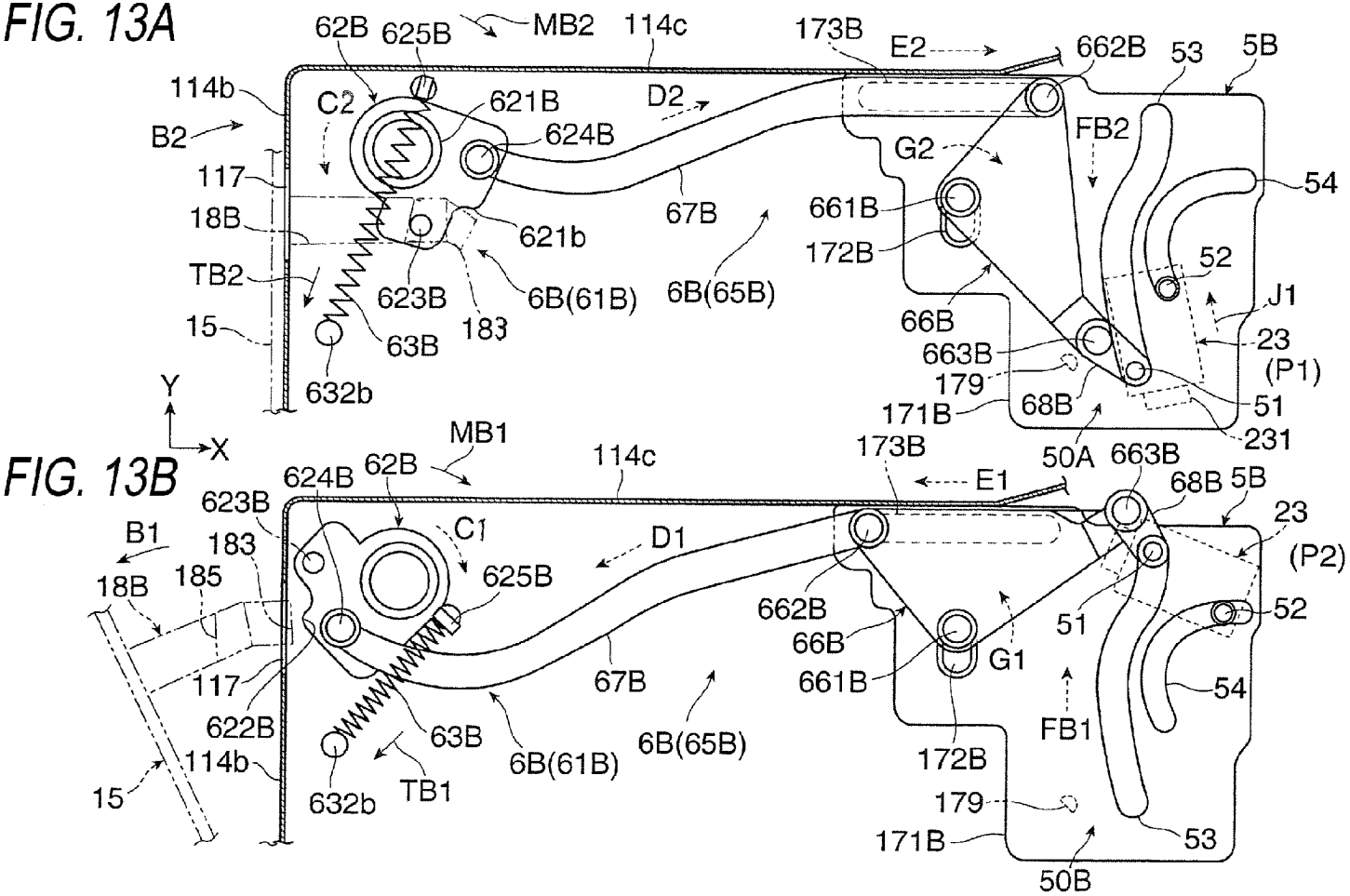
FIG. 13A is a schematic view illustrating a movement mechanism of a left moving apparatus and a state in which the exposure device is moved to an exposure position by the moving apparatus parts.
FIG. 13B is a schematic view illustrating the movement mechanism and a state in which the exposure device is moved to a retracted position by the moving apparatus parts.
Figures 14A, 14B:
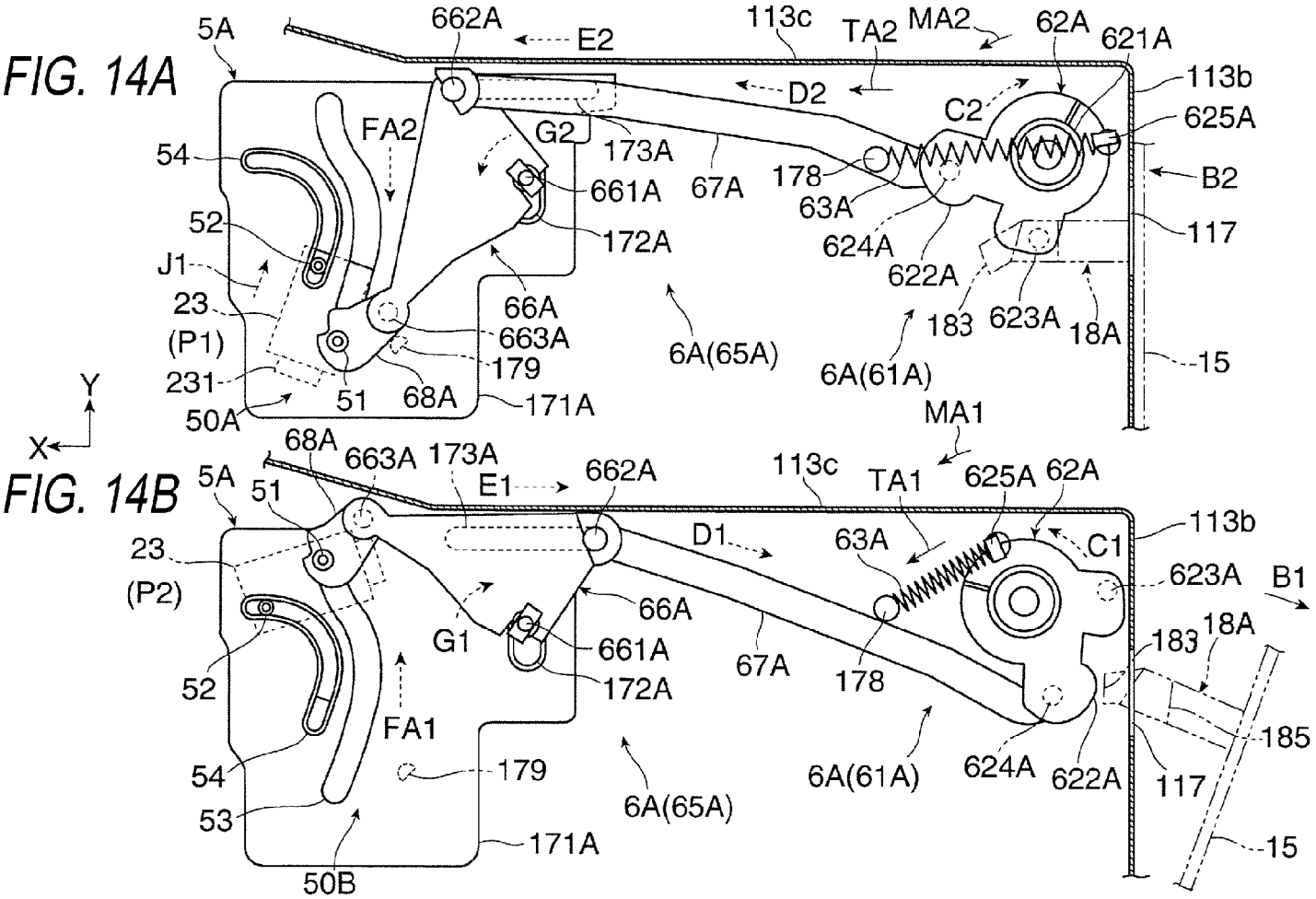
FIG. 14A is a schematic view illustrating a movement mechanism of a right moving apparatus and a state in which the exposure device is moved to an exposure position by the moving apparatus parts.
FIG. 14B is a schematic view illustrating the movement mechanism and a state in which the exposure device is moved to a retracted position by the moving apparatus parts.
Figure 15:
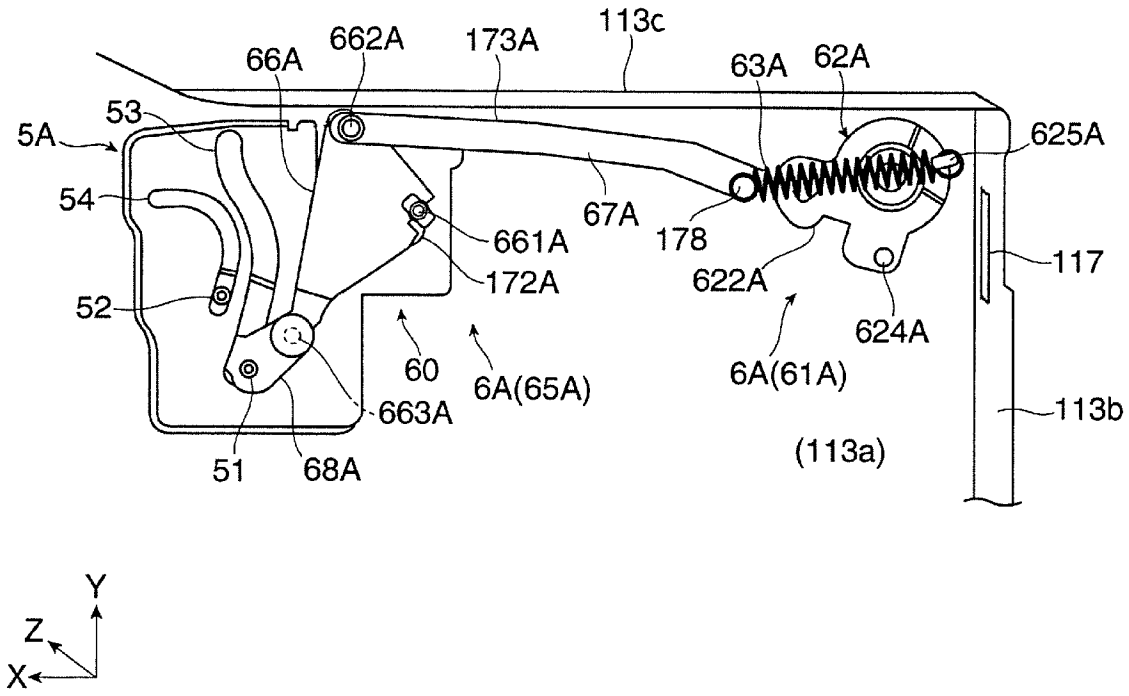
FIG. 15 is a schematic perspective view illustrating a state in which the moving apparatus including the link mechanism is mounted in the casing.

First, as illustrated in FIGS. 4, 13B, and 14B, when opening the opening/closing cover 15, the movement mechanisms 5A and 5B operate in cooperation with the operation of opening the opening/closing cover 15 to move the exposure device 23 from the exposure position P1 to the retracted position P2.

On the contrary, as illustrated in FIGS. 2, 13A, and 14A, when closing the opening/closing cover 15, the movement mechanisms 5A and 5B operate in cooperation with the operation of closing the opening/closing cover 15 to move the exposure device 23 from the retracted position P2 to the exposure position P1.

Figure 7:
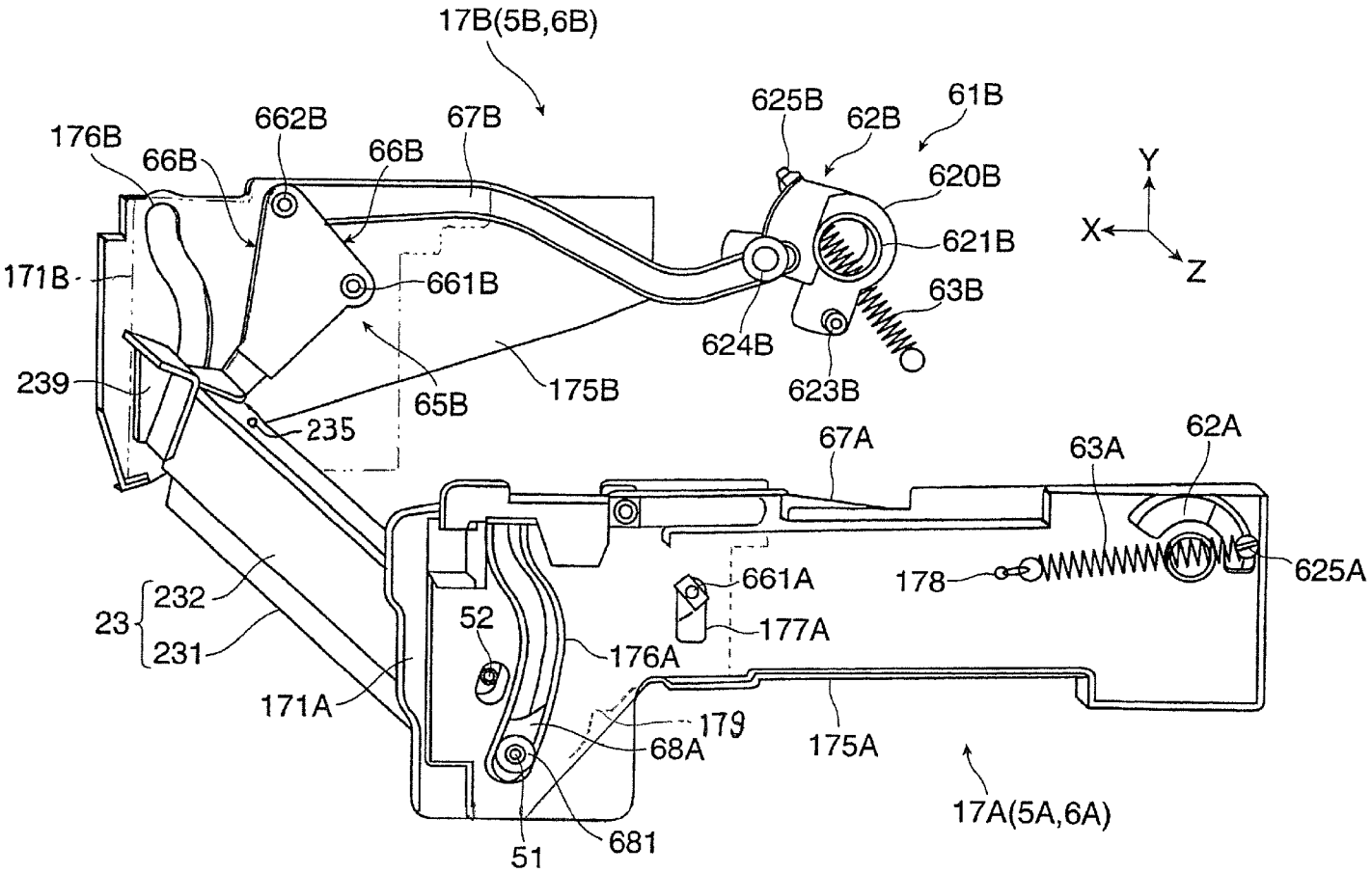
FIG. 7 is a schematic perspective view illustrating a moving apparatus in which the movement mechanism and a link mechanism are integrated.

As illustrated in FIGS. 5 and 7, the movement mechanisms 5A and 5B are provided, as moving apparatuses 17 integrated with the link mechanisms 6, on the casing 10 of the image forming apparatus 1.

As illustrated in FIGS. 5 and 7, in the first exemplary embodiment, in the casing 10 of the image forming apparatus 1, the moving apparatuses 17, which are configured by integrating the movement mechanisms 5 (5A and 5B) and the link mechanisms 6 (6A and 6B), are provided at upper portions of two side surface portions (e.g., left and right side surface portions) 113 and 114 that face both ends of the exposure device 23 in the longitudinal direction, and the moving apparatuses 17 are mounted as two, left and right, moving apparatuses 17A and 17B (specifically, the left moving apparatus 17A and the right moving apparatus 17B).

The left and right side surface portions 113 and 114 of the casing 10 is configured as members that have main body portions 113*a* and 114*a* having an approximately rectangular shape, and bent portions (side bent portions 113*b* and 114*b* and upper bent portions 113*c* and 114*c*) formed by bending outward approximately four sides of the main body portion. In addition, the left and right side surface portions 113 and 114 have non-illustrated cutout portions formed in the main body portions to ensure a range in which the exposure device 23 is moved by the movement mechanisms 5.

In FIG. 5, reference numeral 112 indicates a bottom surface portion which is a part of the casing 10, reference numeral 115 indicates a side coupling portion which couples the left and right side surface portions 113 and 114 to a lower portion of the side surface portion, and reference numeral 116 indicates an upper coupling portion which couples the left and right side surface portions 113 and 114 to a part of an upper surface portion.

The moving apparatuses 17A and 17B have first support members 171A and 171B which are disposed on outer surfaces of the left and right side surface portions 113 and 114 and are provided and mounted to face the non-illustrated cutout portions, and second support members 175A and 175B which are disposed on outer surfaces of the left and right side surface portions 113 and 114 and are disposed and mounted outward from the first support members 171A and 171B.

In FIG. 7, the first support member 171B at the right side is omitted. In addition, in FIG. 8, only the first support member 171A at the left side is illustrated, the first support member 171B at the right side is omitted, and the left and right second support members 175A and 175B are omitted.

Parts of the movement mechanisms 5 (5A and 5B) and parts of the link mechanisms 6 (6A and 6B) are disposed to be interposed between the first support members 171A and 171B and the second support members 175A and 175B.

As illustrated in FIGS. 12A to 14B, both of the first support members 171A and 171B have the first guide grooves 53 and the second guide grooves 54 of the movement mechanisms 5A and 5B, respectively. The first guide grooves 53 and the second guide grooves 54 may be provided at least in plate-shaped support members so as to face both ends of the exposure device 23 in the longitudinal direction.

<Configuration of Link Mechanism>

As illustrated in FIGS. 8, 9, 12A, 12B, 13A, 13B, 14A, and 14B, the link mechanisms 6 are configured as the two left and right link mechanisms 6A and 6B (specifically, the left link mechanism 6A and the right link mechanism 6B) corresponding to the left movement mechanism 5A and the right movement mechanism 5B.

The link mechanisms 6A and 6B have left and right power input units 61A and 61B to which the swing operation at the time of opening/closing the opening/closing cover 15 is input as power, and left and right power transmission units 65A and 65B which convert the power obtained by the power input units 61A and 61B into power for the movement operations of the movement mechanisms 5 and transmit the power to the movement mechanisms 5.

Among the units, as illustrated in FIGS. 5, 7 to 9, 13A, 13B, 14A, and 14B, the power input units 61A and 61B are configured with two left and right rotation bodies 62A and 62B. The rotation bodies 62A and 62B are rotated as left and right contact operating units 18A and 18B, which are provided to correspond to the opening/closing cover 15, come into contact with the left and right rotation bodies 62A and 62B.

The left rotation body 62A is rotatably supported on a second support member 175A of the left moving apparatus 17A so that the left rotation body 62A is present on an outer surface of an upper corner portion of the left side surface portion 113 which faces the opening/closing cover 15. The right rotation body 62B is rotatably supported on a second support member 175B of the right moving apparatus 17B so that right rotation body 62B is present on an outer surface of an upper corner portion of the right side surface portion 114 which faces the opening/closing cover 15.

Figure 8:
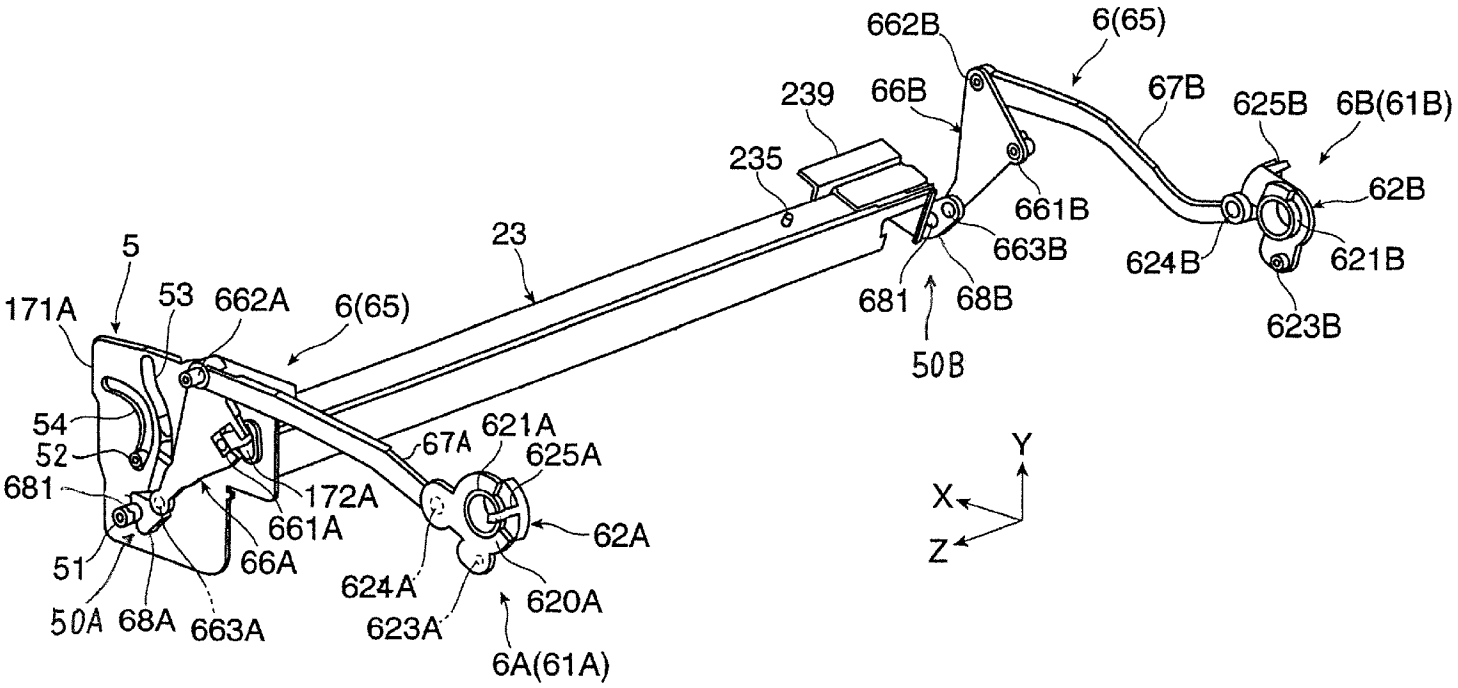
FIG. 8 is a schematic perspective view illustrating moving apparatus parts and a state in which a part of components of the moving apparatus are omitted.
Figure 9:
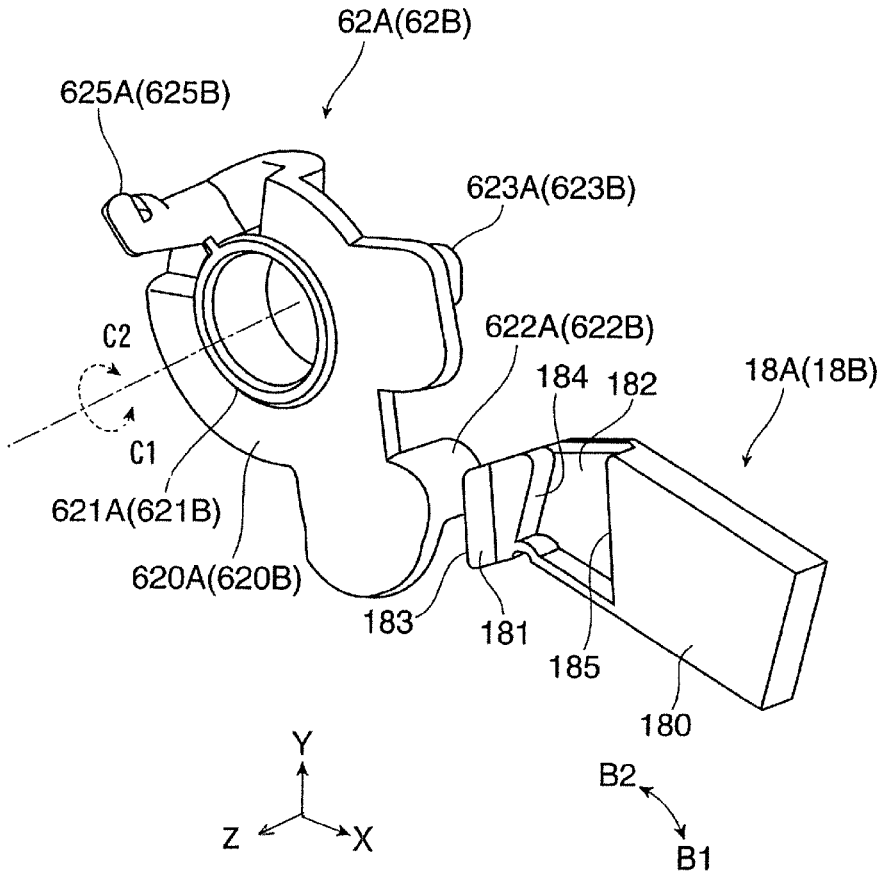
FIG. 9 is a schematic perspective view illustrating one component of the link mechanism and a contact operating unit of the opening/closing cover.

As illustrated in FIGS. 7 to 9, both of the rotation bodies 62A and 62B have disk-shaped main body portions 620A and 620B having cylindrical shaft portions 621A and 621B which are fitted with and rotatably supported by a non-illustrated rotating shaft provided on the second support member 175A or the right side surface portion 114.

As illustrated in FIGS. 7 to 9, around the shaft portions 621A and 621B of the main body portions 620A and 620B, both of the rotation bodies 62A and 62B have contacted portions 622A and 622B and operating projection portions 623A and 623B which are in contact with the contact operating units 18A and 18B of the opening/closing cover 15, coupling shafts 624A and 624B which are coupled to one end of the coupling link 67A and one end of the coupling link 67B which will be described below, and spring mounting portions 625A and 625B which are mounted at one end of a tension spring 63A and one end of a tension spring 63B which will be described below.

One end of the tension spring (coil spring) 63A and one end of the tension spring 63B are mounted on the spring mounting portions 625A and 625B of the rotation bodies 62A and 62B, such that the tension springs continue to be tense in necessary directions by necessary tension (TA and TB).

Meanwhile, as illustrated in FIGS. 5, 9, 13A, 13B, 14A, and 14B, both of the contact operating units 18A and 18B of the opening/closing cover 15 are configured as members that have plate-shaped main body portions 180 which are disposed uprightly at predetermined positions of left and right ends on an inner wall surface of the opening/closing cover 15, bent tip portions 181 which obliquely extend downward at tips of the main body portions 180, and recess portions 182 notched to have shapes widened downward at boundary portions between the main body portions 180 and the bent tip portions 181.

Both of the contact operating units 18A and 18B have contact surface portions 183 which are provided at the tips of the bent tip portions 181 and come into contact with and press the contacted portions 622A and 622B of the rotation bodies 62A and 62B when closing the opening/closing cover 15.

In both of the contact operating units 18A and 18B, inner wall surfaces of the recess portions 182, which are close to the contact surface portions 183, are formed as drawing inclined surface portions 184 which are formed as inclined surfaces inclined downward and outward and come into contact with the operating projection portions 623A and 623B of the rotation bodies 62A and 62B when opening the opening/closing cover 15. Furthermore, inner wall surfaces of the recess portions 182, which are opposite to the contact surface portions 183, are formed as pressing inclined surface portions 185 which are formed as inclined surfaces inclined downward and outward and come into contact with the operating projection portions 623A and 623B of the rotation bodies 62A and 62B when closing the opening/closing cover 15.

As illustrated in FIGS. 5, 13A, 13B, 14A, and 14B, passage openings 117 through which the contact operating units 18A and 18B, which are moved in accordance with the operation of opening/closing the opening/closing cover 15, pass are provided at upper portions of the side bent portions 113*b* and 114*b* of the side surface portions 113 and 114 of the casing 10. In addition, the rotation bodies 62A and 62B are disposed at positions adjacent to the passage openings 117.

In FIG. 5, reference numeral 19 indicates a flexible member which couples, by a predetermined length, a part of the opening/closing cover 15 and a part of the side bent portion 113*b* in order to hold a posture of the opening/closing cover 15 when the opening/closing cover 15 is opened.

Next, as illustrated in FIGS. 8, 13A, 13B, 14A, and 14B, the power transmission units 65A and 65B include left and right rotation links 66A and 66B which rotate (swing) in the vicinity of the movement mechanisms 5, left and right coupling links 67A and 67B which couple parts of the rotation links 66A and 66B to parts of the rotation bodies 62A and 62B of the power input units 61A and 61B, and left and right connection links 68A and 68B which connect the other part of the rotation link 66A and the other part of the rotation link 66B to the first projections 51 which are guided by the first guide grooves 53 of the movement mechanisms 5.

Each of the left and right rotation links 66A and 66B is a plate-shaped member entirely having an approximately triangular shape. Fulcrum shafts 661A and 661B of the rotation links 66A and 66B, which are disposed in the vicinity of one apex, are rotatably supported in support grooves 172A and 172B provided in the first support members 171A and 171B of the left moving apparatus 17A and the right moving apparatus 17B.

The rotation links 66A and 66B are supported to be guided by guide grooves 173A and 173B provided in the first support members 171A and 171B when the first coupling shafts 662A and 662B, which are provided in the vicinity of the other apices, move between two points.

Each of the left and right coupling links 67A and 67B is a curved and elongated plate-shaped member having a necessary shape. One end of the coupling link 67A and one end of the coupling link 67B are rotatably mounted on the coupling shafts 624A and 624B, respectively, which are provided at a part of the rotation body 62A and a part of the rotation body 62B, respectively, and the other ends of the coupling links 67A and 67B are rotatably mounted on the first coupling shafts 662A and 662B provided at the other apices of the rotation links 66A and 66B.

Each of the left and right connection links 68A and 68B is a plate-shaped member having an approximately elliptical shape. Second coupling shafts 663A and 663B, which are provided at the other apices and are the other parts of the rotation links 66A and 66B, are rotatably mounted at one end of the connection link 68A and one end of the connection link 68B, and the first projections 51 are rotatably mounted at the other ends of the connection links 68A and 68B. The first projection 51 is mounted through a guided portion 681 (FIGS. 6 to 8) which is guided in the first guide groove 53 in a state in which the first projection 51 is fitted into the guided portion 681.

As illustrated in FIG. 7, in the second support members 175A and 175B, first auxiliary guide grooves 176A and 176B having the same shape are provided at positions corresponding to the first guide grooves 53 of the movement mechanisms 5A and 5B provided on the first support members 171A and 171B. Guided portions 681A and 681B of the connection links 68A and 68B are fitted into and auxiliarily guided by the first auxiliary guide grooves 176A and 176B.

As illustrated in FIG. 7, in the second support members 175A and 175B, auxiliary support grooves 177A and 177B having the same shape are provided at positions corresponding to the support grooves 172A and 172B provided in the first support members 171A and 171B. The fulcrum shafts 661A and 661B of the rotation links 66A and 66B (auxiliary members 664 into which the fulcrum shafts 661A and 661B are fitted) of the link mechanisms 6A and 6B are fitted into and auxiliarily guided by the auxiliary support grooves 177A and 177B.

As illustrated in FIG. 7, a fixing-mounting unit 178, which mounts and fixes the other end of the tension spring 63A, is provided on the second support member 175A. As illustrated in FIGS. 7 and 14B, the fixing-mounting unit 178 is provided at a position, which is farther from the rotation link 66A than the rotation body 62A, and at a height approximately equal to a height of a rotation center of the rotation body 62A in a horizontal direction.

In this connection, the other end 632*b* of the tension spring 63B is mounted on the non-illustrated fixing-mounting unit provided at a part of the main body portion 114*a* of the side surface portion 114 of the casing 10. As illustrated in FIGS. 7 and 13A, the non-illustrated fixing-mounting unit is provided at a position which is spaced downward apart from the rotation body 62B and shifted from the rotation center of the rotation body 62B toward a side opposite to the rotation link 66B.

<Characteristic Configuration of Link Mechanism>

The link mechanisms 6 (6A and 6B) also adopt the following configuration at link mechanism parts (parts of the link mechanisms 6A and 6B) 60 that have the rotation links 66A and 66B which have the fulcrum shafts 661A and 661B, the first coupling shafts 662A and 662B, and the second coupling shafts 663A and 663B and rotate about the fulcrum shafts 661A and 661B as rotation centers, and the first support members 171A and 171B which have the guide grooves 173A and 173B and the support grooves 172A and 172B.

Figure 12A:
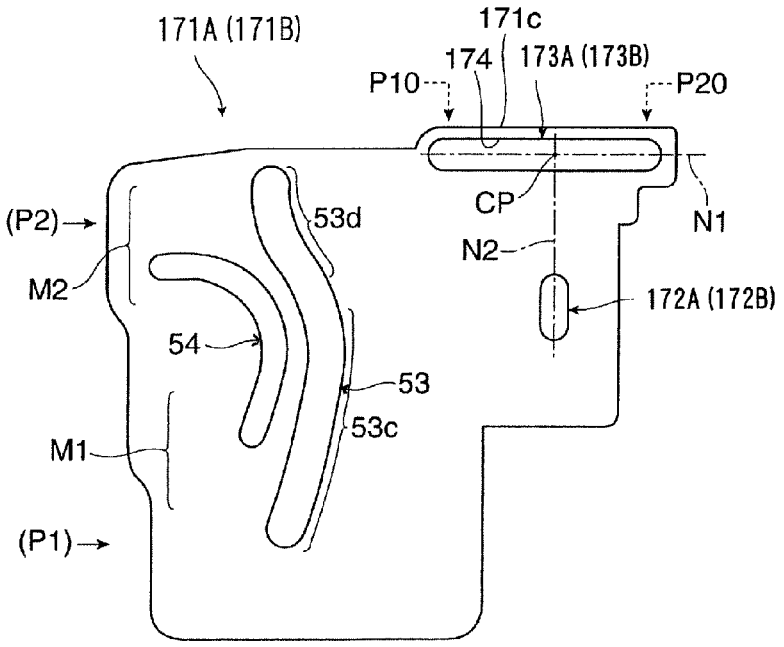
FIG. 12A is a schematic side view illustrating the movement mechanism and configurations such as guide grooves in the link mechanism.
Figure 12B:
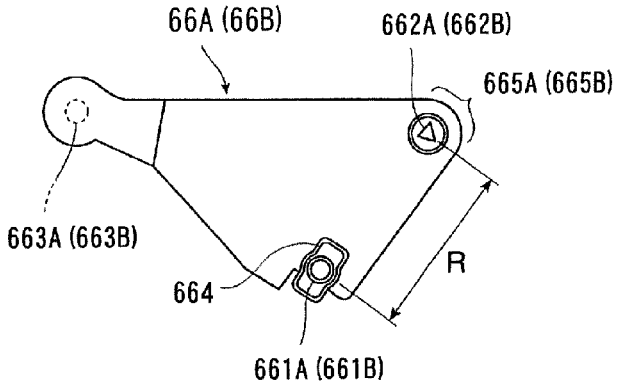
FIG. 12B is a schematic side view illustrating a configuration of a rotation link.

That is, as illustrated in FIGS. 12A and 12B, the guide grooves 173A and 173B are configured to have long side guide portions 174 shaped to have curvatures larger than curvatures of arcs having radii that correspond to separation distances R between the fulcrum shafts 661A and 661B and the first coupling shafts 662A and 662B of the rotation links 66A and 66B. In addition, as illustrated in FIG. 12A, the support grooves 172A and 172B are configured as long grooves shaped to extend in a direction N2 that intersects a direction N1 in which the long side guide portions 174 of the guide grooves 173A and 173B extend.

Figure 18:
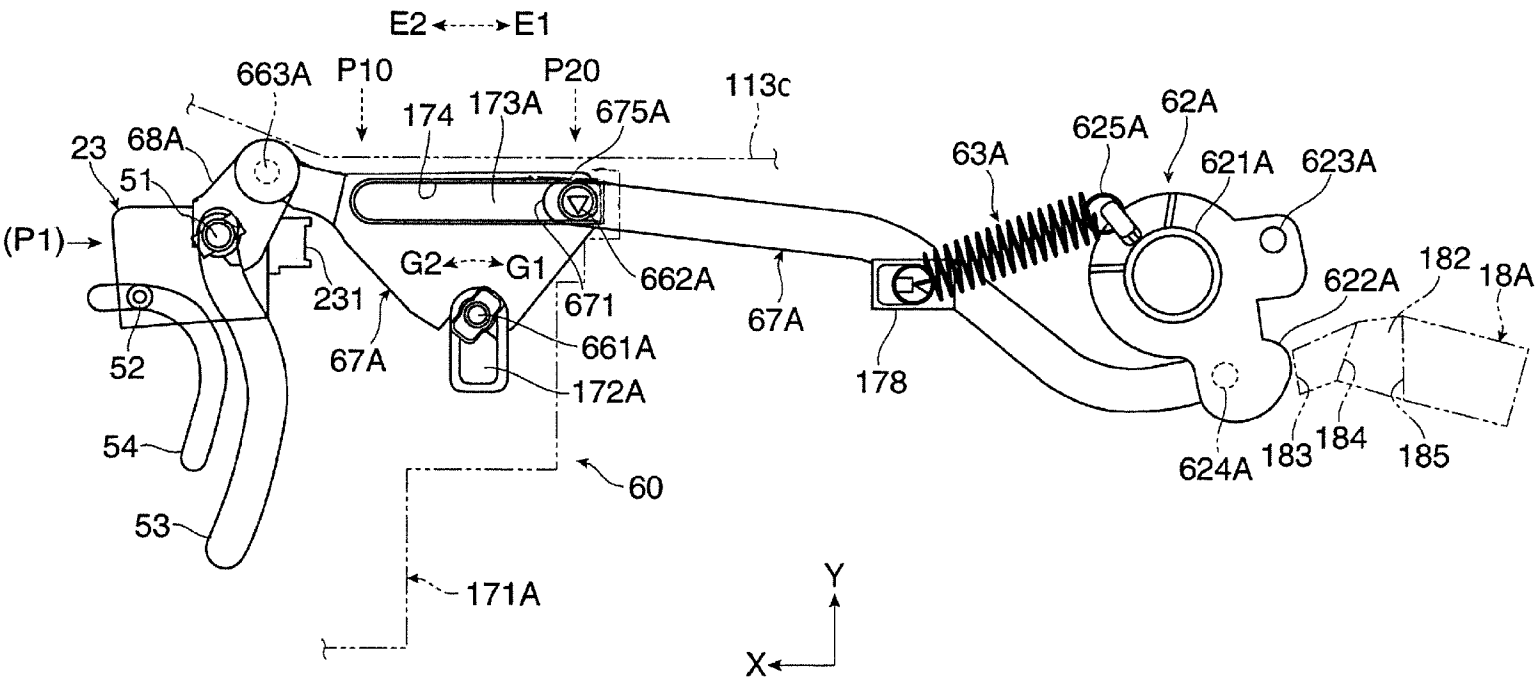
FIG. 18 is a schematic view illustrating a state in which the link mechanism and the like of the left moving apparatus operate (a state in which the exposure device is moved to the exposure position)

In the first exemplary embodiment, as illustrated in FIGS. 12A and 18, the guide grooves 173A and 173B are configured to guide the first coupling shafts 662A and 662B while the first coupling shafts 662A and 662B move between two points (P10 and P20) corresponding to the exposure position P1 and the retracted position P2 of the exposure device 23 which is moved by the movement mechanisms 5A and 5B.

As illustrated in FIG. 12A, the long side guide portions 174 are formed in a straight shape along a straight line (N1) that connects the two points to which the first coupling shafts 662A and 662B are guided by the guide grooves 173A and 173B. In addition, each of the long side guide portions 174 is provided at one long side portion of two long side portions of each of the guide grooves 173A and 173B having long groove shapes, and the one long portion is farther from each of the support grooves 172A and 172B.

Meanwhile, as illustrated in FIG. 12A, the support grooves 172A and 172B are formed as long grooves which are elongated along a vertical line that runs through a central point CP of the longitudinal direction (N1) of the guide grooves 173A and 173B.

As illustrated in FIGS. 7, 10, 11A, and 11B, the exposure device 23 mounted on the movement mechanisms 5A and 5B includes an exposure main body portion 231, and a support member 232 which has an approximately U-shaped cross section and supports the exposure main body portion 231. Both ends 238 of the exposure main body portion 231 are supported by mounting members 236 so as to be movable (displaceable) in directions indicated by arrows J1 and J2. A light exit surface 233 from which light exits at the time of the exposure is disposed at a portion of the exposure main body portion 231 which is opposite to a side of the support member 232. Here, the support member 232 and the mounting members 236 are configured as support units for the exposure device 23.

Figure 10:
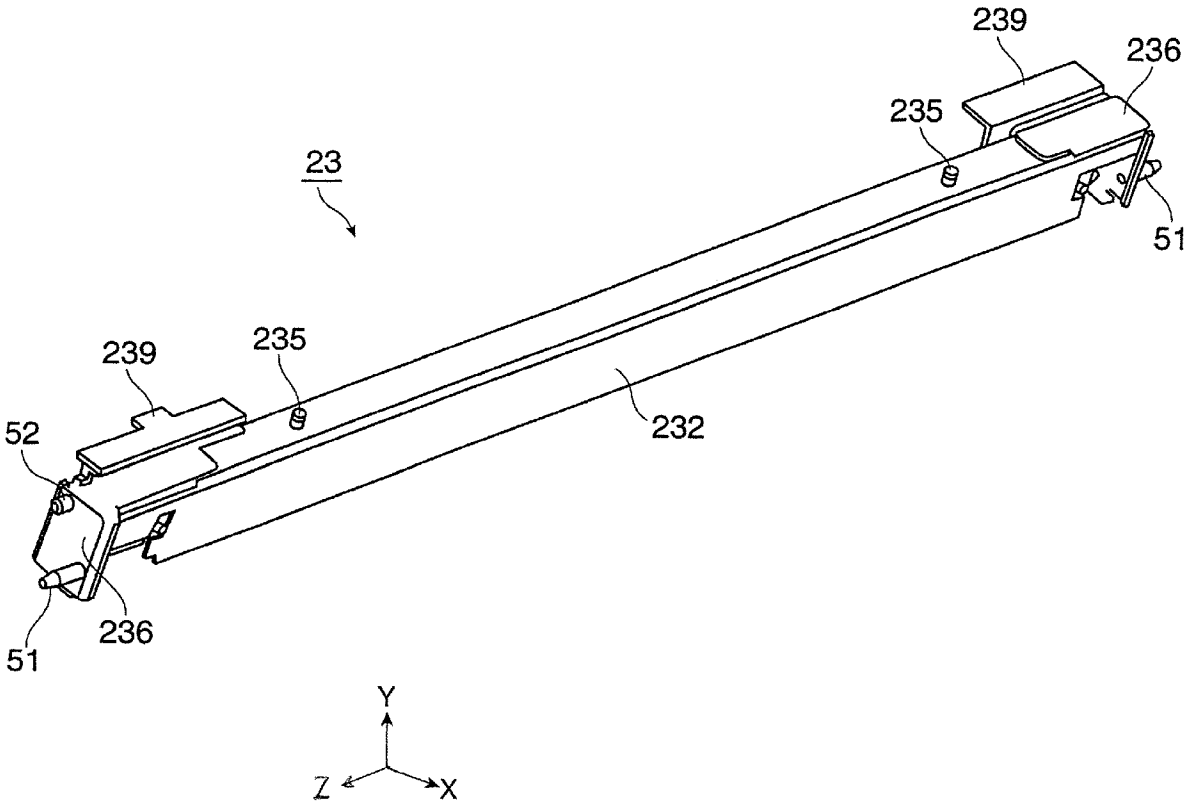
FIG. 10 is a schematic perspective view illustrating an exposure device which is moved by the movement mechanism.

As illustrated in FIG. 10, the support member 232 of the exposure device 23 is fixed to the exposure main body portion 231 through leaf springs 234 which remain interposed between the left and right mounting members 236 having the first projections 51 and the second projections 52.

Figure 11A:
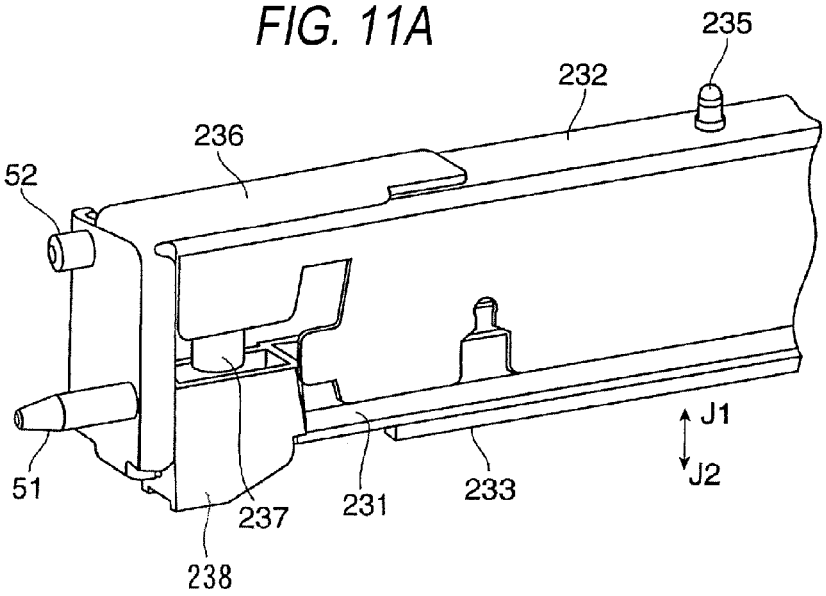
FIG. 11A is a schematic perspective view illustrating one end of the exposure device in FIG. 10.
Figure 11B:
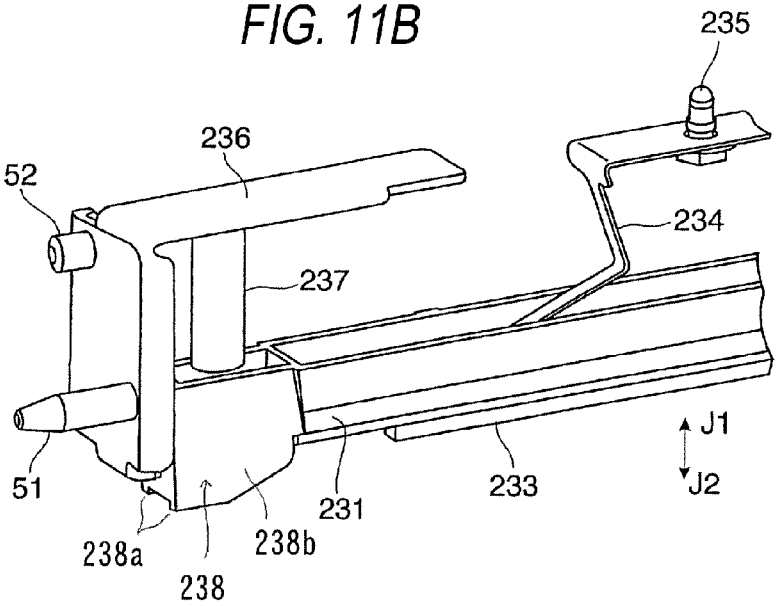
FIG. 11B is a schematic perspective view illustrating an internal structure at one end of the exposure device in FIG. 11A.

In FIGS. 10, 11A and 11B, reference numeral 235 indicates fixing screws for fixing (the other ends of) the leaf springs 234, each of which has one end mounted on the exposure main body portion 231, to the support member 232. In addition, in FIGS. 11A and 11B, reference numeral 237 indicates compression springs (coil springs that increase biasing force by being compressed) which are provided between lower surfaces of the mounting members 236 and the exposure main body portion 231 and bias the exposure main body portion 231 in the mounting members 236 to displace the exposure main body portion 231 toward the exposure position P1. Further, in FIG. 10, reference numeral 239 indicates protective covers which cover and protect portions of the leaf springs 234 which are exposed from both ends of the support member 232 in the longitudinal direction.

In FIGS. 11A and 11B, reference numeral 238 indicates ends of the exposure main body portion 231 in the longitudinal direction (actually, both ends present at the left and right sides). The ends are used to position the exposure device 23 by coming into contact with non-illustrated positioning portions provided on the detachable unit 20 when the exposure device 23 is moved to the exposure position P1.

As illustrated in FIGS. 6 and 12A to 14B, the first guide grooves 53 and the second guide grooves 54 of the movement mechanisms 5A and 5B, which are provided in the first support members 171A and 171B of the moving apparatuses 17A and 17B, are formed to be close to one another within a region M1 close to the exposure position P1 which is the first position, and the first guide grooves 53 and the second guide grooves 54 are formed to be gradually distant from one another within a region M2 close to the retracted position P2 which is the second position.

As illustrated in FIGS. 6 and 12A, each of the second guide grooves 54 is configured as a guide groove having a single arc shape. Furthermore, in this case, each of the first guide grooves 53 is formed as a guide groove that has a portion 53*c* which has an arc shape curved in the same direction as an arc portion of each of the second guide grooves 54 which is present at a side of the exposure position P1, and a portion 53*d* which has an arc shape curved in a direction opposite to a direction of an arc shape of each of the second guide grooves 54 which is present at a side of the retracted position P2.

As illustrated in FIGS. 5 and 13A to 15, the moving apparatuses 17A and 17B having the movement mechanisms 5A and 5B and the link mechanisms 6A and 6B (except for the exposure device 23) are mounted at positions toward upper ends of outer surfaces of the side surface portions 113 and 114 of the casing 10, that is, at positions close to side surfaces of the opening/closing cover 15.

In detail, the movement mechanisms 5A and 5B are disposed at positions within ranges of the outer surfaces of the side surface portions 113 and 114, which include the exposure position P1 and the retracted position P2 of the exposure device 23 in the image forming device 2 (detachable unit 20).

The power input units 61A and 61B (actually, the rotation bodies 62A and 62B) of the link mechanisms 6A and 6B are disposed at positions close to portions of the outer surfaces of the side surface portions 113 and 114 where the passage openings 117 of the side bent portions 113*b* and 114*b* are provided.

The power transmission units 65A and 65B (actually, the coupling links 67A and 67B and the rotation links 66A and 66B) of the link mechanisms 6A and 6B are disposed at positions of the outer surfaces of the side surface portions 113 and 114 between the movement mechanisms 5A and 5B and the power input units 61A and 61B, that is, at positions close to the upper bent portions 113*c* and 114*c*.

<Detailed Configuration of Moving Apparatus>

The moving apparatuses 17A and 17B include left and right moving apparatus parts 50A and 50B that constitute parts of the movement mechanisms 5A and 5B and parts of the power transmission units 65A and 65B of the link mechanisms 6A and 6B.

As illustrated in FIGS. 8, 13A, 13B, 14A, 14B, and 16, the moving apparatus parts 50A and 50B at least have the mounting members 236 which serve as parts of support units for supporting the exposure device 23 so that the exposure device 23 is displaceable, the first guide grooves 53 which guide the mounting members 236 to move the exposure device 23 between the exposure position P1 and the retracted position P2, the rotation links 66A and 66B which are an example of first link units and have the first fulcrum shafts 661 and the second coupling shafts 663 that swing about the fulcrum shafts 661A and 661B to transmit force used to move the exposure device 23, the connection links 68A and 68B which are an example of second link units that connect the mounting members 236 and the second coupling shafts 663 of the rotation links 66A and 66B, and coupling shafts which couple the mounting member 236 and the connection links 68A and 68B and are guided by the first guide grooves 53.

In the first exemplary embodiment, the first projections 51, which are fixed to the mounting members 236, are applied as the coupling shafts.

In the first exemplary embodiment, there is a relationship in which the paths of the first guide grooves 53 are different from trajectories along which the second coupling shafts 663 of the rotation links 66A and 66B swing. As indicated by the alternate-long-and-short-dashes line TL in FIG. 16, the trajectory of the second coupling shaft 663 is a curved arc line. The different relationship refers to a case in which the path and the position of the trajectory are at least partially different from each other, or a case in which the path and the trajectory have dissimilar shapes.

Figure 16:
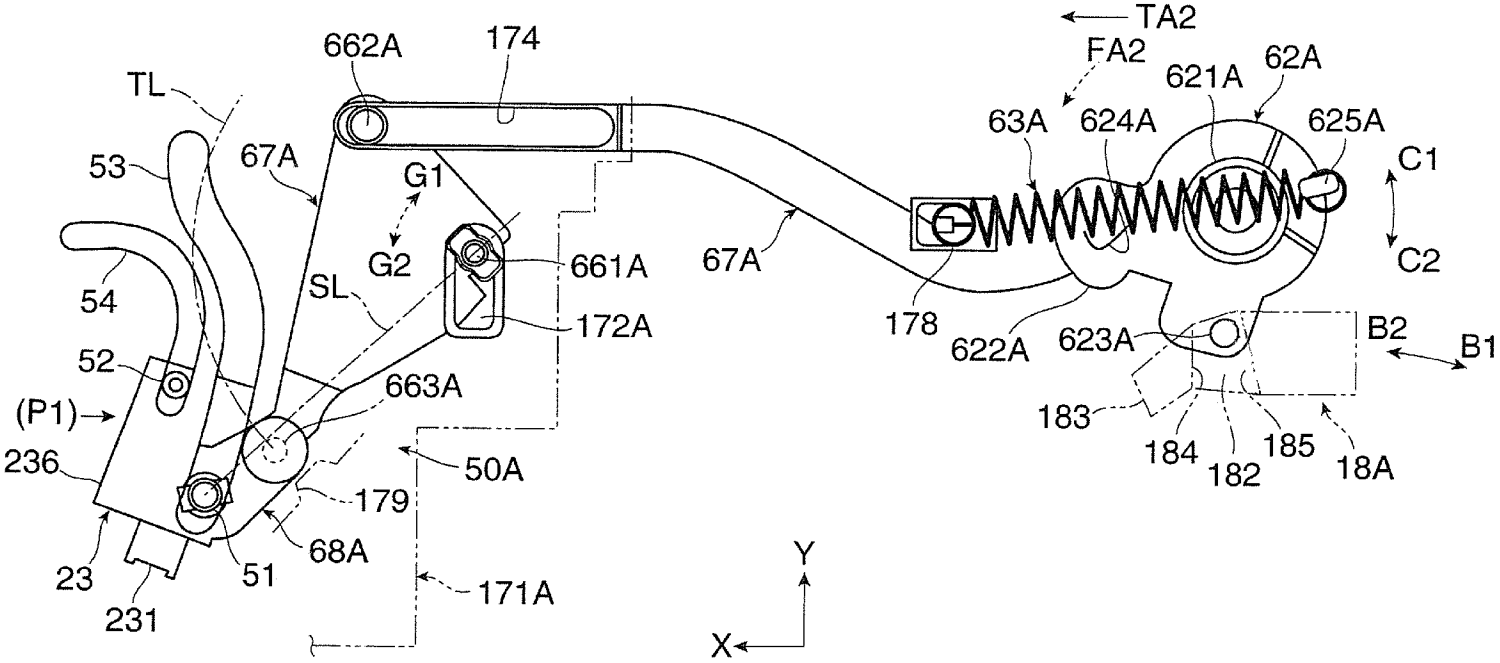
FIG. 16 is a schematic view illustrating a configuration of the moving apparatus parts.

As illustrated in FIGS. 11A and 11B, the moving apparatus parts 50A and 50B have the compression springs 237 which are an example of first biasing units that bias the exposure device 23 in the mounting members 236 to displace the exposure device 23 toward the exposure position P1. As illustrated in FIGS. 13A, 14B, and 16, the connection links 68A and 68B of the moving apparatus parts 50A and 50B are configured such that when the exposure device 23 is moved to the exposure position P1, the second coupling shafts 663 are in a stopped posture in regions in which the second coupling shafts 663 go beyond straight lines that connect the fulcrum shafts 661 and the first projections 51, and the posture is maintained by receiving, from the first projections 51, reactions generated on the mounting members 236 by the biasing force of the compression springs 237.

A single straight line SL indicated by the alternate-long-and-two-short-dashes line in FIG. 16 is a straight line that connects the fulcrum shaft 661 and the first projection 51. In addition, in FIGS. 7 and 16, reference numeral 179 indicates stop portions by which parts of the connection links 68A and 68B come into contact to be stopped when the exposure device 23 is moved to the exposure position P1. For example, as indicated by the dotted line in the FIG. 7, the stop portions 179 are provided on parts of the second support members 175A and 175B.

The moving apparatuses 5A and 5B including the moving apparatus parts 50A and 50B have the second biasing units (tension springs 63A and 63B) which bias the rotation links 66A and 66B to swing the rotation links 66A and 66B in a direction G1 in which the exposure device 23 moves to the retracted position P2. The second biasing units are configured such that force (biasing force) MA2 and MB2, which biases the rotation links 66A and 66B when the exposure device 23 is at the exposure position P1 is smaller than force (biasing force) MA1 and MB1 which biases the rotation links 66A and 66B when the exposure device 23 is at the retracted position P2 (MA2<MA1, MB2<MB1).

As illustrated in FIGS. 7, 13A, 13B, 14A, and 14B, in the first exemplary embodiment, the tension springs 63A and 63B, which are disposed on the rotation bodies 62A and 62B connected to the coupling links 67A and 67B coupled to the first coupling shafts 662A and 662B of the rotation links 66A and 66B, are used as the second biasing units.

The tension springs 63A and 63B, as an example of the second biasing unit, are disposed such that when the exposure device 23 is moved from the retracted position P2 to the exposure position P1, parts of the tension springs 63A and 63B approach and stop until the parts of the tension springs 63A and 63B include rotation centers of the shaft portions 621A and 621B of the rotation bodies 62A and 62B. The arrangement of the tension springs 63A and 63B is realized by selecting fixed positions of both ends of the tension springs 63A and 63B in the longitudinal direction. Therefore, the tension springs 63A and 63B are configured such that the relationship of the biasing force satisfies the relationship of MA2<MA1 and MB2<MB1 when the exposure device 23 is at the exposure position P1.

Figure 17:
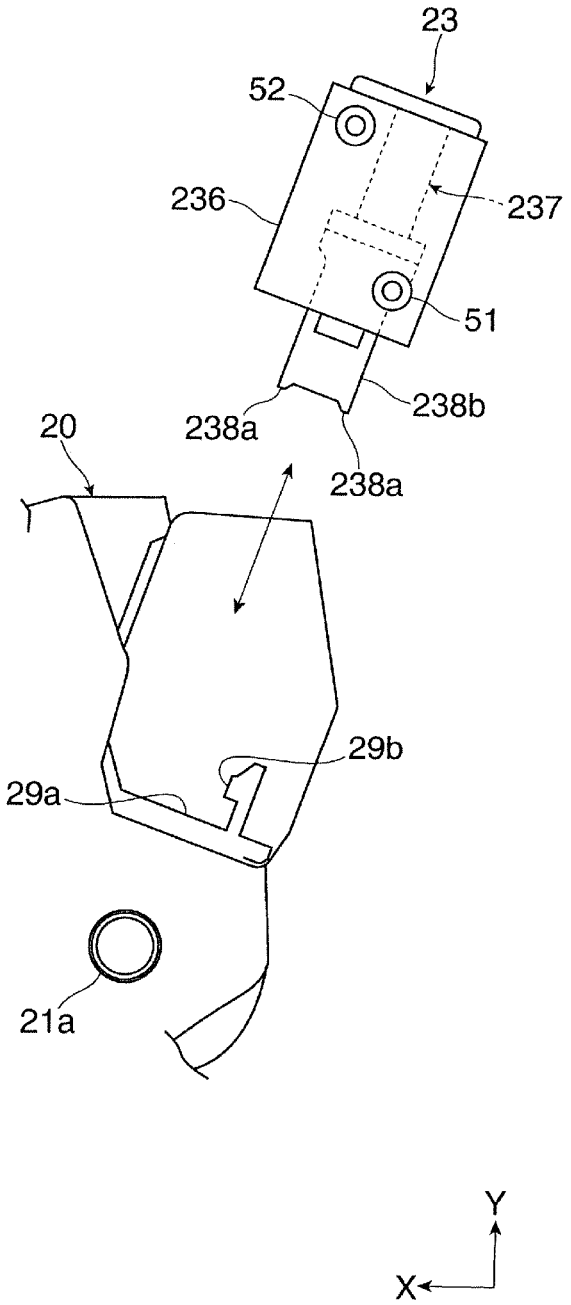
FIG. 17 is a schematic view illustrating a relationship between a positioning portion of a detachable unit and the exposure device.

As illustrated in FIG. 17, in the image forming apparatus 1, the detachable unit 20, as an example of a detachable unit, has positioning portions 29 which is configured such that when the exposure device 23 is moved to the exposure position P1 by the movement mechanisms 5A and 5B (or the moving apparatus parts 50A and 50B), the exposure device 23 is positioned by parts of the exposure device 23 (parts at both ends 238 of the exposure main body portion 231) coming into contact with the positioning portions 29 and position the exposure device 23.

The positioning portions 29 are portions which are formed on a part of the support member (support frame) of the detachable unit 20 and have necessary shapes. For example, as illustrated in FIG. 17, the positioning portions 29 include a first positioning portion 29*a* which comes into contact with at least a part (a protruding tip portion) of a lower surface portion 238*a* at the both ends 238 of the exposure main body portion 231 of the exposure device 23 and performs the positioning operation related to the separation distance from the photoconductive drum 21, and a second positioning portion 29*b* which comes into contact with at least a apart of one side surface portion 238*b* at the both ends 238 and performs the positioning operation related to angles (postures) with respect to the photoconductive drum 21.

<Operation of Moving Exposure Device by Movement Mechanism and Link Mechanism>

As described above, the moving apparatuses 17A and 17B operate the link mechanisms 6A and 6B in cooperation with the operation of opening/closing the opening/closing cover 15, so that the exposure device 23 is moved between the exposure position P1 and the retracted position P2 by the movement mechanisms 5A and 5B (and the moving apparatus parts 50A and 50B).

Operation when Opening the Opening/Closing Cover:

First, an operation of opening the opening/closing cover 15 in the closed state will be described. The operation of opening the opening/closing cover 15 is performed when detaching the developer accommodating container 28 or the detachable unit 20 to change the developer accommodating container 28 or the detachable unit 20.

In this case, in a step in which the opening/closing cover 15 is closed, as illustrated in FIGS. 2, 13A, and 14A, the movement mechanisms 5A and 5B are maintained in the state in which the operation of moving the exposure device 23 to the exposure position P1 is finished.

In this state, as illustrated in FIGS. 13B and 14B, when the opening/closing cover 15 begins to be opened by swinging in the direction indicated by the arrow B1, the drawing inclined surface portions 184 of the contact operating units 18A and 18B on the opening/closing cover 15 come into contact with the operating projection portions 623A and 623B of the rotation bodies 62A and 62B of the power input units 61A and 61B of the link mechanisms 6A and 6B, such that the rotation bodies 62A and 62B begin to rotate in the direction indicated by the broken line arrow C1.

Therefore, power, which is generated by the rotational motion performed as the rotation bodies 62A and 62B are rotated in the direction indicated by the broken line arrow C1, is transmitted to the movement mechanisms 5A and 5B through the power transmission units 65A and 65B of the link mechanisms 6A and 6B.

That is, as the rotation bodies 62A and 62B are rotated in the direction indicated by the broken line arrow C1, the coupling links 67A and 67B of the power transmission units 65A and 65B are moved away from the movement mechanisms 5A and 5B in the direction indicated by the broken line arrow D1, and the first coupling shafts 662A and 662B of the rotation links 66A and 66B are moved along the guide grooves 173A and 173B in the direction indicated by the broken line arrow E1 by the movements of the coupling links 67A and 67B.

Here, the operation of rotating the rotation bodies 62A and 62B in the direction indicated by the broken line arrow C1 by the contact of the contact operating units 18A and 18B on the opening/closing cover 15 that swings in the direction indicated by the arrow B1 is ceased in a step in which the opening/closing cover 15 begins to be opened and the contact operating units 18A and 18B are spaced apart from the rotation bodies 62A and 62B, at a front position where the first coupling shafts 662A and 662B, which move in the direction indicated by the broken line arrow E1, reach one end of the guide groove 173A and one end of the guide groove 173B. However, as illustrated in FIGS. 13B and 14B, the rotations of the rotation bodies 62A and 62B in the direction indicated by the broken line arrow C1 are continued as tension TA1 and TB1 of the tension springs 63A and 63B continues to be applied as the biasing force MA1 and MB1 that rotates the rotation bodies 62A and 62B in the direction indicated by the arrow C1.

Subsequently, as the first coupling shafts 662A and 662B are moved in the direction indicated by the broken line arrow E1, the rotation links 66A and 66B are rotated about the fulcrum shafts 661A and 661B in a direction indicated by the broken line arrow G1, and the second coupling shafts 663A and 663B are also moved in the direction indicated by the broken line arrow G1 by the rotations of the rotation links 66A and 66B. In this case, the second coupling shafts 663A and 663B are moved while drawing trajectories including approximately curved arc lines from a lower position to an upper position.

Subsequently, power, which is generated by the rotational motion performed as the second coupling shafts 663A and 663B of the rotation links 66A and 66B move (swing) in the direction indicated by the broken line arrow G1, is transmitted to the first projections 51 of the exposure device 23 through the connection links 68A and 68B.

Therefore, the first projections 51 are moved by being guided by the first guide grooves 53 in the movement mechanisms 5A and 5B, such that the first projections 51 are moved from lower positions of the first guide grooves 53 to upper positions of the first guide grooves 53. In addition, together with the movements of the first projections 51, the second projections 52 of the exposure device 23 are moved by being guided by the second guide grooves 54 in the movement mechanisms 5A and 5B, such that the second projections 52 are moved from lower positions of the second guide grooves 54 to upper positions of the second guide grooves 54.

Therefore, as illustrated in FIGS. 4, 6, 13B, and 14B, when the opening/closing cover 15 is opened, the movement mechanisms 5A and 5B operate to move the exposure device 23 (from the exposure position P1) to the retracted position P2 in cooperation with the operation of opening the opening/closing cover 15.

As illustrated in FIGS. 4 and 6, the exposure device 23, which is moved to the retracted position P2 by the movement mechanisms 5A and 5B, is maintained in a stopped posture in a state in which (the light exit surface 233 of) the exposure main body portion 231 is directed obliquely upward. For example, the direction directed obliquely upward is a direction directed upward in the longitudinal direction of the second detachment passage space S2.

In this connection, the exposure device 23 is stopped at the retracted position P2 by the following construction.

That is, in this step, the contact operating units 18A and 18B of the opening/closing cover 15 are completely spaced apart from the rotation bodies 62A and 62B. However, as illustrated in FIGS. 13B and 14B, the rotation bodies 62A and 62B of the link mechanisms 6A and 6B continue to receive the tension TA1 and TB1 of the tension springs 63A and 63B as the biasing force MA1 and MB1 that rotates the rotation bodies 62A and 62B in the direction indicated by the arrow C1, and as a result, the rotation bodies 62A and 62B continue to rotate in the direction indicated by the broken line arrow C1. For this reason, the rotational motion (power) when the rotation bodies 62A and 62B continue to rotate in the direction indicated by the broken line arrow C1 is transmitted by the power transmission units 65A and 65B as force FA1 and FB1 that continues to rotate the rotation links 66A and 66B in the direction indicated by the broken line arrow G1.

As a result, since the rotation links 66A and 66B continue to rotate in the direction indicated by the broken line arrow G1, the first projections 51 and the second projections 52 of the exposure device 23 remain stopped at upper positions of the first guide grooves 53 and the second guide grooves 54.

The exposure device 23 is moved to the retracted position P2 by the movement mechanisms 5A and 5B, such that the exposure device 23 is present in the narrow space S5 which is a position outside the second detachment passage space S2, as illustrated in FIG. 4.

Therefore, in the image forming apparatus 1, the operation of detaching (moving) the detachable unit 20 by using the second detachment passage space S2 is performed without hindrance caused by the presence of the exposure device 23. In addition, when the exposure device 23 is at the retracted position P2, the exposure device 23 is not in the stopped posture in a state in which the exposure main body portion (light exit portion) 231 is directed toward the second detachment passage space S2, and as a result, there is no concern that the detachable unit 20 causes erroneous contact while passing through the second detachment passage space S2, such that the exposure main body portion 231 is damaged.

In the image forming apparatus 1, when the exposure device 23 is at the retracted position P2, the exposure device 23 is in the stopped posture in a state in which the exposure main body portion 231 (light exit surface 233) is directed toward an upper surface side opening of the casing 10 which is opened by the opening/closing cover 15. For this reason, it is possible to clean (the light exit surface 233 of) the exposure main body portion 231 of the exposure device 23 while checking (the light exit surface 233 of) the exposure main body portion 231 with the naked eye unless another constituent component (in other words, obstacle) is interposed between the exposure device 23 and the upper surface side opening of the casing 10 when the exposure device 23 is at the retracted position P2.

As illustrated in FIG. 6, the movement mechanisms 5A and 5B of the image forming apparatus 1 are configured, by the setting of the first guide grooves 53 and the second guide grooves 54, such that the exposure device 23 is moved so that the stopped posture at the retracted position P2 is a posture rotated by 90° or more with respect to the stopped posture at the exposure position P1. In this case, as indicated by an intersection angle θ between straight lines K1 and K2 indicated by the two alternate-long-and-two-short-dashes lines in FIG. 6, the posture rotated by 90° or more is a posture which is rotated so that the intersection angle θ is 90° or more.

For this reason, in the movement mechanisms 5A and 5B, the stopped posture of the exposure device 23 at the exposure position P1 and the stopped posture of the exposure device 23 at the retracted position P2 may be changed to different postures which are rotated by 90 degrees or more.

Operation when Closing the Opening/Closing Cover:

Next, an operation of closing the opening/closing cover 15 in the opened state will be described.

In this case, in a step in which the opening/closing cover 15 is opened, as illustrated in FIGS. 4, 13B, and 14B, the movement mechanisms 5A and 5B are maintained in the state in which the operation of moving the exposure device 23 to the retracted position P2 is finished.

In this state, as illustrated in FIGS. 13A, 13B, 14A, 14B, and 18, when the opening/closing cover 15 begins to be closed by swinging in the direction indicated by the arrow B2, the contact surface portions 183 of the contact operating units 18A and 18B on the opening/closing cover 15 come into contact with the contacted portions 622A and 622B of the rotation bodies 62A and 62B of the power input units 61A and 61B of the link mechanisms 6A and 6B, and then the rotation bodies 62A and 62B begin to rotate in the direction indicated by the broken line arrow C2.

Therefore, power, which is generated by the rotational motion performed as the rotation bodies 62A and 62B are rotated in the direction indicated by the broken line arrow C2, is transmitted to the movement mechanisms 5A and 5B through the power transmission units 65A and 65B of the link mechanisms 6A and 6B.

That is, as the rotation bodies 62A and 62B are rotated in the direction indicated by the broken line arrow C2, the coupling links 67A and 67B of the power transmission units 65A and 65B are moved toward the movement mechanisms 5A and 5B in the direction indicated by the broken line arrow D2. Thereafter, the first coupling shafts 662A and 662B of the rotation links 66A and 66B are moved along the guide grooves 173A and 173B in the direction indicated by the broken line arrow E2 by the movements of the coupling links 67A and 67B.

Here, the operation in which the contact operating units 18A and 18B on the opening/closing cover 15, which swings in the direction indicated by the arrow B2, come into contact with the rotation bodies 62A and 62B to rotate the rotation bodies 62A and 62B in the direction indicated by the broken line arrow C2 is performed by the following two-step operation.

Figure 19:
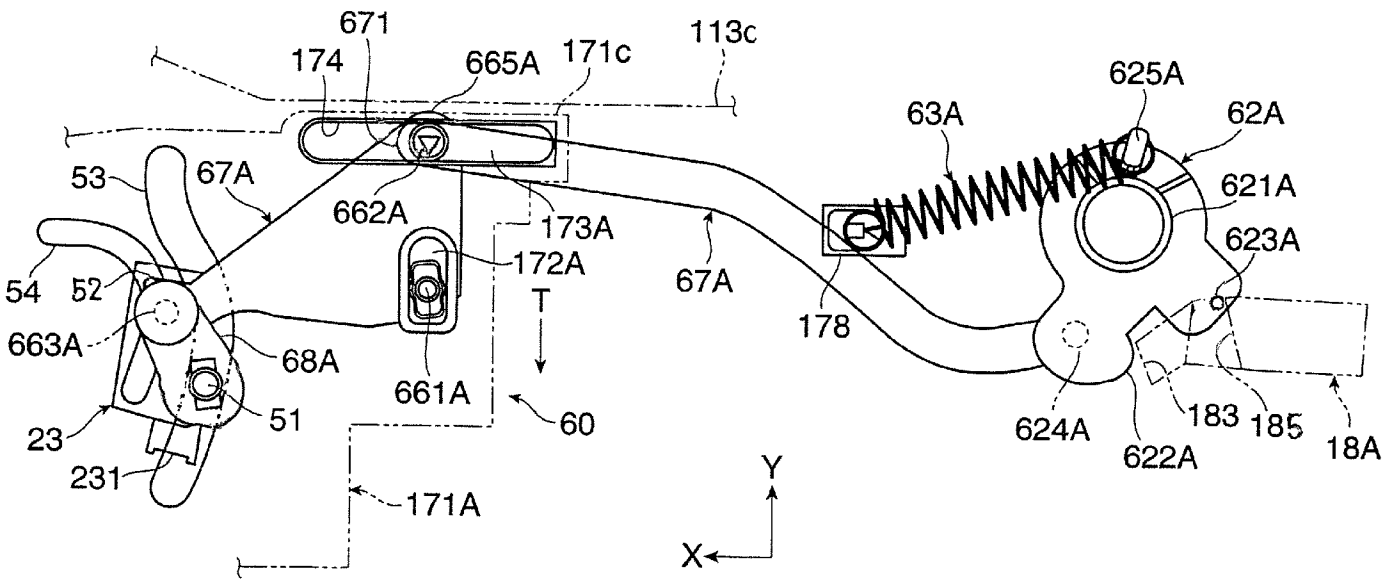
FIG. 19 is a schematic view illustrating a state in which the link mechanism and the like of the left moving apparatus operate (a state in which the exposure device is moved to a position between the exposure position and the retracted position)

That is, the operation is changed from an operation of a first step in which the contact surface portions 183 of the contact operating units 18A and 18B come into contact with the contacted portions 622A and 622B of the rotation bodies 62A and 62B to rotate the rotation bodies 62A and 62B as illustrated in FIG. 18 to an operation of a second step in which the operating projection portions 623A and 623B of the rotation bodies 62A and 62B come into contact with the pressing inclined surface portions 185 of the contact operating units 18A and 18B to rotate the rotation bodies 62A and 62B as illustrated in FIG. 19.

Therefore, the amount of rotations of the rotation bodies 62A and 62B in the direction indicated by the broken line arrow C2 may be increased in comparison with a case in which the contact surface portions 183 just come into contact with the contacted portions 622A and 622B of the rotation bodies 62A and 62B (a case in which only the operation of the first step is performed). This configuration leads to an increase in amount of the movement of the exposure device 23 by the movement mechanisms 5A and 5B.

Subsequently, as the first coupling shafts 662A and 662B are moved in the direction indicated by the broken line arrow E2, the rotation links 66A and 66B are rotated about the fulcrum shafts 661A and 661B in the direction indicated by a broken line arrow G2, and the second coupling shafts 663A and 663B are also moved in the direction indicated by the broken line arrow G2 by the rotations of the rotation links 66A and 66B. In this case, the second coupling shafts 663A and 663B are moved while drawing approximately arc trajectories (the alternate-long-and-short-dashes line TL in FIG. 16) from the upper position to the lower position.

Subsequently, power, which is generated by the rotational motion performed as the second coupling shafts 663A and 663B of the rotation links 66A and 66B are moved in the direction indicated by the broken line arrow G2, is transmitted to the first projections 51 of the exposure device 23 through the connection links 68A and 68B.

Figure 20:
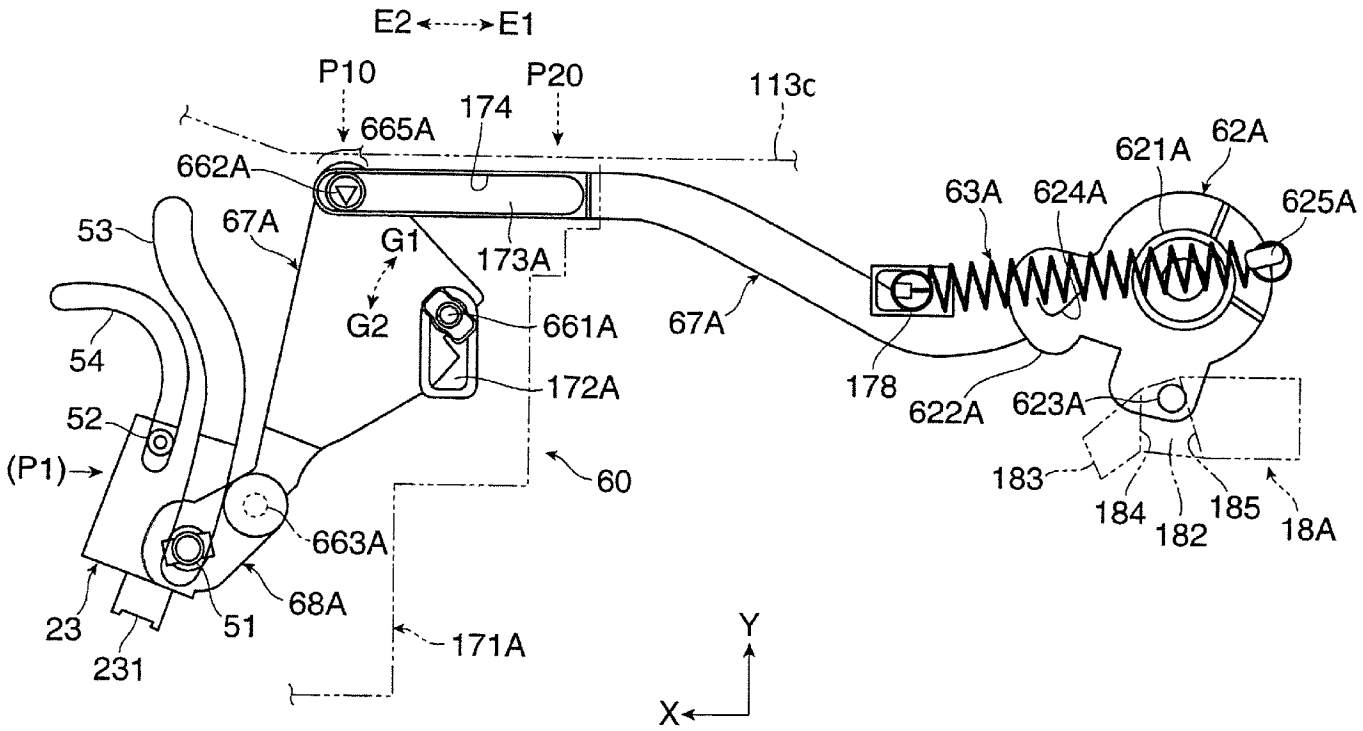
FIG. 20 is a schematic view illustrating a state in which the link mechanism and the like of the left moving apparatus operate (a state in which the exposure device is moved to the retracted position)

Therefore, as illustrated in FIGS. 18 to 20, the first projections 51 are moved by being guided by the first guide grooves 53 in the movement mechanisms 5A and 5B, such that the first projections 51 are moved from the upper positions of the first guide grooves 53 to the lower positions of the first guide grooves 53. In addition, together with the movements of the first projections 51, the second projections 52 of the exposure device 23 are moved by being guided by the second guide grooves 54 in the movement mechanisms 5A and 5B, such that the second projections 52 are moved from the upper positions of the second guide grooves 54 to the lower positions of the second guide grooves 54.

Therefore, as illustrated in FIGS. 2, 6, 13A, and 14A, when the opening/closing cover 15 is closed, the movement mechanisms 5A and 5B operate to move the exposure device 23 (from the retracted position P2) to the exposure position P1 in cooperation with the operation of closing the opening/closing cover 15.

As illustrated in FIGS. 4 and 6, the exposure device 23, which is moved to the exposure position P1 by the movement mechanisms 5A and 5B, is maintained in a stopped posture in a state in which (the light exit surface 233 of) the exposure main body portion 231 is directed obliquely downward (toward the exposure position of the photoconductive drum 21: the position where the electrostatic latent image is formed).

In this case, the exposure device 23 is stopped at the exposure position P1 by the following construction.

Figure 21:
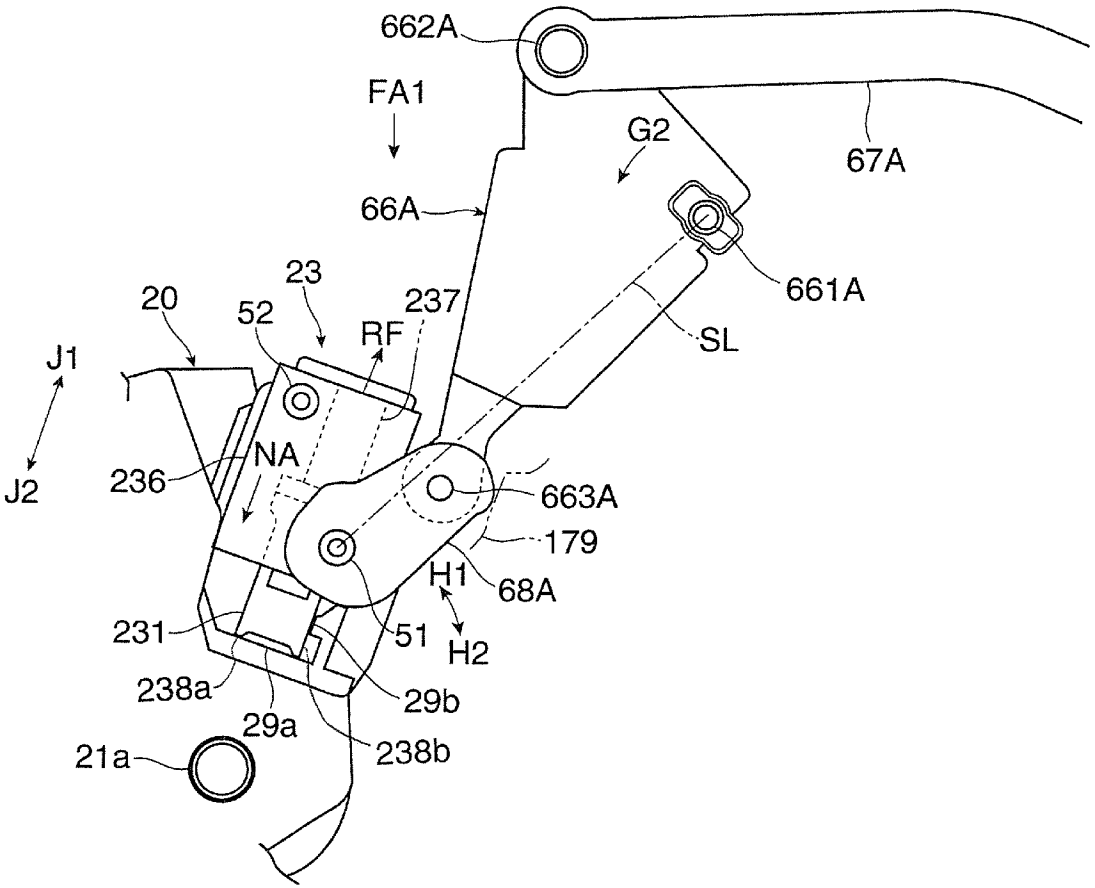
FIG. 21 is a schematic view illustrating a state in which the exposure device comes into contact with the positioning portion of the detachable unit and moves to the exposure position.

First, as illustrated in FIG. 21, the exposure device 23, which is moved to the exposure position P1 by being guided by the first guide grooves 53 of the movement mechanisms 5A and 5B and the moving apparatus parts 50A and 50B, stops moving at a point in time at which parts at the both ends 238 of the exposure main body portion 231 (a part of the lower surface portion 238*a* and a part of the side surface portion 238*b*) come into contact with the positioning portions 29 (the first positioning portions 29*a* and the second positioning portion 29*b*) of the detachable unit 20.

In this case, as illustrated in FIGS. 13A and 14A, the rotation links 66A and 66B continue to receive the force FA2 and FB2 that rotates the rotation links 66A and 66B in the direction indicated by the arrow G2 through the link mechanisms 6A and 6B by the operation of closing the opening/closing cover 15, and as a result, the force FA2 and FB2 is transmitted to the first projections 51 from the second coupling shafts 663A and 663B through the connection links 68A and 68B.

Therefore, the mounting members 236 having the first projections 51 are pressed toward the positioning portions 29. Therefore, the compression springs 237 are further compressed. For this reason, as illustrated in FIG. 21, the exposure main body portion 231 of the exposure device 23 is biased by the compression springs 237 so as to be displaced with respect to the mounting members 236 in the direction indicated by an arrow J2, and as a result, the exposure main body portion 231 is strongly pressed against the positioning portions 29 and thus rigidly positioned.

Also in this case, the rotation links 66A and 66B continue to be rotated in the direction indicated by the arrow G2 through the link mechanisms 6A and 6B by the operation of closing the opening/closing cover 15, and as a result, the connection links 68A and 68B continue to swing in the direction indicated by an arrow H2 about the first projections 51 on the mounting members 236 of the exposure device 23 which are stopped by coming into contact with the positioning portions 29.

Thereby, as illustrated in FIGS. 16 and 21, the connection links 68A and 68B are in the stopped posture at a point in time at which the second coupling shafts 663A and 663B of the rotation links 66A and 66B move to the region where the second coupling shafts 663A and 663B go beyond the straight lines SL connecting the fulcrum shafts 661A and 661B of the rotation links 66A and 66B and the first projections 51 and come into contact with the stop portions 179. In this case, the second coupling shafts 663A and 663B pass through dead points which are positions that intersect the straight lines SL. In addition, in this case, in the rotation links 66A and 66B and the connection links 68A and 68B, each of the lines, which connect the fulcrum shafts 661A and 661B, the second coupling shafts 663A and 663B, and the first projections 51, is a line bent entirely in a dogleg shape because the positions of the second coupling shafts 663A and 663B deviate and protrude from the straight lines SL in the direction indicated by the arrow G2 or the arrow H2.

Subsequently, in this case, as illustrated in FIG. 21, the connection links 68A and 68B receive, from the first projections 51, reactions RF which are generated on the mounting members 236 by biasing force NA of the compression springs 237 at the both ends 238 of the exposure main body portion 231. In addition, by the reactions RF, the mounting members 236 are returned in the direction indicated by an arrow J1.

Therefore, the stopped posture of the connection links 68A and 68B is maintained since parts of the ends of the connection links 68A and 68B, which are connected to the second coupling shafts 663A and 663B of the rotation links 66A and 66B, remain being in contact with the stop portions 179.

As a result, the rotation links 66A and 66B are maintained in the stopped posture without being rotated in the direction indicated by the arrow H1 because the rotation links 66A and 66B receive the reactions RF generated on the mounting members 236 by the biasing force NA of the compression springs 237, and as a result, the exposure main body portion 231 of the exposure device 23 continues to be in contact with the positioning portions 29 of the detachable unit 20, such that the exposure device 23 is maintained in the stopped state at the exposure position P1.

In this connection, when the rotation links 66A and 66B are maintained in the stopped state, the rotation links 66A and 66B receive no force FA2 and FB2 that rotates the rotation links 66A and 66B in the direction indicated by the arrow G2.

That is, in this case, as illustrated in FIGS. 13A, 14A, and 16, in the link mechanisms 6A and 6B and the moving apparatus parts 50A and 50B, the tension springs 63A and 63B further extend in comparison with the case in which the exposure device 23 is at the retracted position P2, but the tension springs 63A and 63B are also in the stopped state as parts of the tension springs 63A and 63B approach until the parts of tension springs 63A and 63B include the rotation centers of the shaft portions 621A and 621B of the rotation bodies 62A and 62B. For this reason, in this case, the tension TA2 and TB2 of the tension springs 63A and 63B is not applied as biasing force that rotates the rotation bodies 62A and 62B in the direction indicated by the broken line arrow C2, but the tension TA2 and TB2 is slightly applied as the biasing force MA2 and MB2 that rotates the rotation bodies 62A and 62B in the direction indicated by the broken line arrow C1. Therefore, in this case, since the rotation bodies 62A and 62B are rotated in the direction indicated by the arrow C1 by receiving the tension TA2 and TB2 of the tension springs 63A and 63B, the rotational motion (power) of the rotation bodies 62A and 62B is not transmitted, through the power transmission units 65A and 65B, as the force FA2 and FB2 that rotates the rotation links 66A and 66B in the direction indicated by the arrow G2, as illustrated in FIGS. 13A and 14A.

In a step in which the opening/closing cover 15 is completely closed (in a locked state), the operating projection portions 623A and 623B of the rotation bodies 62A and 62B are present at intermediate positions of the recess portions 182 (FIG. 9) of the contact operating units 18A and 18B of the opening/closing cover 15, as illustrated in FIG. 16, such that the contact operating units 18A and 18B remain without being in contact with the operating projection portions 623A and 623B.

For example, this configuration is configured as described below.

That is, when the opening/closing cover 15 is closed, the opening/closing cover 15 is configured to swing, with over stroke, to a swinging end position which deviates, by several millimeters, in a closing direction indicated by the arrow B2 beyond a fixed position at which the opening/closing cover 15 is locked by a non-illustrated locking unit (latch mechanism), and the opening/closing cover 15 is configured to receive, from a non-illustrated biasing unit (spring), slight biasing force that slightly returns the opening/closing cover 15 in an opening direction indicated by the arrow B1.

Therefore, during the process of closing the opening/closing cover 15, the pressing inclined surface portions 185 of the contact operating units 18A and 18B come into contact with the operating projection portions 623A and 623B of the rotation bodies 62A and 62B, and the pressing inclined surface portions 185 continue to be in contact with the operating projection portions 623A and 623B until the connection links 68A and 68B are in the stopped posture. However, when the connection links 68A and 68B receive the reactions and thus are maintained in the stopped posture, the rotation bodies 62A and 62B are in the stopped state by the entire relationship of the link mechanisms 6A and 6B, whereas the opening/closing cover 15 returns back to the fixed position from the swinging end position by receiving the biasing force. As a result, the contact operating units 18A and 18B are moved slightly in the direction indicated by the arrow B1 as the opening/closing cover 15 swings, such that the contact operating units 18A and 18B are spaced apart from the operating projection portions 623A and 623B of the rotation bodies 62A and 62B.

As illustrated in FIG. 2, as the exposure device 23 is moved to the exposure position P1 by the movement mechanisms 5A and 5B, the exposure device 23 is in a state in which an electrostatic latent image may be formed on the photoconductive drum 21 by the exposure.

In the moving apparatus parts 50A and 50B, as described above, there is a relationship in which the paths of the first guide grooves 53 are different from the trajectories along which the second coupling shafts 663A and 663B of the rotation links 66A and 66B swing. However, in the moving apparatus parts 50A and 50B, the first projections 51 of the mounting members 236, which are guided by the first guide grooves 53, and the second coupling shafts 663 of the rotation links 66A and 66B are connected by the connection links 68A and 68B, and as a result, the exposure device 23 moves smoothly between the exposure position P1 and the retracted position P2.

In contrast, for example, in a case in which (parts of the first projections 51 of) the mounting members 236 are directly connected to the second coupling shafts 663 of the rotation links 66A and 66B, it is difficult to smoothly move the exposure device 23 between the exposure position P1 and the retracted position P2 when the paths of the first guide grooves 53 are different from the trajectories along which the second coupling shafts 663A and 663B of the rotation links 66A and 66B swing. In addition, in this case, in accordance with a degree of the difference, connecting holes (long holes), which connect the mounting members 236 and the second coupling shafts 663, need to be further elongated and have more complicated shapes, which causes an increase in size of the apparatus.

In the moving apparatus parts 50A and 50B, it is possible to fix the exposure device 23 at the exposure position P1 by maintaining the connection links 68A and 68B in the stopped posture by using the biasing force NA (FIG. 21) of the compression springs 237 in the exposure device 23.

In the moving apparatus parts 50A and 50B, the biasing force MA2 and MB2 (FIGS. 13A, 13B, 14A and 14B), which is applied to the rotation links 66A and 66B by the tension springs 63A and 63B to rotate the rotation links 66A and 66B in the direction indicated by the arrow G1, is decreased when the exposure device 23 is moved to the exposure position P1, and the rotation links 66A and 66B are not strongly rotated in the direction indicated by the arrow G1, such that the connection links 68A and 68B may be continuously maintained in the stopped posture. This configuration may also fix the exposure device 23 at the exposure position P1.

The image forming apparatus 1 including the moving apparatus parts 50A and 50B has the following advantages when the exposure device 23 is moved to the exposure position P1 by the moving apparatuses 17A and 17B when no detachable unit 20 is mounted.

First, since the exposure main body portion 231 of the exposure device 23 does not come into contact with the positioning portions 29 of the detachable unit 20 when the exposure device 23 is moved to the exposure position P1, the connection links 68A and 68B are not maintained in the stopped posture by receiving the reactions RF, such that the exposure device 23 is not fixed at the exposure position P1. Therefore, for example, it is possible to allow a user to recognize that the user neglects to mount the detachable unit 20.

In this case, since the exposure device 23 is not fixed at the exposure position P1, there occurs no situation in which the exposure is erroneously performed (an incorrect operation is performed) by the exposure device 23 at a place where the photoconductive drum 21, which is an example of a latent image holding unit, is not present.

In the image forming apparatus 1, it is possible to easily move the exposure device 23 between the exposure position P1 and the retracted position P2 in cooperation with the operation of opening/closing the opening/closing cover 15.

In the first exemplary embodiment, the long side guide portions 174 are provided in the guide grooves 173A and 173B in the link mechanism parts 60 of the link mechanisms 6A and 6B, and the support grooves 172A and 172B are configured as the long grooves as described above (FIGS. 12A and 12B).

Therefore, as illustrated in FIGS. 18 to 20, when the rotation links 66A and 66B are rotated about the fulcrum shafts 661A and 661B, the fulcrum shafts 661A and 661B are temporarily displaced (moved) in the support grooves 172A and 172B in a direction T away from the guide grooves 173A and 173B, and the first coupling shafts 662A and 662B are moved rectilinearly by being guided by the long side guide portions 174 in the guide grooves 173A and 173B when the first coupling shafts 662A and 662B are moved between the two points (P10 and P20) (see FIG. 19).

As a result, degrees to which portions 665A and 665B of the rotation links 66A and 66B, where the first coupling shafts 662A and 662B are present, protrude from portions (in this example, the long side guide portions 174), which are opposite to the support grooves 172A and 172B, of the guide grooves 173A and 173B that guide the first coupling shafts 662A and 662B to allow the first coupling shafts 662A and 662B to move between the two points (P10 and P20) are decreased in accordance with the rotations of the rotation links 66A and 66B (see FIG. 19).

Therefore, in the image forming apparatus 1, the link mechanism parts 60 may be easily disposed in the state in which the link mechanism parts 60 are close to upper surface bent portions 113*d* and 114*d* which are an example of inner wall surfaces of the side surface portions 113 and 114 of the casing 10 (FIGS. 13A and 13B to FIG. 18).

In the first exemplary embodiment, the following configuration is adopted as the side coupling portion 115 of the casing 10.

In the first exemplary embodiment, for example, as illustrated in FIGS. 5, 22A, 22B, and 22C, the side coupling portion 115 is configured as a member having a top plate section 115*a* which is long in one direction, a first side surface portion 115*b* which is connected to one long side portion of the top plate section 115*a* in the longitudinal direction, and second side surface portions 115*c* and 115*d* which are connected to short side portions at both ends of the top plate section 115*a* in the longitudinal direction.

An opening 118 is provided in the top plate section 115*a*, as necessary. In the first exemplary embodiment, the opening 118 is used as a part of a passageway of the double-sided printing transport path Rt4 (FIG. 2). In addition, the first side surface portion 115*b* has protruding ends protruding outward from the second side surface portions 115*c* and 115*d*. As illustrated in FIG. 5, the protruding ends of the first side surface portion 115*b* are joined from the outside to the side bent portions 113*b* and 114*b* of the left and right side surface portions 113 and 114 of the casing 10. Further, the second side surface portions 115*c* and 115*d* are joined from the inside to the main body portions 113*a* and 114*a* of the left and right side surface portions 113 and 114 of the casing 10.

In the side coupling portion 115, long holes 202, which are elongated in a vertical direction in a direction of gravity, together with screw penetration holes 201, are formed in the protruding ends of the first side surface portion 115*b*. In addition, long holes 203, which are elongated in a horizontal direction, are also formed in the second side surface portions 115*c* and 115*d*. Screw penetration holes 201 may also be provided in the second side surface portions 115*c* and 115*d*.

The long holes 202 and 203 are used as positioning holes. For this reason, non-illustrated columnar projections (bosses), which are formed on the side bent portions 113*b* and 114*b* or the main body portions 113*a* and 114*a* of the left and right side surface portions 113 and 114, are fitted into the long holes 202 and 203 when assembling the casing 10 and the like. The positions and the number of provided long holes 202 and 203 are not particularly limited and may be appropriately selected. The side coupling portion 115 is fixed by using screws and the screw penetration holes 201, such that the side coupling portion 115 is mounted on the casing 10. The screw penetration holes 201 may be screw holes.

Since the side coupling portion 115 has the long holes 202 and 203, it is possible to inhibit the casing 10 from being twisted due to distortion in a floor on which the image forming apparatus 1 is installed. In addition, it is also possible to inhibit deformation, distortion, or irregularity that occurs when assembling the casing 10 or the entire image forming apparatus 1.

Figures 22A, 22B, 22C:
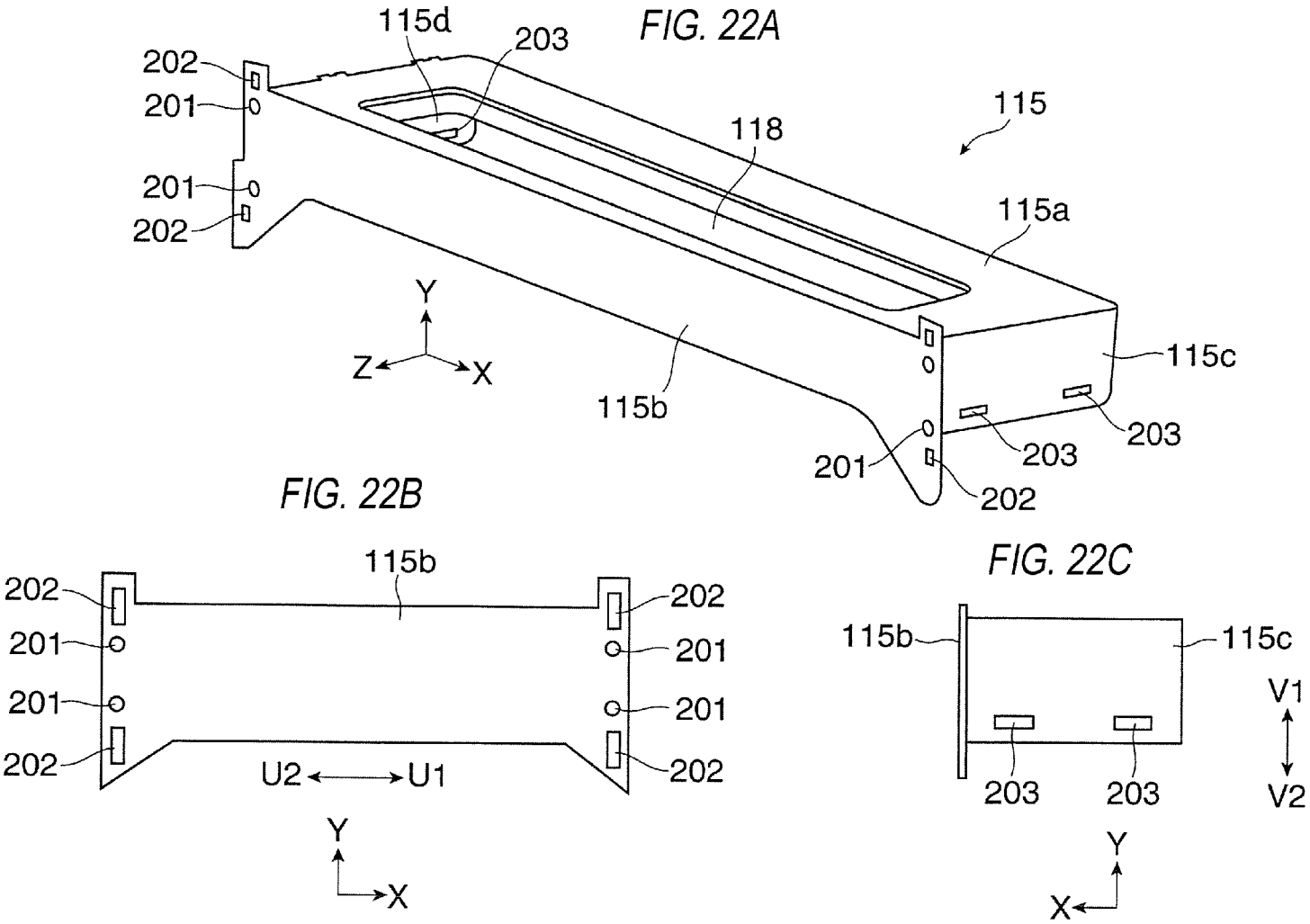

In this connection, as illustrated in FIG. 22B, the long holes 202, which are elongated in the vertical direction, exhibit an inhibition effect against components of force generated when the side surface portions 113 and 114 of the casing 10 are twisted or deformed in an approximately horizontal direction indicated by arrows U1 and U2. In addition, as illustrated in FIG. 22C, the long holes 203, which are elongated in the horizontal direction, exhibit an inhibition effect against components of force generated when the side surface portions 113 and 114 of the casing 10 are twisted or deformed in an approximately vertical direction indicated by arrows V1 and V2. For this reason, with the side coupling portion 115 having the long holes 202 and 203, it is possible to further perform the positioning in the two directions including the vertical direction and the horizontal direction.

Second Exemplary Embodiment

Next, a second exemplary embodiment will be described. Further, members identical or similar to the members in the first exemplary embodiment will be denoted by the same reference numerals, and repeated descriptions thereof will be appropriately omitted.

<Link Operating Apparatus>

In the second exemplary embodiment, the power input units 61A and 61B constitute parts of link operating apparatuses 60 (in the second exemplary embodiment, the members 60 are referred to as the link operating apparatuses) as described below.

First, as illustrated in FIGS. 25A and 25B to FIG. 28, the link operating apparatuses 60 are apparatuses that at least include the rotation bodies 62A and 62B which are an example of rotating units having shaft portions rotatably supported and plural contacted portions provided at positions different in the direction in which the shaft portions are rotated, link units which are connected to parts of the rotation bodies 62A and 62B and displaced in accordance with the rotations of the rotation bodies 62A and 62B, and the contact operating units 18A and 18B which are an example of moving contact units having plural contacting portions which sequentially come into contact with the plural contacted portions of the rotation bodies 62A and 62B to rotate the rotation bodies 62A and 62B.

The link operating apparatuses 60 are configured as the left and right link operating apparatuses 60 (specifically, a left link operating apparatus 60A and a right link operating apparatus 60B) that correspond to the left and right link mechanisms 6A and 6B.

The power input units 61A and 61B constitute the rotating units and the moving contact units of the link operating apparatuses 60A and 60B. In addition, in the second exemplary embodiment, the coupling links 67A and 67B of the power transmission units 65A and 65B, which will be described below, are applied as the link units of the link operating apparatuses 60. Further, in the second exemplary embodiment, the contact operating units 18A and 18B of the link operating apparatuses 60 are disposed to move toward or away from the rotation bodies 62A and 62B. In the second exemplary embodiment, as described below, the contact operating units 18A and 18B are provided on the opening/closing cover 15 which is opened/closed by swinging in the directions indicated by the arrows B1 and B2.

As illustrated in FIGS. 7 to 9, 23A and 23B, and 28, both of the rotation bodies 62A and 62B have the disk-shaped main body portions 620A and 620B having the cylindrical shaft portions 621A and 621B which are fitted with and rotatably supported by the non-illustrated rotating shaft provided on the second support member 175A or the right side surface portion 114.

As illustrated in FIGS. 7 to 9, 23A and 23B, and 28, both of the rotation bodies 62A and 62B have first contacted portions 622A and 622B and second contacted portions 623A and 623B which are in contact with parts of the contact operating units 18A and 18B of the opening/closing cover 15 at circumferences of the shaft portions 621A and 621B of the main body portions 620A and 620B, the coupling shafts 624A and 624B which are coupled to one end of the coupling link 67A and one end of the coupling link 67B of the power transmission units 65A and 65B which will be described below, and the spring mounting portions 625A and 625B on which one end of the tension spring 63A and one end of the tension spring 63B, which will be described below, are mounted (in the second exemplary embodiment, the members 622A and 622B are referred to as the first contacted portions and the members 623A and 623B are referred to as the second contacted portions).

Figure 23A:
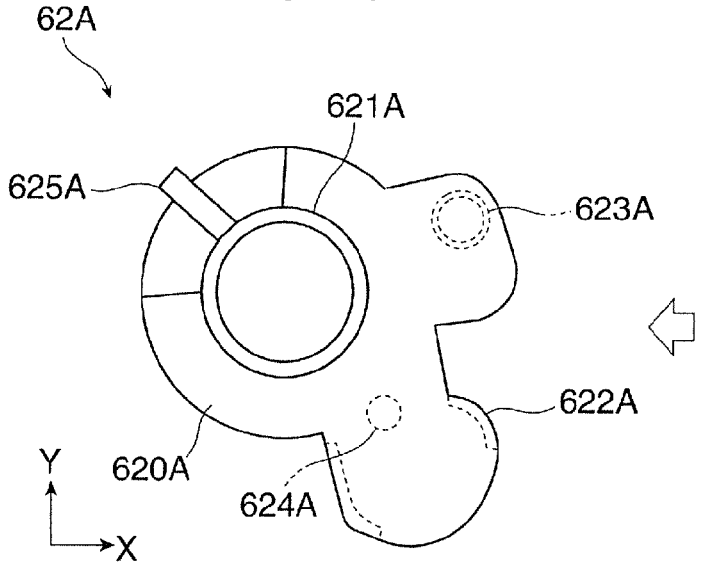
FIG. 23A is a side view of a rotation body in FIG. 9.
Figure 23B:
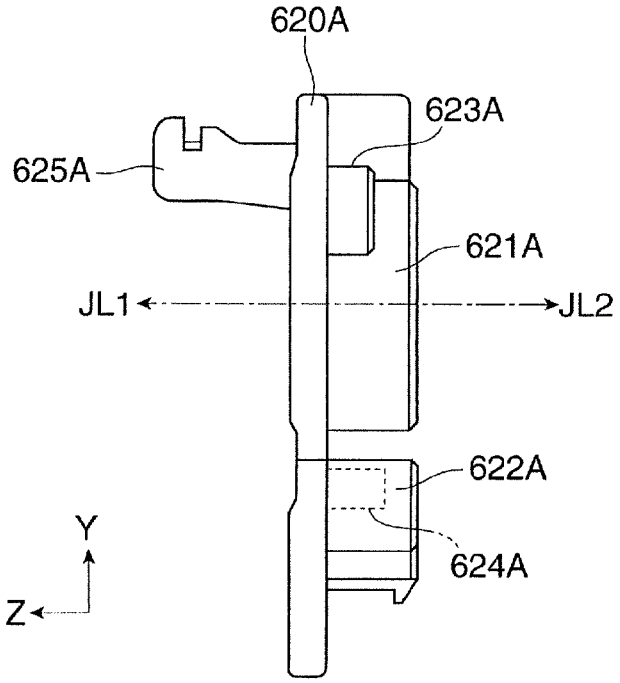
FIG. 23B is a view illustrating a state when viewing the rotating body in FIG. 23A in a direction indicated by the arrow.

As illustrated in FIGS. 9 and 23B, all of the first contacted portions 622A and 622B and the second contacted portions 623A and 623B are provided as protruding portions that protrude in a direction along an axis JL of the shaft portions 621A (621B) in the identical direction JL2 based on the main body portions 620A (620B). In the second exemplary embodiment, the first contacted portions 622A and 622B are provided as semicylindrical protruding portions, and the second contacted portions 623A and 623B are provided as columnar protruding portions.

Meanwhile, as illustrated in FIG. 23B, both of the spring mounting portions 625A and 625B are provided as protruding portions that protrude in the direction along the axis JL of the shaft portions 621A (621B) in a direction JL1 opposite to a direction toward the side where the first contacted portion 622A (622B) is present based on the main body portions 620A (620B).

One end of the tension spring (coil spring) 63A and one end of the tension spring 63B are mounted on the spring mounting portions 625A and 625B of the rotation bodies 62A and 62B. In this way, as illustrated in FIGS. 25A, 25B, 26A and 26B, the rotation bodies 62A and 62B continue to be tense in a necessary direction with necessary tension (TA and TB).

When viewing the spring mounting portions 625A and 625B of the rotation bodies 62A and 62B in the order of the rotation direction C1 indicated by the broken line arrow C1 to be described below based on the main body portions 620A and 620B, the second contacted portions 623A and 623B, the first contacted portions 622A and 622B, the spring mounting portions 625A and 625B are disposed in this order at portions arranged at intervals. In addition, in other words, the spring mounting portions 625A and 625B are disposed at portions between the first contacted portions 622A and 622B of the main body portions 620A and 620B and the spring mounting portions 625A and 625B for the tension springs 63A and 63B.

In the second exemplary embodiment, the tension springs 63A and 63B are provided as biasing units which provide force (biasing force) MA and MB that biases the rotation bodies 62A and 62B to rotate the rotation bodies 62A and 62B in the direction when the contact operating units 18A and 18B are moved in a direction away from the rotation bodies 62A and 62B (the direction identical to the swinging direction B1 when opening the opening/closing cover 15).

As illustrated in FIGS. 25A, 25B, 26A, and 26B, the tension springs 63A and 63B are configured such that the force (biasing force) MA2 and MB2 which biases the rotation links 66A and 66B when the exposure device 23 is at the exposure position P1 is smaller than the biasing force (biasing force) MA1 and MB1 when the exposure device 23 is at the retracted position P2 (MA2<MA1, MB2<MB1).

One end of the tension spring 63A and one end of the tension spring 63B are mounted on the spring mounting portions 625A and 625B of the rotation bodies 62A and 62B, and the other end 632*b* of the tension spring 63A and the other end 632*b* of the tension spring 63B are mounted on the spring mounting portions 178 provided on the second support member 175A at the left or the right side surface portion 114 of the casing 10 (in the second exemplary embodiment, the members 178 are referred to as the spring mounting portions). Further, the tension springs 63A and 63B are disposed such that when the exposure device 23 is moved from the retracted position P2 to the exposure position P1, parts of the tension springs 63A and 63B approach and stop until the parts of the tension springs 63A and 63B include the rotation centers of the shaft portions 621A and 621B of the rotation bodies 62A and 62B. The arrangement of the tension springs 63A and 63B is realized by selecting fixed positions of both ends of the tension springs 63A and 63B in the longitudinal direction. Therefore, the tension springs 63A and 63B are configured such that the relationship of the biasing force satisfies the relationship of MA2<MA1 and MB2<MB1 when the exposure device 23 is at the exposure position P1.

Figure 24A:
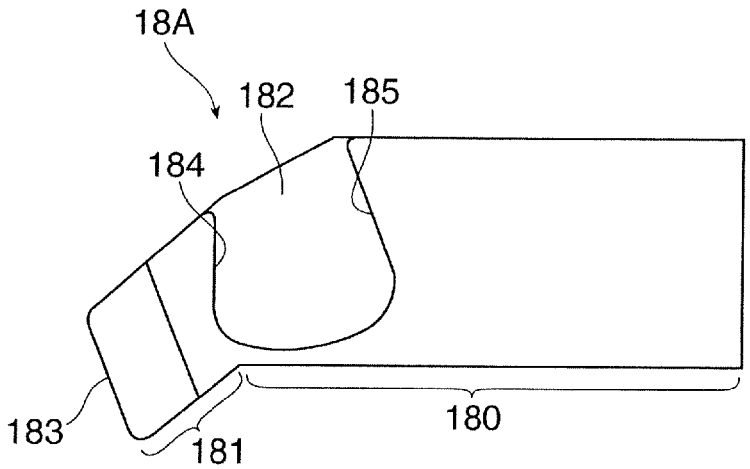
FIG. 24A is a side view of a contact operating unit in FIG. 9.
Figure 24B:
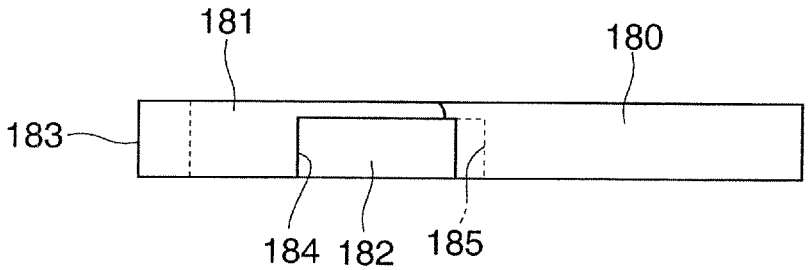
FIG. 24B is a top plan view of the contact operating unit in FIG. 24A.

Meanwhile, as illustrated in FIGS. 5, 9, 24A, 24B, 25A, 25B, 26A, and 26B, both of the contact operating units 18A and 18B of the opening/closing cover 15 are configured as members that have plate-shaped main body portions 180 which are disposed uprightly at predetermined positions of left and right ends on an inner wall surface of the opening/closing cover 15, bent tip portions 181 which obliquely extend downward at tips of the main body portions 180, and recess portions 182 which are notched to have shapes widened downward at boundary portions between the main body portions 180 and the bent tip portions 181. As illustrated in FIGS. 5, 24A, and 24B, the main body portion 180 and the bent tip portion 181 are configured as a single continuous member with the recess portion 182 disposed between the main body portion 180 and the bent tip portion 181.

As illustrated in FIG. 9 or FIGS. 24A and 24B, both of the contact operating units 18A and 18B have first contacting portions 183 provided at the tips of the bent tip portions 181 (in the second exemplary embodiment, the members 183 are referred to as the first contacting portion). The first contacting portions 183 are formed as an approximately planar end surface at the tip of the bent tip portion 181.

The first contacting portions 183 function as pressure contacting portions used by coming into contact with the first contacted portions 622A and 622B of the rotation bodies 62A and 62B when the contact operating units 18A and 18B are moved toward the rotation bodies 62A and 62B in accordance with the operation of swinging the opening/closing cover 15 in the closing direction indicated by the arrow B2 (see FIGS. 25A, 25B, 26A and 26B).

As illustrated in FIGS. 9, 24A, and 24B, in both of the contact operating units 18A and 18B, inner wall surfaces of the recess portion 182, which are in the vicinity of the contact surface portions 183, are formed as second contacting portions 184 which are formed as inclined surfaces inclined downward and outward and come into contact with the operating projection portions 623A and 623B of the rotation bodies 62A and 62B when opening the opening/closing cover 15 (in the second exemplary embodiment, the members 184 are referred to as the second contacting portions). Furthermore, inner wall surfaces of the recess portions 182, which are opposite to the contact surface portions 183, are formed as third contacting portions 185 which are formed as inclined surfaces inclined downward and outward and come into contact with the operating projection portions 623A and 623B of the rotation bodies 62A and 62B when closing the opening/closing cover 15 (in the second exemplary embodiment, the members 185 are referred to as the third contacting portions).

The second contacting portions 184 function as drawing contacting portions used by coming into contact with the second contacted portions 623A and 623B of the rotation bodies 62A and 62B when the contact operating units 18A and 18B are moved in a direction away from the rotation bodies 62A and 62B in accordance with the operation of swinging the opening/closing cover 15 in the opening direction indicated by the arrow B1 (see FIGS. 25A, 25B, 26A, and 26B). In addition, the third contacting portions 185 function as pressure contacting portions used by coming into contact with the second contacted portions 623A and 623B of the rotation bodies 62A and 62B when the contact operating units 18A and 18B are moved in a direction toward the rotation bodies 62A and 62B in accordance with the operation of swinging the opening/closing cover 15 in the closing direction indicated by the arrow B2 (see FIGS. 25A, 25B, 26A, and 26B).

<Operation of Moving Exposure Device by Movement Mechanism and Link Mechanism>

Similar to the first exemplary embodiment, the moving apparatuses 17A and 17B operate the link mechanisms 6A and 6B in cooperation with the operation of opening/closing the opening/closing cover 15, so that the exposure device 23 is moved between the exposure position P1 and the retracted position P2 by the movement mechanisms 5A and 5B.

Operation when Opening the Opening/Closing Cover:

First, an operation of opening the opening/closing cover 15 in the closed state will be described. The operation of opening the opening/closing cover 15 is performed when detaching the developer accommodating container 28 or the detachable unit 20 to change the developer accommodating container 28 or the detachable unit 20.

Figures 25A, 25B:
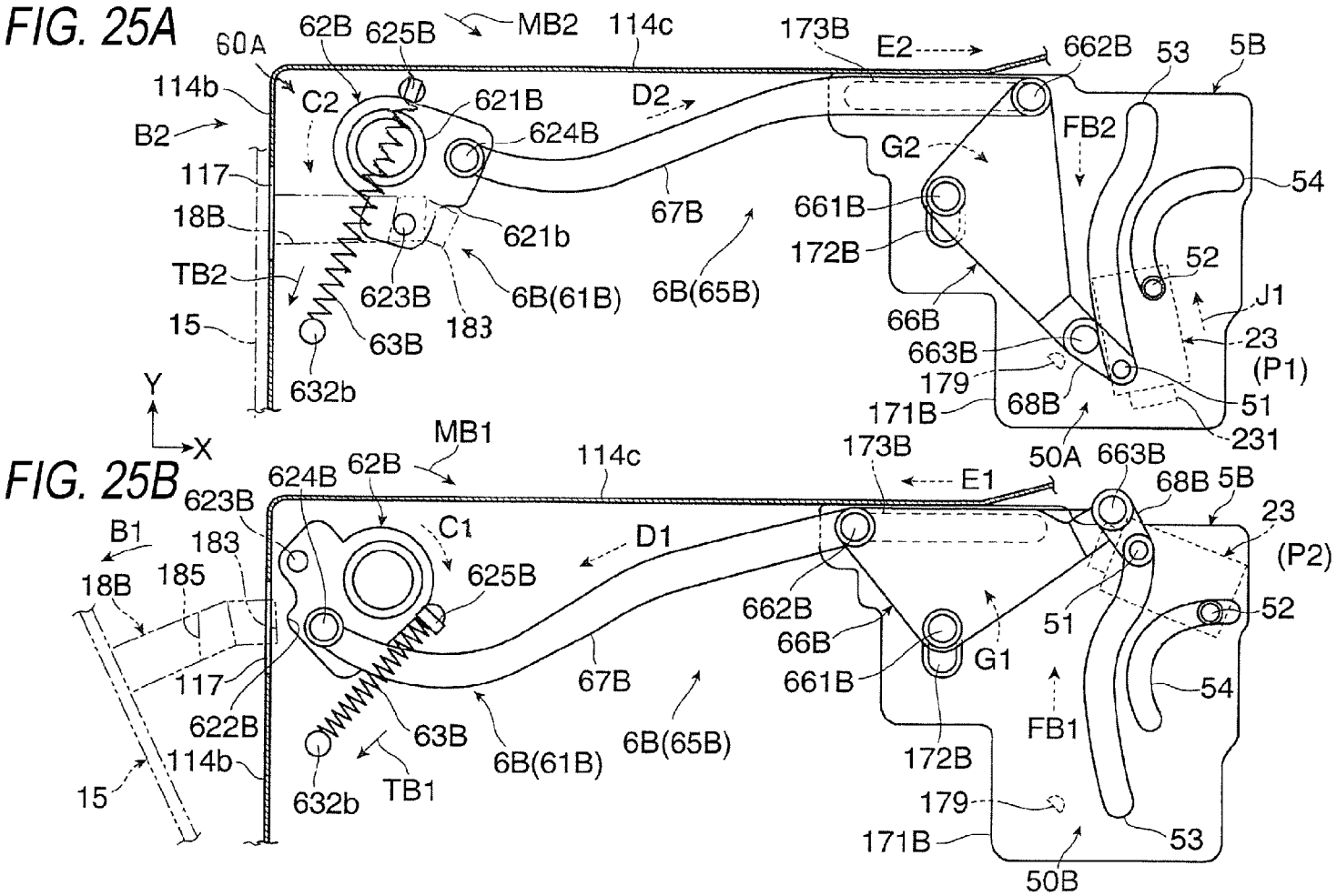
FIG. 25A is a schematic view illustrating the movement mechanism of the left moving apparatus and a state in which the exposure device is moved to the exposure position by the link operating apparatus.
FIG. 25B is a schematic view illustrating the movement mechanism and a state in which the exposure device is moved to the retracted position by the link operating apparatus.
Figures 26A, 26B:
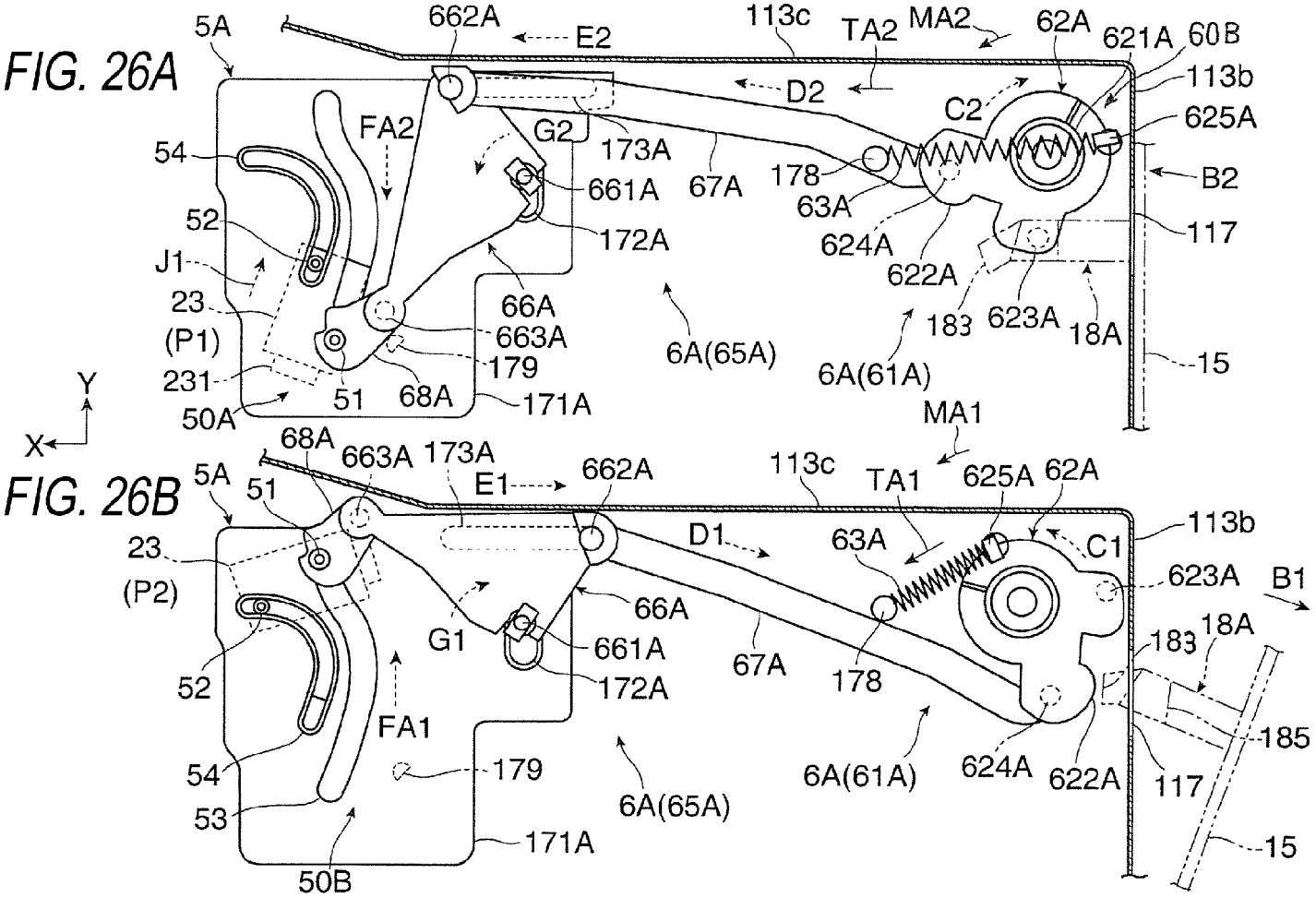
FIG. 26A is a schematic view illustrating the movement mechanism of the right moving apparatus and a state in which the exposure device is moved to the exposure position by the link operating apparatus.
FIG. 26B is a schematic view illustrating the movement mechanism and a state in which the exposure device is moved to the retracted position by the link operating apparatus.
Figure 27:
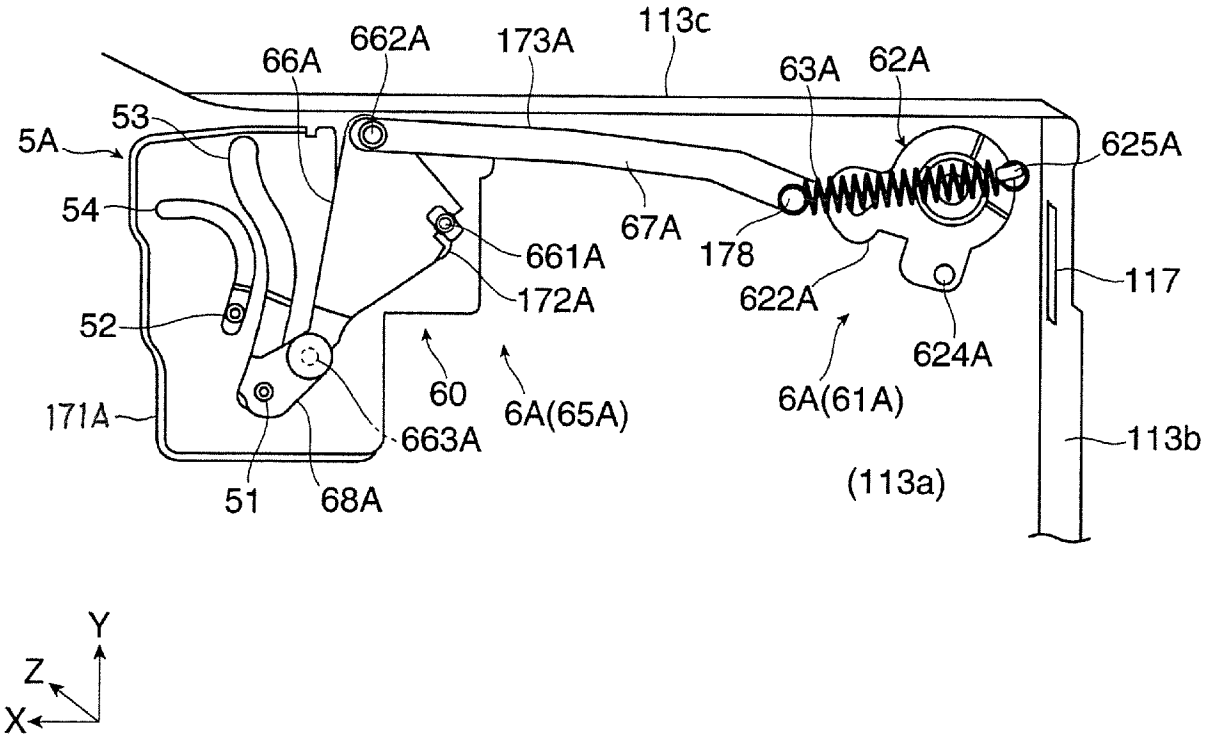
FIG. 27 is a schematic perspective view illustrating a state in which the moving apparatus including the link mechanism is mounted in the casing.

In this case, in a step in which the opening/closing cover 15 is closed, as illustrated in FIGS. 2, 25A, and 26A, the movement mechanisms 5A and 5B are maintained in the state in which the operation of the movement mechanisms 5A and 5B moving the exposure device 23 to the exposure position P1 is finished.

Figure 29:
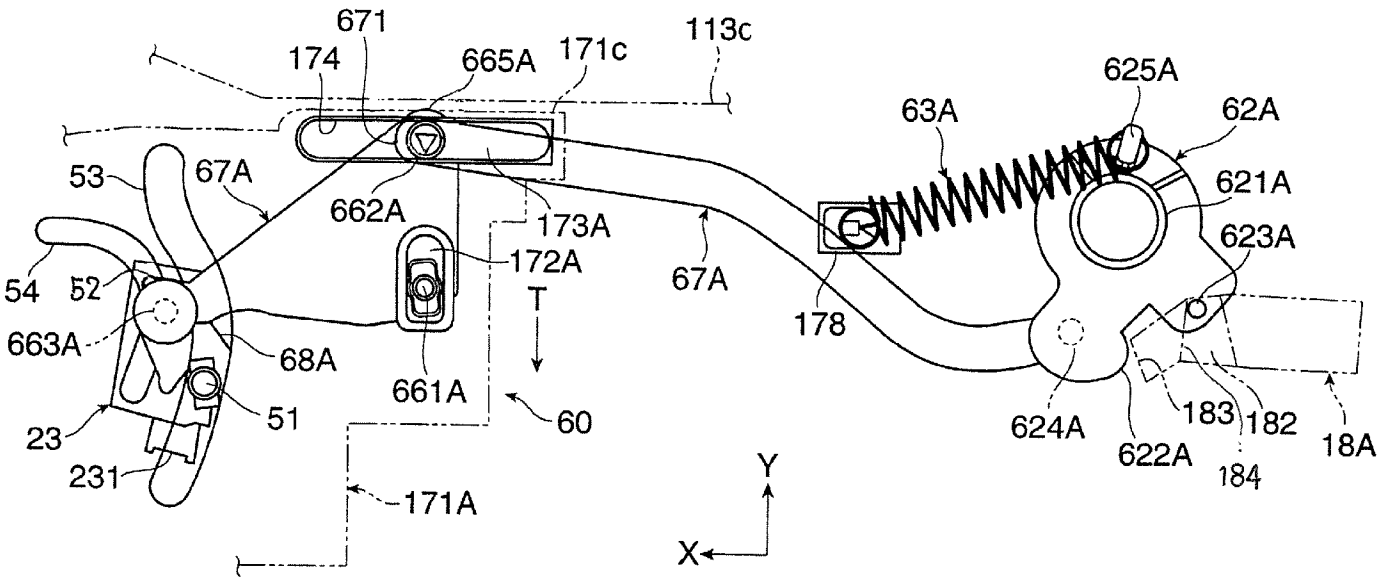
FIG. 29 is a schematic view illustrating a state in which the link mechanism and the like of the left moving apparatus operate (a state in which the exposure device is moved to a position between the exposure position and the retracted position)

In this state, as illustrated in FIGS. 25B, 26B, and 29, when the opening/closing cover 15 begins to be opened by swinging in the direction indicated by the arrow B1, the second contacting portions 184, which draw the contact operating units 18A and 18B on the opening/closing cover 15 in the link moving apparatuses 60A and 60B, come into contact with the second contacted portions 623A and 623B on the rotation bodies 62A and 62B of the power input units 61A and 61B (or the link moving apparatuses 60A and 60B) of the link mechanisms 6A and 6B, such that the rotation bodies 62A and 62B begin to rotate in the direction indicated by the broken line arrow C1.

Therefore, power, which is generated by the rotational motion performed as the rotation bodies 62A and 62B are rotated in the direction indicated by the broken line arrow C1, is transmitted to the movement mechanisms 5A and 5B through the power transmission units 65A and 65B of the link mechanisms 6A and 6B.

That is, as the rotation bodies 62A and 62B are rotated in the direction indicated by the broken line arrow C1, the coupling links 67A and 67B of the power transmission units 65A and 65B are moved away from the movement mechanisms 5A and 5B in the direction indicated by the broken line arrow D1, and the first coupling shafts 662A and 662B of the rotation links 66A and 66B are moved along the guide grooves 173A and 173B in the direction indicated by the broken line arrow E1 by the movements of the coupling links 67A and 67B.

Here, the operation of rotating the rotation bodies 62A and 62B in the direction indicated by the broken line arrow C1 by the contact of the contact operating units 18A and 18B on the opening/closing cover 15 that swings in the direction indicated by the arrow B1 is ceased in a step in which the opening/closing cover 15 begins to be opened and the contact operating units 18A and 18B are spaced apart from the second contacted portions 623A and 623B of the rotation bodies 62A and 62B, at a front position where the first coupling shafts 662A and 662B, which move in the direction indicated by the broken line arrow E1, reach one end of the guide groove 173A and one end of the guide groove 173B.

However, as illustrated in FIGS. 25B and 26B, the rotations of the rotation bodies 62A and 62B in the direction indicated by the broken line arrow C1 are continued as tension TA1 and TB1 of the tension springs 63A and 63B continues to be applied as the biasing force MA1 and MB1 that rotates the rotation bodies 62A and 62B in the direction indicated by the arrow C1.

In this case, in the link moving apparatuses 60A and 60B, the rotation bodies 62A and 62B are rotated in the direction indicated by the arrow C1 only when the second contacting portions 184 of the contact operating units 18A and 18B are in contact with the second contacted portions 623A and 623B of the rotation bodies 62A and 62B.

Subsequently, as the first coupling shafts 662A and 662B are moved in the direction indicated by the broken line arrow E1, the rotation links 66A and 66B are rotated about the fulcrum shafts 661A and 661B in a direction indicated by the broken line arrow G1, and the second coupling shafts 663A and 663B are also moved in the direction indicated by the broken line arrow G1 by the rotations of the rotation links 66A and 66B. In this case, the second coupling shafts 663A and 663B are moved while drawing trajectories including approximately curved arc lines from a lower position to an upper position.

Subsequently, power, which is generated by the rotational motion performed as the second coupling shafts 663A and 663B of the rotation links 66A and 66B move (swing) in the direction indicated by the broken line arrow G1, is transmitted to the first projections 51 of the exposure device 23 through the connection links 68A and 68B.

Therefore, the first projections 51 are moved by being guided by the first guide grooves 53 in the movement mechanisms 5A and 5B, such that the first projections 51 are moved from lower positions of the first guide grooves 53 to upper positions of the first guide grooves 53. In addition, together with the movements of the first projections 51, the second projections 52 of the exposure device 23 are moved by being guided by the second guide grooves 54 in the movement mechanisms 5A and 5B, such that the second projections 52 are moved from lower positions of the second guide grooves 54 to upper positions of the second guide grooves 54.

Therefore, as illustrated in FIGS. 4, 6, 25B, and 26B, when the opening/closing cover 15 is opened, the movement mechanisms 5A and 5B operate to move the exposure device 23 (from the exposure position P1) to the retracted position P2 in cooperation with the operation of opening the opening/closing cover 15.

As illustrated in FIGS. 4 and 6, the exposure device 23, which is moved to the retracted position P2 by the movement mechanisms 5A and 5B, is maintained in a stopped posture in a state in which (the light exit surface 233 of) the exposure main body portion 231 is directed obliquely upward. For example, the direction directed obliquely upward is a direction directed upward in the longitudinal direction of the second detachment passage space S2.

In this connection, the exposure device 23 is stopped at the retracted position P2 by the following construction.

That is, in this step, the contact operating units 18A and 18B of the opening/closing cover 15 are completely spaced apart from the rotation bodies 62A and 62B. However, as illustrated in FIGS. 25B and 26B, the rotation bodies 62A and 62B of the link mechanisms 6A and 6B continue to receive the tension TA1 and TB1 of the tension springs 63A and 63B as the biasing force MA1 and MB1 that rotates the rotation bodies 62A and 62B in the direction indicated by the arrow C1, and as a result, the rotation bodies 62A and 62B continue to rotate in the direction indicated by the broken line arrow C1. For this reason, the rotational motion (power) when the rotation bodies 62A and 62B continue to rotate in the direction indicated by the broken line arrow C1 is transmitted by the power transmission units 65A and 65B as force FA1 and FB1 that continues to rotate the rotation links 66A and 66B in the direction indicated by the broken line arrow G1.

As a result, since the rotation links 66A and 66B continue to rotate in the direction indicated by the broken line arrow G1, the first projections 51 and the second projections 52 of the exposure device 23 remain stopped at upper positions of the first guide grooves 53 and the second guide grooves 54.

The exposure device 23 is moved to the retracted position P2 by the movement mechanisms 5A and 5B, such that the exposure device 23 is present in the narrow space S5 which is a position outside the second detachment passage space S2, as illustrated in FIG. 4.

Therefore, in the image forming apparatus 1, the operation of detaching (moving) the detachable unit 20 by using the second detachment passage space S2 is performed without hindrance caused by the presence of the exposure device 23. In addition, when the exposure device 23 is at the retracted position P2, the exposure device 23 is not in the stopped posture in a state in which the exposure main body portion (light exit portion) 231 is directed toward the second detachment passage space S2, and as a result, there is no concern that the detachable unit 20 causes erroneous contact while passing through the second detachment passage space S2, such that the exposure main body portion 231 is damaged.

In the image forming apparatus 1, when the exposure device 23 is at the retracted position P2, the exposure device 23 is in the stopped posture in a state in which the exposure main body portion 231 (light exit surface 233) is directed toward an upper surface side opening of the casing 10 which is opened by the opening/closing cover 15. For this reason, it is possible to clean (the light exit surface 233 of) the exposure main body portion 231 of the exposure device 23 while checking (the light exit surface 233 of) the exposure main body portion 231 with the naked eye unless another constituent component (in other words, obstacle) is interposed between the exposure device 23 and the upper surface side opening of the casing 10 when the exposure device 23 is at the retracted position P2.

As illustrated in FIG. 6, the movement mechanisms 5A and 5B of the image forming apparatus 1 are configured, by the setting of the first guide grooves 53 and the second guide grooves 54, such that the exposure device 23 is moved so that the stopped posture at the retracted position P2 is a posture rotated by 90° or more with respect to the stopped posture at the exposure position P1. In this case, as indicated by an intersection angle θ between straight lines K1 and K2 indicated by the two alternate-long-and-two-short-dashes lines in FIG. 6, the posture rotated by 90° or more is a posture which is rotated so that the intersection angle θ is 90° or more.

For this reason, in the movement mechanisms 5A and 5B, the stopped posture of the exposure device 23 at the exposure position P1 and the stopped posture of the exposure device 23 at the retracted position P2 may be changed to different postures which are rotated by 90 degrees or more.

Operation when Closing the Opening/Closing Cover:

Next, an operation of closing the opening/closing cover 15 in the opened state will be described.

In this case, in a step in which the opening/closing cover 15 is opened, as illustrated in FIGS. 4, 25B, and 26B, the movement mechanisms 5A and 5B are maintained in the state in which the operation of moving the exposure device 23 to the retracted position P2 is finished.

In this state, as illustrated in FIGS. 25A, 25B, 26A, 26B, and 30, when the opening/closing cover 15 begins to be closed by swinging in the direction indicated by the arrow B2, the first contacting portions 183 of the contact operating units 18A and 18B on the opening/closing cover 15 in the link moving apparatuses 60A and 60B come into contact with the first contacted portions 622A and 622B of the rotation bodies 62A and 62B of the power input units 61A and 61B (or the link moving apparatuses 60A and 60B) of the link mechanisms 6A and 6B, and then the rotation bodies 62A and 62B begin to rotate in the direction indicated by the broken line arrow C2.

Therefore, power, which is generated by the rotational motion performed as the rotation bodies 62A and 62B are rotated in the direction indicated by the broken line arrow C2, is transmitted to the movement mechanisms 5A and 5B through the power transmission units 65A and 65B of the link mechanisms 6A and 6B.

That is, as the rotation bodies 62A and 62B are rotated in the direction indicated by the broken line arrow C2, the coupling links 67A and 67B of the power transmission units 65A and 65B are moved toward the movement mechanisms 5A and 5B in the direction indicated by the broken line arrow D2. Thereafter, the first coupling shafts 662A and 662B of the rotation links 66A and 66B are moved along the guide grooves 173A and 173B in the direction indicated by the broken line arrow E2 by the movements of the coupling links 67A and 67B.

Here, in the link moving apparatuses 60A and 60B, the operation in which parts of the contact operating units 18A and 18B on the opening/closing cover 15, which swings in the direction indicated by the arrow B2, come into contact with the rotation bodies 62A and 62B to rotate the rotation bodies 62A and 62B in the direction indicated by the broken line arrow C2 is performed by the following two-step operation.

Figure 28:
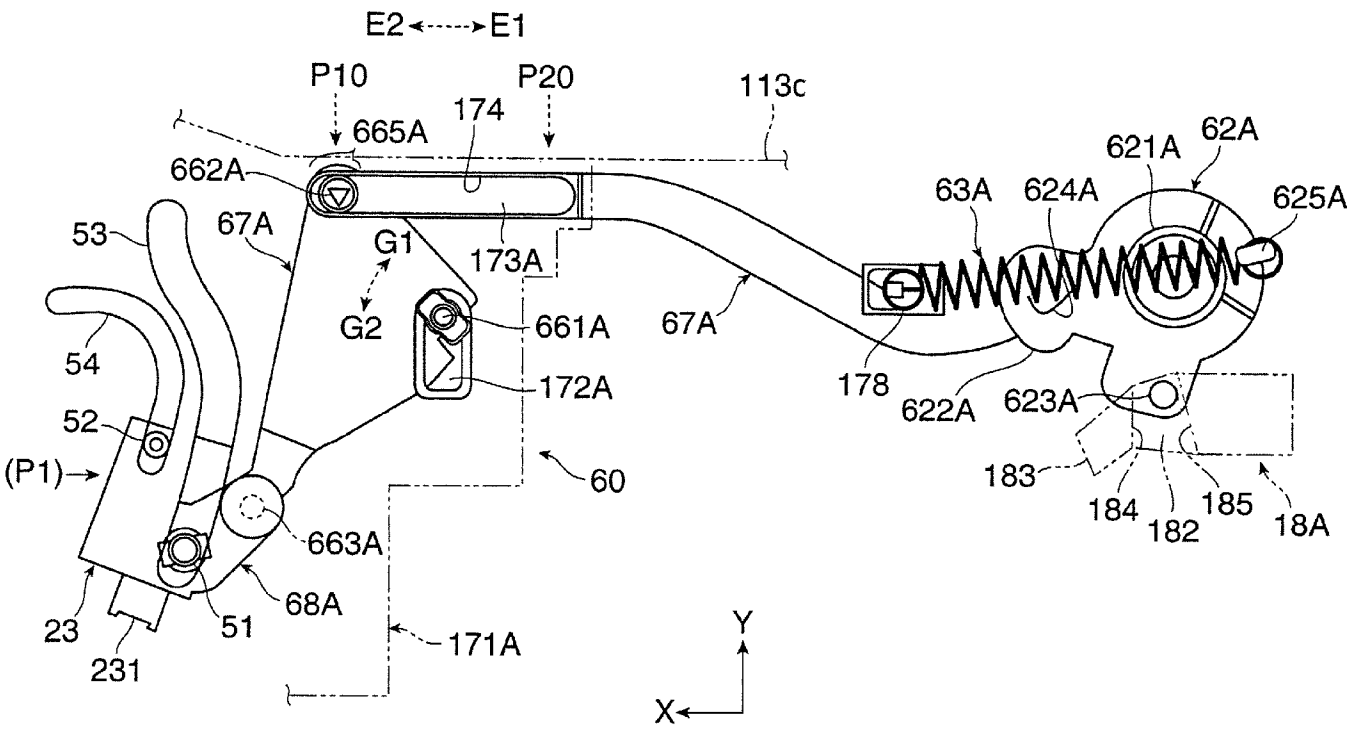
FIG. 28 is a schematic view illustrating a state in which the link mechanism and the like of the left moving apparatus operate (a state in which the exposure device is moved to the exposure position)
Figure 30:
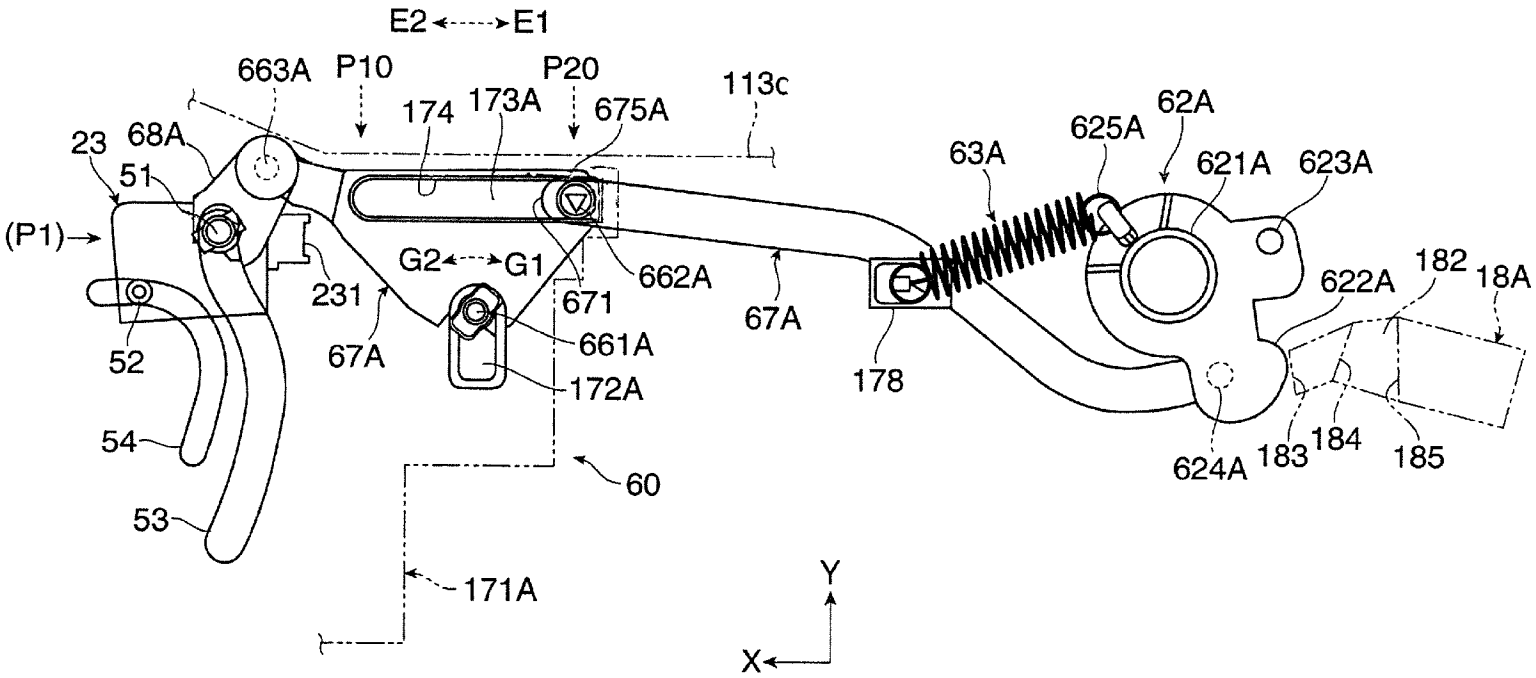
FIG. 30 is a schematic view illustrating a state in which the link mechanism and the like of the left moving apparatus operate (a state in which the exposure device is moved to the retracted position)
Figure 31A:
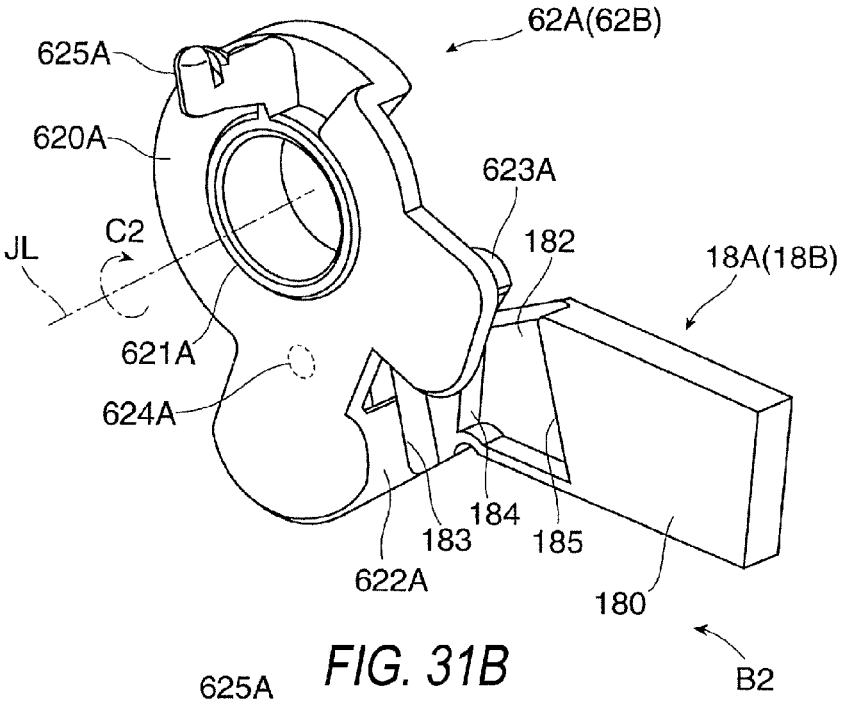
FIG. 31A is a schematic perspective view illustrating a state in which a first contacting portion of the contact operating unit in FIG. 9 is in contact with a first contacted portion of the rotation body in FIG. 9.
Figure 31B:
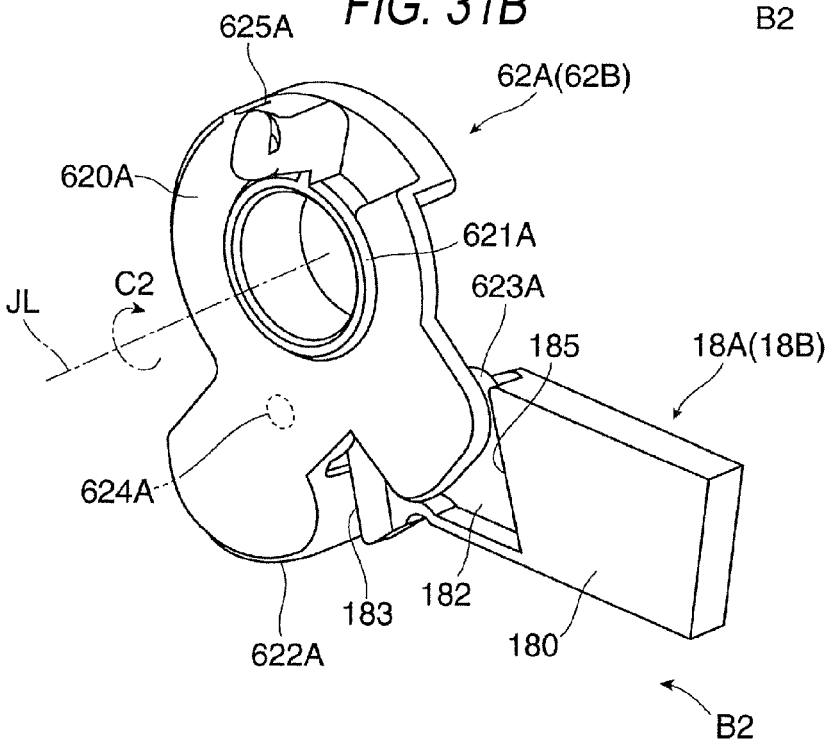
FIG. 31B is a schematic perspective view illustrating a state in which a third contacting portion of the contact operating unit is in contact with a second contacted portion of the rotation body.
Figure 32:
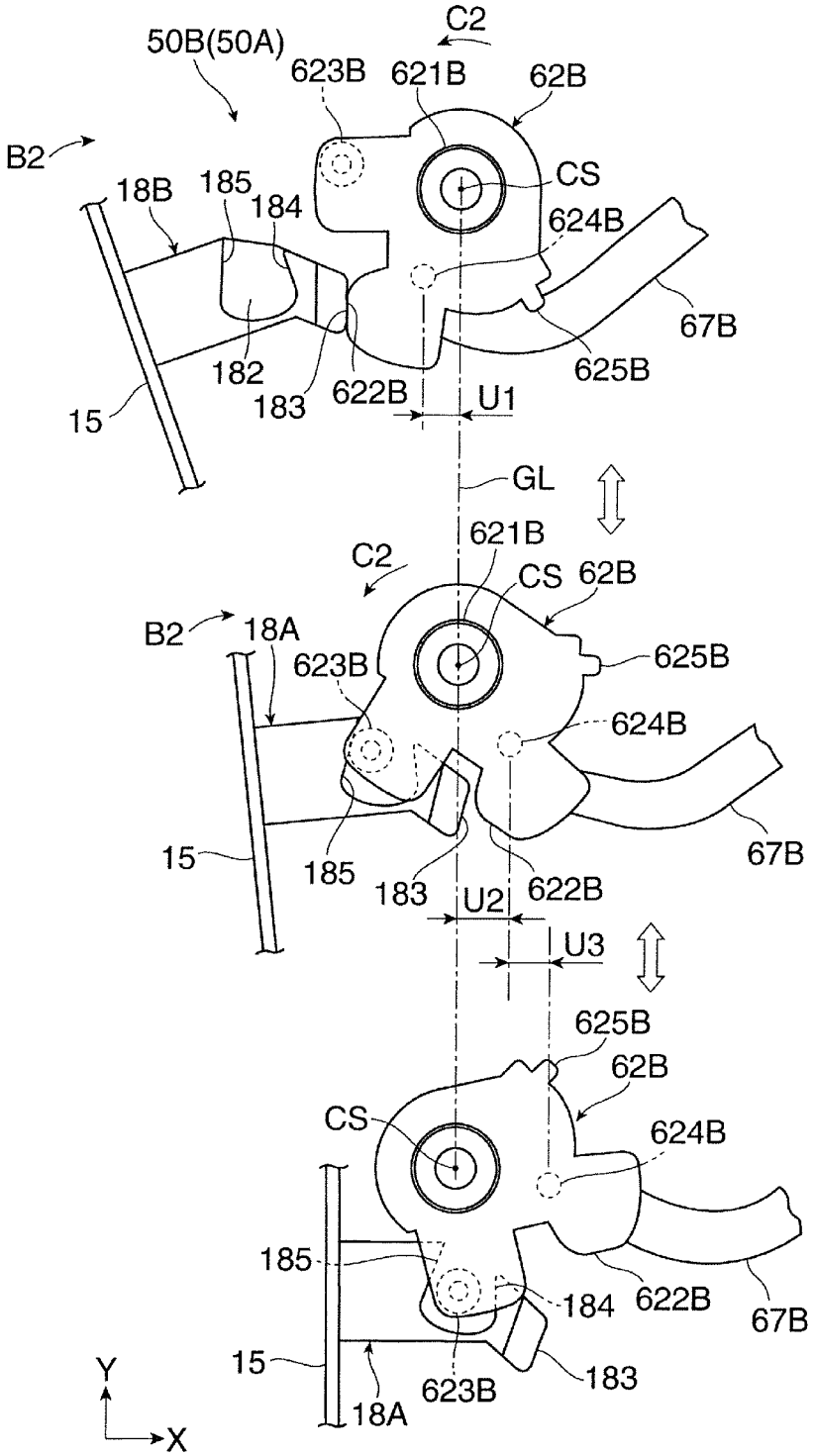
FIG. 32 is a schematic view illustrating an operating state of the link operating apparatus and the amount by which a coupling link connected to the rotation body is moved.

That is, in the link moving apparatuses 60A and 60B, the operation is changed from an operation of a first step in which the first contacting portions 183 of the contact operating units 18A and 18B come into contact with the first contacted portions 622A and 622B of the rotation bodies 62A and 62B to rotate the rotation bodies 62A and 62B as illustrated in FIGS. 30 and 31A, and an upper part in FIG. 32 to an operation of a second step in which the third contacting portions 185 serving as pressure portions in the contact operating units 18A and 18B come into contact with the second contacted portions 623A and 623B of the rotation bodies 62A and 62B to rotate the rotation bodies 62A and 62B as illustrated in FIGS. 28 and 31B, and an intermediate part in FIG. 32.

When the operation is changed from the operation of the first step to the operation of the second step, the state in which the first contacting portions 183 of the contact operating units 18A and 18B are in contact with the first contacted portions 622A and 622B of the rotation bodies 62A and 62B is ceased (released) in a step in which the third contacting portions 185 of the contact operating units 18A and 18B begin to come into contact with the second contacted portions 623A and 623B of the rotation bodies 62A and 62B.

In this case, in the link moving apparatuses 60A and 60B, the first contacting portions 183 and the third contacting portions 185 of the contact operating units 18A and 18B sequentially come into contact with the first contacted portions 622A and 622B and the second contacted portions 623A and 623B of the rotation bodies 62A and 62B, thereby rotating the rotation bodies 62A and 62B in the direction indicated by the arrow C2.

Therefore, the amount of rotations of the rotation bodies 62A and 62B in the direction indicated by the broken line arrow C2 may be further increased, for example, in comparison with a case in which the first contacting portions 183 of the contact operating units 18A and 18B just come into contact with the first contacted portions 622A and 622B of the rotation bodies 62A and 62B (a case in which only the operation of the first step is performed).

In FIG. 32, reference numeral CS indicates a rotation center (a position through which the axis JL passes) of the shaft portion 621B of the rotation body 62B. For example, assuming that a straight line, which is connected to the rotation center CS of the coupling shaft 624B immediately before the first contacting portion 183 comes into contact with the first contacted portion 622B, is defined as a reference line, the rotation amount may be ascertained by degrees of central angles with respect to the rotation center CS at respective positions of the coupling shaft 624B when the rotation body 62B is rotated relative to the reference line in the direction indicated by the arrow C2.

The increase in rotation amount (or the central angle) of the rotation body 62B (62A) increases the movement amount (distance) U of the coupling link 67B connected to the rotation body 62B (62A) in a direction D2 in which the coupling link 67B moves away from the rotation body 62B (62A), as illustrated in FIG. 32. Furthermore, the increase in rotation amount (or central angle) of the rotation body 62B (62A) increases the rotation amount of the rotation link 66B (66A) that rotates as the coupling link 67B moves in the directions indicated by the arrows D1 and D2, and finally, the increase in rotation amount (or central angle) of the rotation body 62B (62A) also leads to an increase in movement amount of the exposure device 23 by the movement mechanisms 5A and 5B to which the rotation amount of the rotation link 66B (66A) is reflected.

FIG. 32 illustrates the movement amount U of the coupling link 67B as a distance between the coupling shaft 624A of the rotation body 62B connected to one end of the coupling link 67B and a virtual centerline GL extending in the direction of gravity from the rotation center CS of the rotation body 62B.

As illustrated in FIG. 32, the movement amount U of the coupling link 67B of the link moving apparatus 60B (60A) is a first movement amount (U1+U2) at the time of the operation of the first step, and a second movement amount (U3) at the time of the operation of the second step. As described above, the movement amount U of the coupling link 67B when the operation to the second step is performed is increased by a movement amount U4 in comparison with the first movement amount when only the operation of the first step is performed.

Subsequently, as the first coupling shafts 662A and 662B are moved in the direction indicated by the broken line arrow E2, the rotation links 66A and 66B are rotated about the fulcrum shafts 661A and 661B in the direction indicated by a broken line arrow G2, and the second coupling shafts 663A and 663B are also moved in the direction indicated by the broken line arrow G2 by the rotations of the rotation links 66A and 66B. In this case, the second coupling shafts 663A and 663B are moved while drawing trajectories having approximately arc shapes from the upper position to the lower position.

Subsequently, power, which is generated by the rotational motion performed as the second coupling shafts 663A and 663B of the rotation links 66A and 66B are moved in the direction indicated by the broken line arrow G2, is transmitted to the first projections 51 of the exposure device 23 through the connection links 68A and 68B.

Therefore, as illustrated in FIGS. 32 to 28 in a reverse direction, the first projections 51 are moved by being guided by the first guide grooves 53 in the movement mechanisms 5A and 5B, such that the first projections 51 are moved from the upper positions of the first guide grooves 53 to the lower positions of the first guide grooves 53. In addition, together with the movements of the first projections 51, the second projections 52 of the exposure device 23 are moved by being guided by the second guide grooves 54 in the movement mechanisms 5A and 5B, such that the second projections 52 are moved from the upper positions of the second guide grooves 54 to the lower positions of the second guide grooves 54.

Therefore, as illustrated in FIGS. 2, 6, 25A, 25B, 26A, 26B, and 28, when the opening/closing cover 15 is closed, the movement mechanisms 5A and 5B operate to move the exposure device 23 (from the retracted position P2) to the exposure position P1 in cooperation with the operation of closing the opening/closing cover 15.

As illustrated in FIGS. 4 and 6, the exposure device 23, which is moved to the exposure position P1 by the movement mechanisms 5A and 5B, is maintained in a stopped posture in a state in which (the light exit surface 233 of) the exposure main body portion 231 is directed obliquely downward (toward the exposure position of the photoconductive drum 21: the position where the electrostatic latent image is formed).

In this case, the exposure device 23 is stopped at the exposure position P1 by the following construction.

First, the exposure device 23, which is moved to the exposure position P1 by being guided by the first guide grooves 53 in the movement mechanisms 5A and 5B, stops moving at a point in time at which parts (a bottom portion or a side surface portion) at the both ends 238 of the exposure main body portion 231 come into contact with the non-illustrated positioning portions 29 provided on the detachable unit 20.

In this case, as illustrated in FIGS. 25A and 26A, the rotation links 66A and 66B continue to receive the force FA2 and FB2 that rotates the rotation links 66A and 66B in the direction indicated by the arrow G2 through the link mechanisms 6A and 6B by the operation of closing the opening/closing cover 15, and as a result, the force FA2 and FB2 is transmitted to the first projections 51 from the second coupling shafts 663A and 663B through the connection links 68A and 68B.

Therefore, the mounting members 236 having the first projections 51 are pressed toward the positioning portions. Therefore, the compression springs 237 are further compressed. For this reason, the exposure main body portion 231 of the exposure device 23 is biased by the compression springs 237 so as to be displaced with respect to the mounting members 236 in the direction indicated by an arrow J2 (FIGS. 11A and 11B), and as a result, the exposure main body portion 231 is strongly pressed against the positioning portions and thus rigidly positioned.

Also in this case, the rotation links 66A and 66B continue to be rotated in the direction indicated by the arrow G2 through the link mechanisms 6A and 6B by the operation of closing the opening/closing cover 15, and as a result, the connection links 68A and 68B continue to swing in the direction indicated by the arrow H2 about the first projections 51 on the mounting members 236 of the exposure device 23 which are stopped by coming into contact with the positioning portions, as illustrated in FIGS. 25A and 26A.

Therefore, the connection links 68A and 68B are in the stopped posture at a point in time at which the second coupling shafts 663A and 663B of the rotation links 66A and 66B move to the region where the second coupling shafts 663A and 663B go beyond the straight lines connecting the fulcrum shafts 661A and 661B of the rotation links 66A and 66B and the first projections 51 and come into contact with the stop portions 179. In this case, the second coupling shafts 663A and 663B pass through dead points which are positions that intersect the straight lines. In addition, in this case, in the rotation links 66A and 66B and the connection links 68A and 68B, each of the lines, which connect the fulcrum shafts 661A and 661B, the second coupling shafts 663A and 663B, and the first projections 51, is a line bent entirely in a dogleg shape because the positions of the second coupling shafts 663A and 663B deviate and protrude from the straight lines in the direction indicated by the arrow G2 or the arrow H2.

Subsequently, in this case, as illustrated in FIGS. 31A and 31B, the connection links 68A and 68B receive, from the first projections 51, reactions which are generated on the mounting members 236 by the biasing force of the compression springs 237 at the both ends 238 of the exposure main body portion 231. In addition, as illustrated in FIGS. 25A and 26A, the mounting members 236 are returned by the reactions in a direction indicated by an arrow J1.

Therefore, the stopped posture of the connection links 68A and 68B is maintained since parts of the ends of the connection links 68A and 68B, which are connected to the second coupling shafts 663A and 663B of the rotation links 66A and 66B, remain being in contact with the non-illustrated stop portions.

As a result, the rotation links 66A and 66B receive the reactions which are generated on the mounting members 236 by the biasing force of the compression spring 237, such that the rotation links 66A and 66B are maintained in the stopped posture without being rotated in the direction opposite to the direction indicated by the arrow H2. Therefore, the exposure main body portion 231 of the exposure device 23 continues to be in contact with the positioning portions 29 of the detachable unit 20, such that the exposure main body portion 231 is maintained in the stopped state at the exposure position P1.

In this connection, when the rotation links 66A and 66B are maintained in the stopped state, the rotation links 66A and 66B receive no force FA2 and FB2 that rotates the rotation links 66A and 66B in the direction indicated by the arrow G2.

That is, in this case, as illustrated in FIGS. 25A and 26A, in the link mechanisms 6A and 6B and the link operating apparatuses 60A and 60B, the tension springs 63A and 63B further extend in comparison with the case in which the exposure device 23 is at the retracted position P2, but the tension springs 63A and 63B are also in the stopped state as parts of the tension springs 63A and 63B approach until the parts of tension springs 63A and 63B include the rotation centers CS of the shaft portions 621A and 621B of the rotation bodies 62A and 62B.

For this reason, in this case, the tension TA2 and TB2 of the tension springs 63A and 63B is not applied as biasing force that rotates the rotation bodies 62A and 62B in the direction indicated by the broken line arrow C2, but the tension TA2 and TB2 is slightly applied as the biasing force MA2 and MB2 that rotates the rotation bodies 62A and 62B in the direction indicated by the broken line arrow C1.

Therefore, in this case, since the rotation bodies 62A and 62B are rotated in the direction indicated by the arrow C1 by receiving the tension TA2 and TB2 of the tension springs 63A and 63B, the rotational motion (power) of the rotation bodies 62A and 62B is not transmitted, through the power transmission units 65A and 65B, as the force FA2 and FB2 that rotates the rotation links 66A and 66B in the direction indicated by the arrow G2, as illustrated in FIGS. 25A and 26A.

In a step in which the opening/closing cover 15 is completely closed (in a locked state), the second contacted portions 623A and 623B of the rotation bodies 62A and 62B are present at intermediate positions of the recess portions 182 (FIG. 9) of the contact operating units 18A and 18B of the opening/closing cover 15, as illustrated in FIG. 26A and a lower end in FIGS. 31A and 31B, such that the contact operating units 18A and 18B remain not in contact with the second contacted portions 623A and 623B.

For example, this configuration is configured as described below.

That is, when the opening/closing cover 15 is closed, the opening/closing cover 15 is configured to swing, with over stroke, to a swinging end position which deviates, by several millimeters, in a closing direction indicated by the arrow B2 beyond a fixed position at which the opening/closing cover 15 is locked by a non-illustrated locking unit (latch mechanism), and the opening/closing cover 15 is configured to receive, from a non-illustrated biasing unit (spring), slight biasing force that slightly returns the opening/closing cover 15 in an opening direction indicated by the arrow B1.

Therefore, during the process of closing the opening/closing cover 15, the third contacting portions 185 of the contact operating units 18A and 18B come into contact with the second contacted portions 623A and 623B of the rotation bodies 62A and 62B, and the third contacting portions 185 continue to be in contact with the second contacted portions 623A and 623B until the connection links 68A and 68B are in the stopped posture. However, when the connection links 68A and 68B receive the reactions and thus are maintained in the stopped posture, the rotation bodies 62A and 62B are in the stopped state by the entire relationship of the link mechanisms 6A and 6B, whereas the opening/closing cover 15 returns back to the fixed position from the swinging end position by receiving the biasing force. As a result, the contact operating units 18A and 18B are moved slightly in the direction indicated by the arrow B1 as the opening/closing cover 15 swings such that the contact operating units 18A and 18B are spaced apart from the second contacted portions 623A and 623B of the rotation bodies 62A and 62B.

As illustrated in FIG. 2, as the exposure device 23 is moved to the exposure position P1 by the movement mechanisms 5A and 5B, the exposure device 23 is in a state in which an electrostatic latent image may be formed on the photoconductive drum 21 by the exposure.

In the second exemplary embodiment, in the image forming apparatus 1, when the exposure device 23 is moved to the retracted position P2 by opening the opening/closing cover 15, the passage openings 117 provided in the casing 10 are exposed and opened to the outside. For this reason, for example, as illustrated in FIGS. 33A and 33B, an erroneous operation is likely to be made, which rotates an article 200 such as a rod or a plate, which may pass through the passage opening 117, the rotation body 62A (62B) in the direction indicated by the arrow C2 intentionally or in error through the passage opening 117 and thus moves the exposure device 23 to the exposure position P1.

However, since the image forming apparatus 1 has the link operating apparatus 60A (60B), the second contacted portion 623A of the rotation body 62A comes into contact with a part of the article 200, as illustrated in FIG. 33B, even in a case in which (tip portion of) the article 200, which is inserted from the passage opening 117, is intended to come into contact with the first contacted portion 622A of the rotation body 62A and rotate the rotation body 62A in the direction indicated by the arrow C2, as illustrated in FIG. 33A.

Therefore, in the image forming apparatus 1, the article 200 cannot be further pressed inward and cannot be rotated the rotation body 62A in the direction indicated by the arrow C2. As a result, the rotation body 62A cannot be rotated to the necessary extent in the direction indicated by the arrow C2, such that the exposure device 23 cannot be moved to and fixed at the exposure position P1.

In the second exemplary embodiment, there is a relationship in which the paths of the first guide grooves 53 are different from trajectories along which the second coupling shafts 663A and 663B of the rotation links 66A and 66B swing. However, in the movement mechanisms 5A and 5B and the link mechanisms 6A and 6B in the second exemplary embodiment, the first projections 51, which are provided on the mounting members 236 of the exposure device 23 and guided by the first guide grooves 53, and the second coupling shafts 663 of the rotation links 66A and 66B are connected by the connection links 68A and 68B, and as a result, the exposure device 23 moves smoothly between the exposure position P1 and the retracted position P2.

In the second exemplary embodiment, the long side guide portions 174 are provided in the guide grooves 173A and 173B in the link mechanism parts 60 of the link mechanisms 6A and 6B, and the support grooves 172A and 172B are configured as long grooves as described above (FIGS. 12A and 12B).

Therefore, as illustrated in FIGS. 28 to 30, when the rotation links 66A and 66B are rotated about the fulcrum shafts 661A and 661B, the fulcrum shafts 661A and 661B are temporarily displaced (moved) in the support grooves 172A and 172B in a direction T away from the guide grooves 173A and 173B, and simultaneously, the first coupling shafts 662A and 662B are moved rectilinearly by being guided by the long side guide portions 174 in the guide grooves 173A and 173B when the first coupling shafts 662A and 662B are moved between the two points (P10 and P20) (see FIG. 29).

As a result, degrees to which portions 665A and 665B of the rotation links 66A and 66B, where the first coupling shafts 662A and 662B are present, protrude from portions (in this example, the long side guide portions 174), which are opposite to the support grooves 172A and 172B, of the guide grooves 173A and 173B that guide the first coupling shafts 662A and 662B to allow the first coupling shafts 662A and 662B to move between the two points (P10 and P20) are decreased in accordance with the rotations of the rotation links 66A and 66B (see FIG. 29).

Therefore, in the image forming apparatus 1, the link mechanism parts 60 may be easily disposed in the state in which the link mechanism parts 60 are close to upper surface bent portions 113*d* and 114*d* which are an example of the inner wall surfaces of the side surface portions 113 and 114 of the casing 10 (FIGS. 25A and 25B to FIG. 28).

Another Exemplary Embodiment

The first exemplary embodiment provides the configuration example in which the first projections 51, which are fixed on the mounting members 236, are applied as the coupling shafts that couple the mounting members 236 of the exposure device 23 and the connection links 68A and 68B in the moving apparatus parts 50A and 50B. However, projections (shaft portions), which are fixed on the connection links 68A and 68B, may be applied as the coupling shafts, for example. In the case in which the projections (shaft portions), which are fixed on the connection links 68A and 68B, are applied as the coupling shafts, the projections are rotatably provided on the mounting members 236.

The first exemplary embodiment provides the configuration example in which the stop portions 179 are provided on the second support members 175A and 175B, but the stop portions 179 may also be provided at portions other than the second support members 175A and 175B, and for example, the stop portions 179 may be provided on the first support members 171A and 171B.

The first exemplary embodiment provides the case in which the tension springs 63A and 63B, which have end portions mounted on the rotation bodies 62A and 62B of the link mechanisms 6A and 6B, are applied as the second biasing units that bias the rotation links 66A and 66B to swing the rotation links 66A and 66B in the direction (the direction indicated by the arrow G1) in which the exposure device 23 is moved to the retracted position P2. However, the other biasing units may be applied as the second biasing units, and for example, tension springs, which have end portions mounted on the rotation links 66A and 66B, may be applied.

The first exemplary embodiment provides the configuration example in which the detachable unit 20 having the photoconductive drum 21 is applied as the detachable unit having the positioning portions 29 for the exposure device 23. However, the detachable unit is not limited thereto, and for example, a detachable unit, which has the positioning portions 29 but does not have the photoconductive drum 21, may be applied.

The first exemplary embodiment provides the case in which the opening/closing cover 15 is applied as the swing unit for swinging the rotation links 66A and 66B in the directions indicated by the arrows G1 and G2 in the moving apparatus parts 50A and 50B. However, the swing unit is not limited thereto, and for example, an operating lever, which operates to swing the rotation links 66A and 66B in the directions indicated by the arrows G1 and G2, may be applied.

The first exemplary embodiment exemplifies the image forming apparatus 1, which adopts the electrophotographic process, as the image forming apparatus using the moving apparatus parts 50A and 50B. However, the image forming apparatus using the moving apparatus parts 50A and 50B is not particularly limited in respect to configurations other than the moving apparatus parts 50A and 50B as long as the image forming apparatus needs to move the exposure device 23 between the exposure position P1 and the retracted position P2.

The second exemplary embodiment exemplifies that the rotation body 62 of the link moving apparatus 60, which is an example of a rotating unit, includes the two contacted portions 622 and 623, but the rotating unit may have three or more contacted portions. In addition, the rotation body 62 having the disk-shaped main body portion 620 is exemplified as the rotating unit, but the rotating unit may have a main body portion having other shapes or may have no main body portion but have a shaft portion that also serves as a main body.

The second exemplary embodiment provides the configuration example in which the rotation bodies 62, as the rotating units, are provided as the protruding portions formed as the two contacted portions 622 and 623 protrude in the identical direction JL2 along the axis JL of the shaft portions 621, but as necessary, plural contacted portions may be configured to be provided as protruding portions that protrude in the different directions JL1 and JL2 in the direction along the axis JL of the shaft portions.

However, in the rotating unit, it is easier to decrease a dimension of the rotating unit in the axial direction JL in the case in which the contacted portions are provided in the identical direction along the axis JL of the shaft portions in comparison with the case in which the plural contacted portions are provided as the protruding portions that protrude in different directions along the axis JL of the shaft portions.

The second exemplary embodiment provides the configuration in which the three contacting portions 183 to 185 are provided as the contact operating units 18 which are an example of moving contact units of the link moving apparatus 60, but two or four or more contacting portions may be provided as the moving contact units.

The second exemplary embodiment exemplifies the structure in which the three contacting portions 183 to 185 are provided as the moving contact units on the single main body portion 180 (including the bent tip portions 181), but as necessary, there may be a structure in which plural contacting portions are distributed on plural main body portions as the moving contact units. However, it is easier to decrease a size of the moving contact unit and simplify a structure of the moving contact unit in the structure in which the plural contacting portions are provided on the single main body portion in comparison with the structure in which the plural contacting portions are distributed on the plural main body portions.

The second exemplary embodiment provides the configuration example in which in the link moving apparatus 60, the first contacting portion 183 and the third contacting portion 185 of the contact operating unit 18 sequentially come into contact with the first contacted portion 622 and the second contacted portion 623 of the rotation body 62 to rotate the rotation body 62 when closing the opening/closing cover 15, but the second contacting portion 184 of the contact operating unit 18 comes into contact with the second contacted portion 623 of the rotation body 62 to rotate the rotation body 62 when opening the opening/closing cover 15. However, the link moving apparatus 60 may be configured such that any two or more contacting portions of the contact operating unit 18 may sequentially come into contact with any of two or more contacted portions of the rotation body 62 to rotate the rotation body 62 even when opening the opening/closing cover 15.

The second exemplary embodiment provides the configuration example in which in the image forming apparatus 1, the contact operating unit 18, which is an example of the moving contact unit, is provided on the opening/closing cover 15, which is an example of the swing unit in the link moving apparatus 60. However, in addition to this, for example, the contact operating unit 18 may be configured to be provided on a swing unit such as an operating lever that operates to swing the contact operating unit 18 which is an example of the moving contact unit, or the contact operating unit 18 may be configured to be provided on an advancing and retracting unit, such as an operating lever, a cleaning member, or a sheet feeding cassette, that is operated to advance and retract.

The second exemplary embodiment provides the configuration example in which the link moving apparatuses 60A and 60B are used for the image forming apparatus 1. However, the link moving apparatuses 60A and 60B may be applied to apparatuses other than the image forming apparatus as long as the apparatus uses a link unit which is connected to a part of the rotating unit and displaced in accordance with the rotation of the rotating unit.

The second exemplary embodiment exemplifies the image forming apparatus 1, which adopts the electrophotographic process, as the image forming apparatus to which the link moving apparatuses 60A and 60B are applied. However, the image forming apparatus, to which the link moving apparatuses 60A and 60B are applied, may be an image forming apparatus that adopts other image forming methods (ink discharge method) or other image forming configurations as long as the image forming apparatus uses the link unit which is connected to a part of the rotating unit and displaced in accordance with the rotation of the rotating unit.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A moving apparatus comprising:

an exposure unit configured to form a latent image by exposure;

a support unit configured to support the exposure unit so that the exposure unit is displaceable, the support unit comprising a guide groove configured to guide a movement of the support unit to move the exposure unit between an exposure position and a retracted position;

a first link unit comprising:

a first shaft portion, and a second shaft portion that swings about the first shaft portion to transmit force used to move the exposure unit;

a second link unit connecting the support unit and the second shaft portion of the first link unit;

a coupling shaft connecting the support unit and the second link unit and being guided by the guide groove; and a first biasing unit configured to bias the exposure unit in the support unit to displace the exposure unit toward the exposure position, the first biasing unit disposed between the exposure unit and the support unit.

2. The moving apparatus according to claim 1, wherein the second link unit is in a stopped posture in a region in which the second shaft portion goes beyond a straight line that connects the first shaft portion and the coupling shaft when the exposure unit is moved to the exposure position, and the posture is maintained by receiving, from the coupling shaft, a reaction that is generated on the support unit by biasing force of the first biasing unit.

3. The moving apparatus according to claim 1, further comprising:

a second biasing unit that biases the first link unit to swing the first link unit in a direction in which the exposure unit is moved to the retracted position, wherein the second biasing unit is configured such that a biasing force biasing the first link unit when the exposure unit is at the exposure position is smaller than that when the exposure unit is at the retracted position.

4. An image forming apparatus comprising:

an exposure unit configured to form a latent image by exposure; and a moving unit configured to move the exposure unit between an exposure position and a retracted position, wherein the moving unit includes the moving apparatus according to claim 2.

5. The image forming apparatus according to claim 4, wherein the image forming apparatus further comprises:

an apparatus main body; and a detachable unit being detachable from the apparatus main body and including a positioning portion configured such that the exposure unit is positioned by coming into contact with the positioning portion at the exposure position in the moving apparatus, wherein when the detachable unit is mounted in the apparatus main body, the exposure unit is in contact with the positioning portion of the detachable unit and the posture of the second link unit is maintained by receiving, from the coupling shaft, the reaction that is generated on the support unit by the biasing force of the second biasing unit.

6. The image forming apparatus according to claim 5, wherein the detachable unit includes a latent image holding unit configured to hold the latent image formed by the exposure unit.

7. The image forming apparatus according to claim 4, further comprising:

a swing unit being swingably provided in an apparatus main body, wherein the first link unit of the moving unit swings in cooperation with a swinging operation of the swing unit.

8. The image forming apparatus according to claim 7, wherein the swing unit is an opening/closing unit configured to open and close a part of the apparatus main body.

* * * * *